US005208604A

United States Patent [19]

Watanabe et al.

[11] Patent Number: 5,208,604

[45] Date of Patent: May 4, 1993

[54] INK JET HEAD AND MANUFACTURING METHOD THEREOF, AND INK JET APPARATUS WITH INK JET HEAD

[75] Inventors: Takashi Watanabe, Yokohama; Kazuaki Masuda, Sagamihara; Akira Goto, Yokohama; Hiroshi Kono, Yokohama; Takashi Kanzaki, Yokohama; Toshio Kashino, Chigasaki; Akio Saito, Hadano; Koyo Midorikawa, Tokyo; Toru Okumura, Yokohama; Masami Ikeda; Nobuyuki Kuwabara, both of Tokyo, all of Japan

[73] Assignee: Canon Kabushiki Kaisha, Tokyo, Japan

[21] Appl. No.: 752,909

[22] Filed: Aug. 26, 1991

Related U.S. Application Data

[63] Continuation of Ser. No. 429,811, Oct. 31, 1989, abandoned.

[30] Foreign Application Priority Data

| | | | |
|---|---|---|---|
| Jan. 13, 1989 | [JP] | Japan | 1-007403 |
| Jan. 13, 1989 | [JP] | Japan | 1-007409 |
| Jan. 13, 1989 | [JP] | Japan | 1-007410 |
| Jan. 13, 1989 | [JP] | Japan | 1-007470 |
| Jan. 18, 1989 | [JP] | Japan | 1-009181 |
| Jan. 18, 1989 | [JP] | Japan | 1-009184 |
| Jan. 28, 1989 | [JP] | Japan | 1-018079 |
| Oct. 31, 1989 | [JP] | Japan | 63-275794 |
| Oct. 31, 1989 | [JP] | Japan | 63-275797 |
| Oct. 31, 1989 | [JP] | Japan | 63-275800 |

[51] Int. Cl.[5] ..... B41J 2/16

[52] U.S. Cl. ..... 346/1.1; 346/140 R

[58] Field of Search ..... 346/1.1, 140 R

[56] References Cited

U.S. PATENT DOCUMENTS

| | | | |
|---|---|---|---|
| 4,014,029 | 3/1977 | Lane et al. | 346/140 |
| 4,312,009 | 1/1982 | Lange | 346/140 |
| 4,313,124 | 1/1982 | Hara | 346/140 R |
| 4,345,262 | 8/1982 | Shirato et al. | 346/140 R |
| 4,374,707 | 2/1983 | Pollack | 204/11 |
| 4,417,251 | 11/1983 | Sugitani | 346/1.1 |
| 4,450,455 | 5/1984 | Sugitani et al. | 346/140 |
| 4,459,600 | 7/1984 | Sato et al. | 346/140 R |
| 4,463,359 | 7/1984 | Avata et al. | 346/1.1 |
| 4,558,333 | 12/1985 | Sugitani et al. | 346/140 R |
| 4,712,172 | 12/1987 | Kiyohara et al. | 346/1.1 |
| 4,723,129 | 2/1988 | Endo et al. | 346/140 |
| 4,842,677 | 6/1989 | Wojnarowski et al. | 219/121.69 |
| 5,059,973 | 10/1991 | Watanabe | 346/1.1 |

FOREIGN PATENT DOCUMENTS

| | | |
|---|---|---|
| 0309146 | 3/1989 | European Pat. Off. . |
| 57-107848 | 7/1982 | Japan . |
| 58-217368 | 12/1983 | Japan . |
| 59-123670 | 7/1984 | Japan . |
| 59-138461 | 8/1984 | Japan . |
| 61-032761 | 2/1986 | Japan . |
| 0144360 | 7/1986 | Japan . |

OTHER PUBLICATIONS

IBM Tech. Disclosure Bulletin, vol. 17, No. 5, Oct. 1974 Hutchins, G. L., "Self-Alligned Controlling Transducers for Ink Jet Nozzles".

Znotins, T. A., et al., "Excimer Lasers: An Emerging Technology In Materials Processing," *Laser Focus*, vol. 23, No. 5, May 1987.

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

The present invention relates to a method for manufacturing an ink jet recording head having an ink path communicated with a discharge opening, a discharge energy generating element disposed in the ink path and a discharge opening plate on which the discharge opening is formed. The discharge opening plate is attached to an end surface of the ink path. The discharge opening is formed by irradiating an excimer laser light on the discharge opening plate from a side of the plate which is attached to the ink path.

13 Claims, 32 Drawing Sheets

INK JET HEAD AND MANUFACTURING METHOD THEREOF, AND INK JET APPARATUS WITH INK JET HEAD

This application is a continuation of application Ser. No. 07/429,811 filed Oct. 31, 1989, now abandoned.

BACKGROUND OF THE INVENTION

1. Field of the Invention

The present invention relates to an ink jet recording head and manufacturing method thereof and an ink jet recording apparatus.

The present invention also relates to a discharge opening (orifice) plate and manufacturing method thereof, and an ink jet recording head with the plate, and an ink jet apparatus with the head.

2. Related Background Art

As the liquid jet recording device of this type of the prior art, there have been proposed various devices such as one in which fine droplets are discharged by generating pressure difference in the liquid channel through deformation of a piezoelectric element, one in which a pair of electrodes are provided to deflect, or one in which droplets are discharged from the discharging orifices by utilizing heat energy such as by generating abruptly heat from the heat generating element arranged in the liquid channel, thereby generating bubbles, etc.

Among them, the liquid jet recording head according to the system in which the recording liquid is discharged by utilizing heat energy is particularly attracting attention as one which is capable of recording with high resolving power because liquid discharging outlets such as orifices for formation of droplets for flying by discharging droplets for recording, etc., (hereinafter also called as "orifices") can be arranged at high density, can be made compact as a whole as the recording head, can fully utilize the recent technical progresses in the field of semiconductors as well as the advantages of IC technique and microworking technique of which improvements of reliability are marked, can be easily made lengthy and planar (dimensional), etc., whereby it can be easily made into multi-nozzle and arranged at high density, and yet productivity during bulk production is good to make the production cost lower.

FIGS. 1A and 1B are respectively a schematic exploded perspective view and a schematic perspective after bonding showing an example of the liquid jet recording head of this type of the prior art.

In these Figures, 1 is a first substrate comprising Si, etc., comprising a group of electricity-heater converters and wiring portions thereof provided as the energy generating element for generating the energy to be utilized for discharging liquid on its upper surface. 8 is a second substrate, having an introducing inlet 9 for liquid for recording such as ink (hereinafter merely called as "ink"), a groove 11A for forming an ink flow channel 11 corresponding to the electricity heat converter, an ink flow channel wall 10 and a concavity 12 which becomes the common liquid chamber for storing ink and also communicating it to the respective flow channels formed thereon.

As shown in FIG. 1A, the first and the second substrates are mutually adhered and fixed with an adhesive 13 to assemble a recording head as shown in FIG. 1B.

However, the head obtained by the method as described above has the problem that the straight forward progress of the ink droplets is impaired. This is, above all, due to the fact that the orifices, which are formed of materials of different qualities, cause difference in wettability with the ink at the peripherals of orifices. In the prior art, for the purpose of avoiding such problem, it has been proposed to prepare separately an orifice plate comprising orifices molded by etching of a metal plate or a photosensitive glass plate, or an orifice plate comprising orifices by hole working on a resin film, etc., and plastering it onto the main head.

However, in the liquid recording head with such constitution (hereinafter also called "ink jet recording head" or merely "recording head"), there ensued the following problems.

In the ink jet recording head as described above, the step of bonding an orifice plate is included during its preparation, and it is necessary to perform strict registration between the orifice and the flow channel portion during said bonding. Also, since said bonding can be done with difficulty when the end surfaces of the first and the second substrate to be bonded to the orifice plate are not coincident in a plane, difficulty can also ensue during adhesion of both substrates for this reason.

In addition, the orifice plate is also adhered by use of an adhesive, but since the pitch of the flow channel 11 and the height of the flow channel wall 10 are fine to the extent of about some 10 μm, unless the coated amount (thickness) of the adhesive layer 13 is controlled to a few μm, the adhesive may come out to the flow channel side because of the pressure applied during bonding, whereby there may be caused such fear that the low channel diameter or the discharging orifice diameter may be varied, even leading to clogging. Also, when the adhesive force is not sufficient, there is the fear that peeling of the orifice plate may occur.

Further, in the orifice plate formed of a resin film, because the resin film has generally a thickness of about 20 to 50 μm, not only handling is cumbersome, but also it may be considered that wrinkles may be formed or bubbles may be introduced during plastering to effect improper plastering.

The complexity of the preparation steps and the large number of steps as described above bring about increase in the production cost of recording heads, and this has been also a problem in making the recording head as described above, or the recording head constituted by integration with an ink tank, etc. which is the ink supplying source disposable.

The contents as described above are to be described in more detail as follows. The ink jet recording head is constituted of an orifice plate 40 having orifices 41 as the discharging outlet, a ceiling plate 400 having ink channel grooves 401 communicated to the respective orifices, and a heater board 100 constituting a part of the ink channel and having energy generating elements 101A for generating energy to be utilized for discharging ink, as shown in FIG. 2.

Generally speaking, the orifice plate is provided for the purpose of constituting the discharging outlet surface of the same member in order to prevent slippage in the discharging direction of discharged ink droplet caused by the difference in wettability between the heater board and the ceiling plate, and also the orifice, including its shape, etc. is an important element influencing the discharging performance of the ink jet recording head. Above all, the orifice through which the ink is discharged becomes the most important portion, and with high developments of the image recording technique and the recording head production technique in recent years as described above, the orifice size (orifice diameter) has become miniaturized and a plurality of orifices have become provided at high density.

On the other hand, various contrivances have been made in the prior art for working of orifice. Some examples are mentioned below:

(1) mechanical working with drill;

(2) fine working by discharging working;

(3) fine working by anisotropic etching of Si;

(4) the method by patterning according to photolithography and plating;

(5) fine working with carbon dioxide, YAG laser, etc.

However, as described above, the recording technique at the present time demands higher precision and higher speed as a matter of course, and along with this demand, the dimension of the orifice of the ink jet recording head has been miniaturized, and the orifice density increased, and yet the head has become to have a plurality of orifices.

In such point of view, according to the methods of prior art examples (1) and (2) as mentioned above, there were involved such problems that miniaturization of orifice dimension was difficult, and also that the efficiency was not good in working of a plurality of orifices of high density.

On the other hand, in the method of (3), there was the problem that the cost of Si material for the orifice plate was high in cost, and the working time was long.

Further, in the method of (4), the preparation steps from photolithography to plating are long, and also auxiliary materials such as substrate and resist, etc. must be employed.

In addition, the method of (5) could not prepare a satisfactory orifice complying with the above demand for the reason as described below.

Working by carbon dioxide laser and YAG laser was not sufficient in laser output, and both shape and precision of the orifice formed were not satisfactory. For example, the orifice formed by YAG laser is not circular in shape, and also foreign matters not sufficiently removed by laser are attached around the orifice. Also depending on the material and the thickness of the orifice plate, it also sometimes happened that no orifice, namely an opening portion, could be formed.

Also, since working by carbon dioxide laser and YAG laser is done by working orifices one by one, it is time consuming for working of a plurality of orifices and not suitable for bulk productivity.

Further, although a plurality of orifices must be correct in each positional precision, working was more difficult, because a movable portion for enabling precise registration was also required in working by carbon dioxide laser and YAG laser of the prior art.

As described above, according to the methods of the prior art, the respective problems were involved in the above-mentioned demand, and they were not sufficiently satisfactory as the working method of orifices.

On the other hand, recording by an ink jet recording head corresponds to higher precision, higher speed as described above, and improvement of its reliability has also become important. Accordingly, improvements have been also been made to ink. As a consequence, since the material in contact with ink is demanded to have ink resistance performance, the material which becomes the orifice plate is also required to satisfy such demand. Therefore, orifice working may be sometimes difficult depending on its material.

Also, the ink jet recording head is constituted of an orifice plate, a ceiling plate and a substrate as described above. Above all, orifices and ink channels communicated thereto, when not correctly registered in their positions, will badly affect discharging performance, even causing non-discharging in the worst case.

However, since both orifices and ink channels are fine in their sizes and constituted at high densities, it is difficult to assemble with correct registration, thus posing a great problem in preparation of ink jet recording head.

The above content can be explained below from a different aspect.

As mentioned above, the main body of the ink jet recording head comprised of, for example as shown in FIG. 2, the orifice plate 40 having the orifice 41 (discharge plate), the ceiling plate for forming the ink liquid path communicated with each orifice, and the base member constituting a part of the path 401 and having the electro-mechanical converting element 101A for generating energy used for discharging the ink.

The orifice plate has a fine orifice for discharging the ink, which orifice has great significance affecting the discharge character of the ink jet recording head. In detail, it is necessary for the orifice plate of the ink jet recording head to be excellent in workability since a fine orifice is provided, and excellent in ink-proof character since it is directly contacted with the ink.

Conventionally, the metallic plate of SnS, Ni, Cr, Al, and resin film material such as polyimide (PI), polyethersulfone (PES), polyetheretherketone (PEEK). and polyester (PE) which can be formed easily in predetermined thickness and in low cost can be used.

On the other hand, the recording at high speed and very fine quality has been required in these days with the progress of the recording technique, and for this reason the orifice is formed small in diameter and with high density. Consequently, there have been adopted various kinds of working methods for the orifice, among which, one using the laser light is used for orifice forming since it is suitable for fine working.

However, it is very difficult to connect the perforated orifice plate and the corresponding ink liquid path, and positional shift or offset therebetween is generated to deteriorate the discharge quality as well as recording character. In addition, the adhesive used for connection might go into the liquid path due to positional shift.

To add further, as the ink jet recording head utilizing a discharging orifice plate, for example, those with constitutions shown in FIGS. 3A to 3C and FIGS. 4A and 4B have been known.

The recording head with the constitution shown in FIG. 3 has a constitution obtained by providing, for example, an ink channel wall 7A comprising a cured film of a photosensitive resin, etc. as shown in FIG. 3B and an outer frame 8A constituting liquid chamber, etc. on a substrate 100 comprising a glass, etc. having an energy generating member 101A for generating the energy to be utilized for discharging ink such as a heat generating element, a piezoelectric element, etc. as shown in FIG. 3A, then bonding a cover 11B for ink passages having ink feeding holes 9A thereto, further cutting the channel downstream portion of the bonded body obtained (the main recording head portion) along the line C—C to control the channel length, followed by bonding of a discharging orifice plate 40 having thru-holes for formation of discharging orifices as shown in FIG. 3C to the channel opening end surface formed by said cutting in predetermined positional relationship.

On the other hand, the recording head with the constitution shown in FIG. 4A has a constitution obtained by forming a main recording head portion provided with an ink channel wall 7A, comprising, for example, a cured resin film of a photosensitive resin, etc. and an outer frame 8A, as shown in FIG. 4B on a substrate 100 comprising a glass, etc. having an ink discharging energy generating member 101A generating energy used for discharging ink such as a heat-generating element, piezoelectric element, etc. as shown in FIG. 4A, and bonding a discharging orifice plate 12A to the upper part thereof in predetermined positional relationship.

The constitution of the discharging orifice plate for constituting the ink jet recording head with the constitution as described above and the characteristics to ink have great influences on the recording characteristics of the ink jet recording head such as the discharging direction of ink, the amount of the ink discharged, etc., and various investigations have been done in the prior art about the material to be used for formation of the discharging material and its structure.

Concerning the characteristics of the discharging plate in the prior art, the problems to be solved may include the following problems.

a) In bonding between the discharging orifice plate and the main recording head portion, it is necessary to coat an adhesive on the bonding surface on the main portion side, but it is difficult to coat the adhesive uniformly, efficiently and with good workability onto the bonding surface on the main portion side, and yet the adhesive is liable to come around into the flow channel portion, whereby the production yield is low to be poor in bulk productivity.

Further, when coating of the adhesive is carried out so that the adhesive may not flow into the flow channel, the adhesive cannot be supplied to the peripheral portion of the flow channel in most cases, and if bonding is effected under such state with the discharging orifice plate, a gap will be formed between the discharging plate and the main portion, wherein ink may be pooled to cause readily interference with stable ink discharging.

b) In the case of providing a liquid repellent (ink repellent) coating layer for obtaining good ink discharged state on the surface of the discharging orifice plate which becomes the outer wall surface when bonded to the recording head (the surface on the side where ink is discharged, hereinafter called "discharging orifice surface"), it is difficult to coat uniformly the material for liquid repellent coating layer onto said surface, and also it is difficult to inhibit flowing of the material for formation of liquid repellent coating layer to the inner surface of the discharging orifice which is demanded to be inkphillic, whereby the product yield is low to be poor in productivity.

Also, as described above, the ink jet head to be applied to the ink jet recording device is provided generally with an ink energy discharging member, ink channels, ink discharging orifices and a liquid chamber of ink.

The output according to ink jet recording device is now demanded to be higher in resolving power and speed, and as the means for solving this, improvements of pitch precision and diameter precision of discharging orifice, and further ink repellent treatment in the vicinity of discharging orifice may be mentioned. For preparation of such ink jet head, there has been employed the method in which first fine grooves are formed on a substrate such as glass, metal, plastic, etc., the substrate is bonded to an appropriate plate to form liquid channels for ink within the head, and then a discharging orifice plate having holes, pitches precisely worked by electro-forming, etching, etc. is bonded, followed by application of ink repellent treatment on the whole plate surface.

The ink jet prepared according to the method of the prior art as described above has problems in preparation during bonding of the discharging orifice plate and during ink repellent treatment. In short, during bonding of the discharging orifice plate, generally a means of coating the plate back surface or the front surface of the ink channel with an adhesive and bonding the both is employed, but during coating of the adhesive, there ensues the problem that a part or all of the ink channel or the discharging orifice portion finely worked is filled with the adhesive. Further, during ink repellent treatment, it is generally practiced to attach a fluorine type or silicon type thin film on the whole plate surface, and also at this time, the phenomenon of collapsing of hole similarly occurs as during coating of the adhesive as described above. Also, in aspect of preparation cost, there is the problem that electro-forming or etching is expensive.

To say repeatedly, an ink jet recording head having a discharging orifice plate formed with provision of thru-holes on a plate material has, for example, a representative constitution as shown in FIG. 5.

More specifically, it has a structure comprising a discharging orifice plate 40 having discharging orifices 41 communicated to the channel bonded to the opened face thereat a bonded body having a substrate 100 provided with an energy generating member 101A formed by wall member 7A for generating the energy to be utilized for discharging ink within the ink channel and a ceiling plate 11B bonded together.

The structure of the discharging orifice structure and its characteristics to ink have great influences on the recording characteristics of an ink jet recording head such as the discharging direction of ink, the droplet amount of discharged ink, etc., and various investigations have been made in the prior art about the material to be used for formation of the discharging orifice plate and its structure.

As the problem to be improved in the characteristics of the discharging orifice plate, there is the problem that when a light pool of ink is formed around the discharging orifice on the outer wall surface 40*a* of the discharging orifice plate, disturbance is liable to occur in the discharging direction of ink as shown in FIG. 6B, whereby no stable ink discharging can be obtained (see FIG. 6A) and no good recording can be performed.

Moreover, when an ink attached film is formed on the whole surface around the discharging orifice, scattering of ink during ink discharging (splash phenomenon) occurs, whereby no stable recording can be performed, and the amount of the ink attached around the discharging orifice is further increased to develop and enlarge the ink pool. If the ink pool is excessively enlarged, ink discharging through the discharging orifice may sometimes become impossible.

Accordingly, there has been known the method to prevent formation of such ink pool as described above onto the outer wall surface of the discharging orifice by applying water repellent treatment on the outer wall surface of the discharging orifice plate.

In the water repellent treatment of the outer wall surface, the treatment is required to be performed so that the water repellent treatment may not be extended to the inner surface of the discharging orifice which is demanded to be inkphillic.

The water repellent treatment of the outer surface of the discharging orifice in the prior art has been performed by forming a thin layer of an ink repellent surface treating agent on the surface of a transfer member and transferring the thin layer onto the surface having the discharging orifice of the ink jet recording head.

Whereas, the method of the prior art have involved such problems that the treatment working is cumbersome, and also that the water repellent agent may be progressed to the inner portion of the discharging orifice, transfer cannot be sufficiently effected or even water repellent surface can not be formed because of deterioration of the transfer member.

As described above, the ink jet recording head is generally equipped with fine ink discharging orifice, ink channel and ink discharging energy generating element provided on a part of the ink channel.

As the method for preparing such ink jet recording head, for example, there has been known the method in which fine groove is formed by cutting, etching, etc. on a substrate such as glass, metal, etc., and then the substrate having the groove formed thereon is bonded to another appropriate substrate to form an ink channel within the head.

In the case of having a plurality of ink channels, those channels are in most cases communicated to a common liquid chamber and constituted so that the recording liquid may be supplied smoothly and sufficiently into the liquid channels.

Whereas, for supplying sufficient amount of recording liquid corresponding to the amount consumed by discharging of the liquid into the liquid channels, it is desirable to have a common liquid chamber of a volume with sufficient room relative to the amount consumed. However, with a common liquid chamber having a height virtually equal to the height of the ink channel, flow resistance of the recording liquid cannot be made substantially smaller, and therefore in spite of room in volume, no sufficient supply of the recording liquid can be done in some cases.

Accordingly, it becomes the general constitution to make the height of the common liquid chamber sufficiently larger than the height of the liquid channel.

However, in the method of forming fine grooves on a substrate such as glass or metal, it is difficult to form a common liquid chamber having a sufficient height relative to the height of ink channel.

It is also possible to make the height of the common chamber greater by increasing the etching amount of the common liquid chamber by repeating etching for plural times, but this method increases the steps and therefore cannot be said to respond sufficiently to the demands for cost down or productivity.

Accordingly, it has been practiced to prepare separately the common liquid chamber portion and bond the common liquid chamber portion to the end of the ink channel portion, thereby forming a desired common liquid chamber.

According to this method, sufficient common liquid chamber volume can be obtained easily and therefore it is preferable in aspect of performance of the ink jet head.

However, the method of bonding separately parts inherently has the problems of increase of number of steps, lowering in productivity, and there remain still points to be solved for accomplishing much cost down.

Also, in the case of using such method, generation of stress or positional slippage accompanied with shrinkage by curing of the adhesive, leak of the recording liquid due to incomplete sealing, flowing of the adhesive into the liquid channel or into the common liquid chamber or clogging occurred in some cases.

In addition, as described above, the recording technique at the present time demands higher precision and higher speed as a matter of course, and according to such demands, the discharging orifices of the ink jet recording head became fine in dimension, higher in orifice density, and also became to have a plurality of orifice groups.

Particularly, for higher densification, the pitch between the recording dots becomes narrower, and for making the fluid resistance through the ink path for higher speed, there is the demand to expand the pitch between orifices.

For this purpose, by taking broad pitch between orifices and working the respective discharging orifices obliquely to form the discharging directions of the recording liquid so as to be convergent, it becomes possible to perform highly precise recording. However, according to the working method of the prior art, it has been difficult to perform working with delicate variances in the discharging angle for the respective orifices.

Also, in a recording head having a plurality of the respective orifice rows for high speed recording or color recording, if the distance between the respective orifice rows is large, great memory size is required for adjusting the Dot signals between the respective orifice rows, thereby resulting in the cost-up of the main printer.

SUMMARY OF THE INVENTION

It is an object of the present invention to overcome the defect in the prior art and to provide the ink jet recording head which can be manufactured through simple process and under little steps, and which is reliable and low in cost, and manufacturing method thereof.

It is another object of the present invention to provide the orifice plate which has orifices arranged in high density and with high accuracy, and the ink jet recording head in which the relation between the orifice and ink path is accurately set and manufacturing method thereof, in view of the above mentioned problem relating to the orifice working and the connection of the orifice plate with the ceiling plate and heater board.

It is still another object of the present invention to provide the ink jet recording head in which the discharge performance is increased by working the orifice onto the orifice plate comprised of plural kinds of materials.

It is still another object of the present invention to provide an ink jet recording head which can obtain necessary ink droplet amount and discharge speed stably and sufficiently upon recording.

It is still another object of the present invention to provide the discharge opening plate and ink jet recording head in which the water repellent cover layer is provided only at the discharge opening surface and has adhesive layer for carrying out the adhering operation with the main body of the head easily, and can be mass produced with high yield, in view of the disadvantage in the ink jet recording head using the discharge opening plate.

It is still another object of the present invention to provide the manufacturing method of the ink jet recording head which has high accurate diameter of the ink discharge opening and pitch, and which can be produced cheaply.

It is still another object of the present invention to provide the method for carrying out the water repellent treatment only onto the outer wall surface of the discharge opening of the plate effectively.

It is still another object of the present invention to provide the manufacturing method for the ink jet recording head which can solve the above mentioned various problem by forming the grooves for ink path by excimer laser after molding the ceiling plate having the groove for common chamber.

It is still another object of the present invention to provide the ink jet recording head and manufacturing method thereof which has the orifice plate of high density and high accuracy, in which the discharge opening whose angle is changed in every discharge opening and in every head can be easily formed on the orifice plate, and in which the relation between the orifice and the ink path are determined accurately.

Still another object is to provide a method for manufacturing an ink jet recording head having an ink path communicated with a discharge opening, a discharge energy generating element disposed in said ink path, and a discharge opening plate provided with said discharge opening and attached to an end surface of said ink path, the ink being discharged from said discharge opening, characterized in that, said discharge opening is formed by irradiating an excimer laser light to said discharge opening plate.

Still another object is to provide a method for manufacturing an ink jet recording head having an ink path communicated with a discharge opening, a discharge energy generating element disposed in said ink path, and a discharge opening plate provided with said discharge opening and attached to an end surface of said ink path, the ink being discharged from said discharge opening, characterized in that said discharge opening plate is attached to said end surface of the ink path prior to when said discharge opening is formed, and then an excimer laser light is irradiated to said discharge opening plate attached to form said discharge opening.

Still another object is to provide a liquid discharge recording head, comprising, a first base plate provided with a discharge energy generating element, a second base plate formed by resin molding and connected with said first base plate, said second base plate having a groove for forming a liquid flow path corresponding to the location of said discharge energy generating element upon said connection, and being provided with said liquid discharge opening for recording before said groove, said second base plate having a member for forming said discharge opening whose thickness is selected thinner at least of a portion at which said discharge opening is formed.

Still another object is to provide a method for manufacturing a liquid jet recording head made by connecting a first base plate provided with discharge energy generating means and a second base plate for forming a liquid flow path for recording corresponding to the location of said discharge energy generating means, characterized in that, said discharge opening is formed by irradiating an excimer laser light to a blank of a second base plate made of resin to which a plate member for forming a liquid discharge opening for the recording is attached integrally.

Still another object is to provide a method for manufacturing an ink jet recording head having an ink path communicated with a discharge opening, a discharge energy generating element disposed in said ink path for generating energy used for discharging the ink, and a discharge opening forming member provided with said discharge opening and attached to an open surface at which an opening communicated with said ink path is disposed, the ink being discharged through said discharge opening to carry out the recording, characterized in that, said discharge opening on said discharge opening forming member is formed by irradiation of an excimer laser light, and said excimer laser entering side upon said irradiation is attached to said open surface.

Still another object is to provide a method for manufacturing an ink jet recording head having a base plate provided with an element generating discharge energy used for discharging the ink, a ceiling plate having a recessed portion for forming an ink flow path corresponding to the disposed location of said discharge energy element by being attached with said base plate, and a discharge opening forming member on which a discharge opening communicated with said ink path, and which discharges the ink is formed, characterized in that, an excimer laser light is irradiated from said recessed side to form said discharge opening, after said ceiling plate and discharge opening forming member are connected integrally.

Still another object is to provide an ink jet recording head having a discharge opening forming member provided with a discharge opening for discharging ink, an ink path communicated with said discharge opening, and a discharge energy generating element disposed on a part of said ink flow path to generate energy used for discharging the ink, the ink being discharged to carry out recording, characterized in that, said discharge opening forming member is formed by accumulating plural members of different kinds of materials.

Still another object is to provide a discharge opening plate for an ink jet recording head, comprising, a plate member, a water repellant cover layer provided on an upper surface of said plate member, an adhesive layer provided on a lower surface of said plate member and a through hole for forming a discharge opening for discharging ink therethrough being provided.

Still another object is to provide a method for manufacturing a discharge opening plate for an ink jet recording head, comprising, a step for providing said water repellant cover layer on an upper surface of a plate member, a step for providing said adhesive agent layer on a lower surface of the plate member, a step for drilling a through hole on a plate member on which said both layers are provided for forming a discharge opening for discharging the ink.

Still another object is to provide a method for manufacturing an ink jet recording head, characterized in that, drilling a plate-like member made by accumulating a water repellant layer, a base film and an adhesive agent layer sequentially, and adhering said plate-like member to a surface on which an opening communicating with an ink path of a head body.

Still another object is to provide a method for manufacturing an ink jet recording head, characterized in that, drilling a plate-like member made by accumulating a water repellant layer, a base film, an adhesive agent layer and a mold release film sequentially, tearing said mold release film, and adhering said plate-like member whose mold release film has been torn to a surface on which an opening communicating with an ink path of a head body.

Still another object is to provide a method for manufacturing a discharge opening plate having a through hole for forming a discharge opening, for an ink jet recording head, comprising, a step for forming a metallic layer forming said discharge opening plate at a surface of a base member on which a resin layer having configuration corresponding to that of said through hole is arranged corresponding to the arrangement of said through hole, a step for making water repellant treatment to a surface of said metallic surface, and a step for removing said resin layer from said surface of base member to form said through hole.

Still another object is to provide a method for manufacturing an ink jet recording head made by connecting a plate having grooves for forming ink paths provided corresponding to each of plural ink discharge openings, and a base plate having a discharge energy generating element disposed at a part of said ink paths, comprising, said grooves of plate are formed by irradiating an excimer laser light.

Still another object is to provide a method for manufacturing an ink jet recording head made by connecting a plate having grooves for forming ink paths provided corresponding to each of plural discharge openings and a common liquid chamber for storing the ink supplied to said ink paths, and a base member having a discharge energy generating element disposed at a part of said ink paths, characterized in that, forming a base member having said grooves for forming said common chamber by injection molding, working said grooves forming said ink paths by irradiating an excimer laser light to said base member.

Still another object is to provide a method for manufacturing an ink jet recording head in which plural discharge openings are formed by irradiating excimer laser light, characterized in that, at least one of the entering angles of the laser light relative to a surface of said discharge openings is differentiated from others.

BRIEF DESCRIPTION OF THE DRAWINGS

FIG. 32 is a view showing one embodiment of discharge opening plate, in which

PREFERERRED EMBODIMENT OF THE INVENTION

The present invention is described in detail by referring to examples.

Figure 7B:
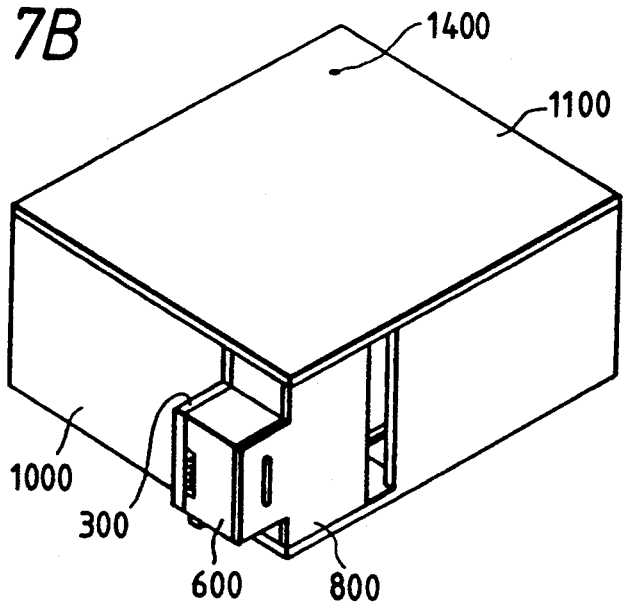
FIGS. 7A and 7B are respectively an exploded schematic view and a schematic view for explaining the cartridge including recording head of the present invention.
Figure 7A:
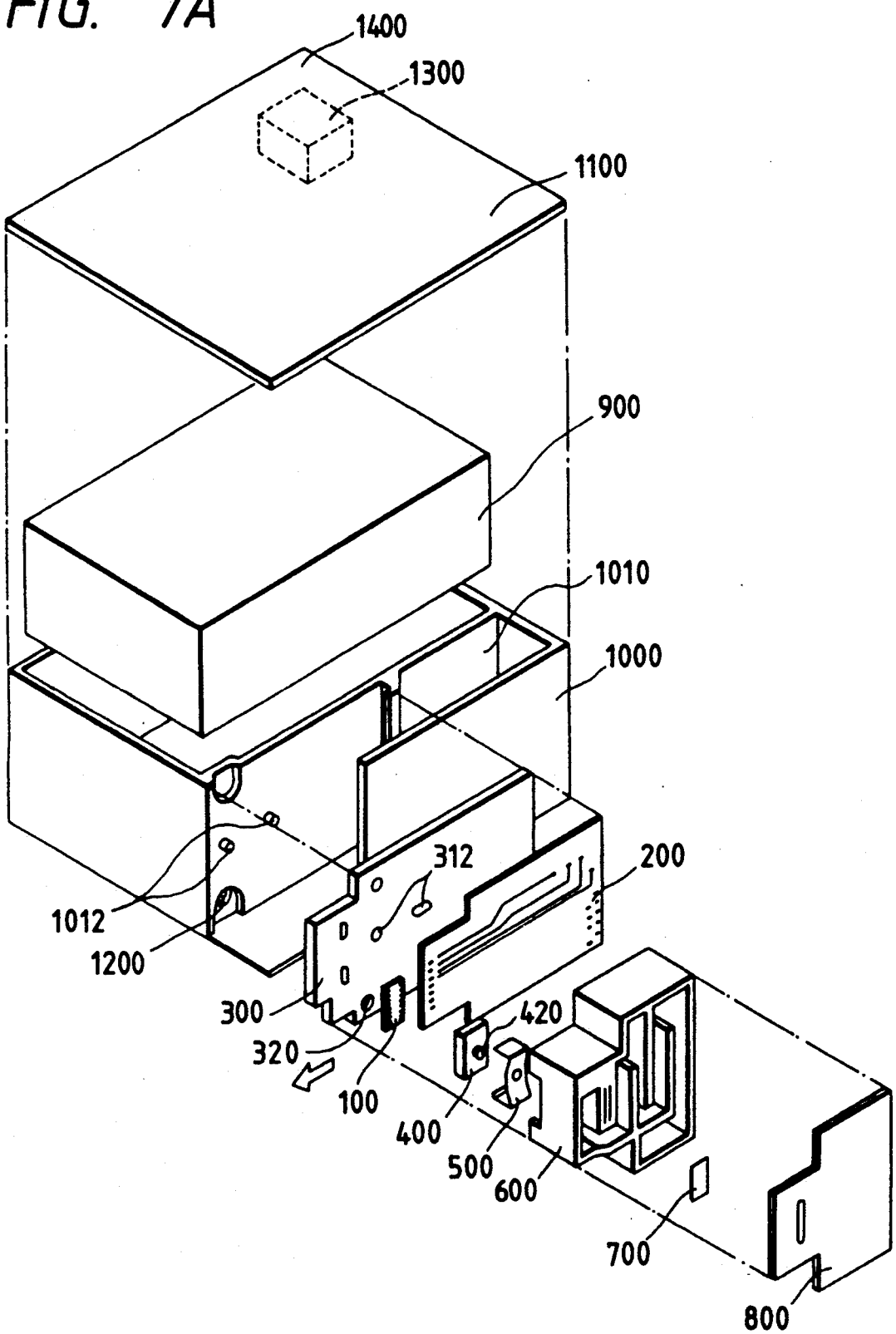

FIGS. 7A and 7B show respectively schematic disassembled view and assembled view of an ink jet recording head according to an example of the present invention in which an ink housing portion which is an ink feeding source is made integral to give a disposable type.

Figure 1A:
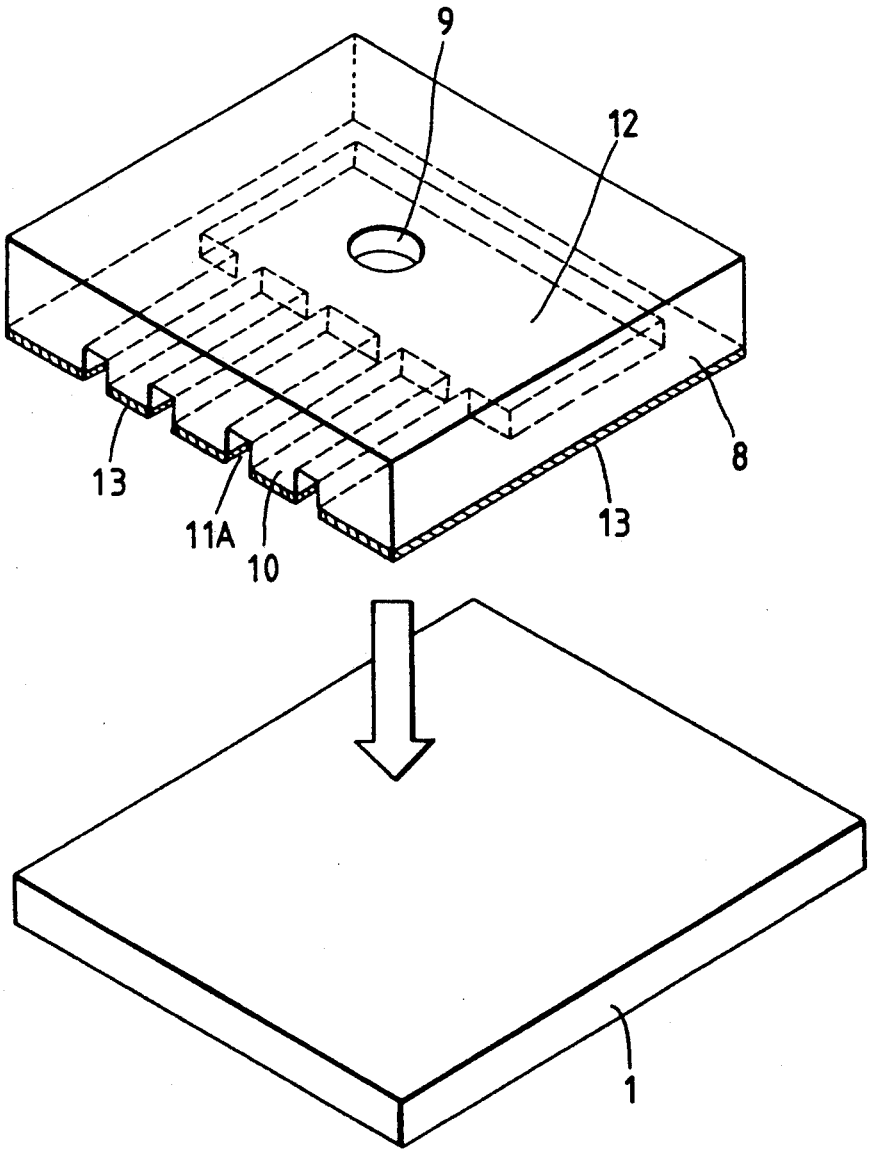
FIG. 1A PRIOR ART
FIGS. 1A and 1B are views for explaining an assembly of conventional recording head.
Figure 1B:
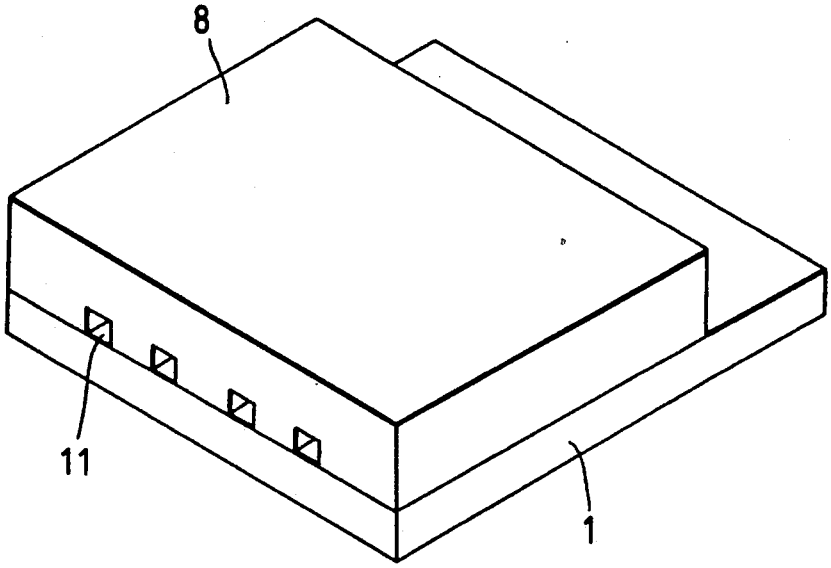
FIG. 1B PRIOR ART
Figure 2:
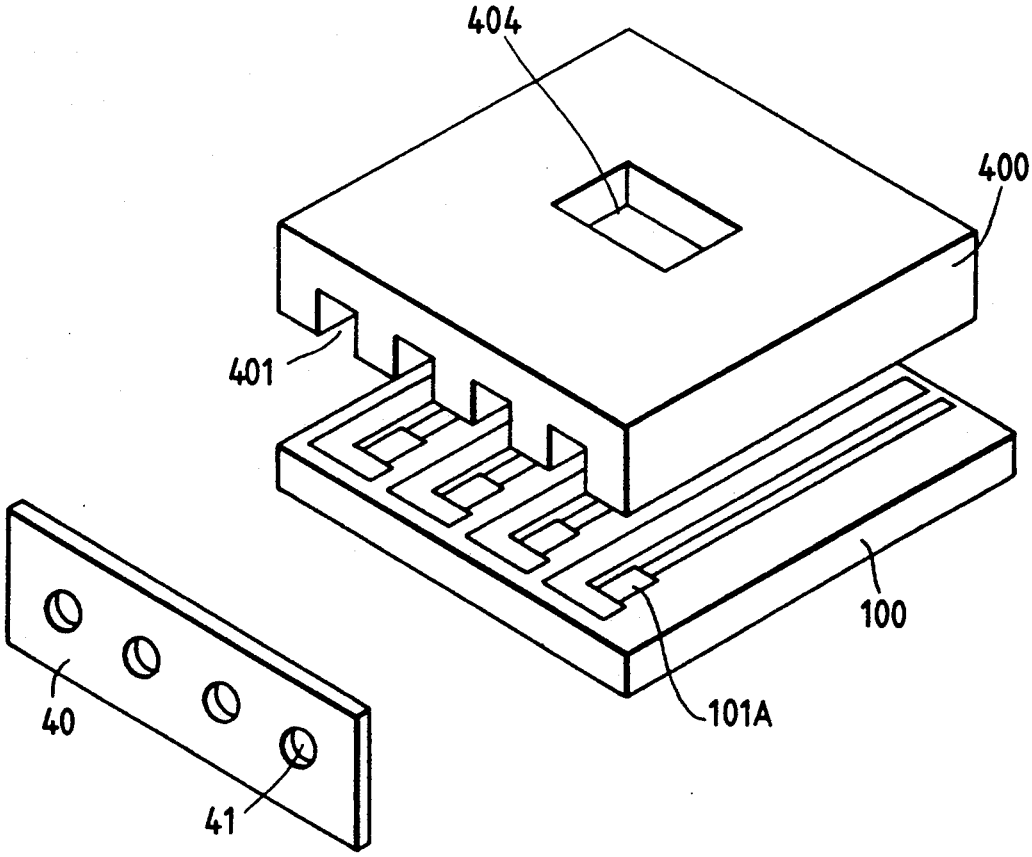
FIG. 2 PRIOR ART
FIG. 2 is an exploded schematic view for showing construction of ink recording head.

In FIG. 7A, numeral 100 is a heater board comprising an electricity heat convertor (discharging heater) and a wiring of Al, etc. for feeding power thereto formed by film forming technique on a Si substrate, which corresponds to the first substrate 1 in FIG. 1A and 1B. Its detailed constitution is described below by referring to FIG. 8. 200 is a wiring substrate corresponding to the heater board 100, and the corresponding wiring is connected by, for example, wire bonding.

400 is a ceiling plate provided with a partition wall, a common liquid chamber for limiting the ink flow channel, which corresponds to the second substrate 8 in FIG. 1 and in this embodiment is comprised of a resin material having integrally an orifice plate portion. The detailed embodiment of this ceiling plate 400 is described below by referring to FIGS. 39 to 41.

300 is a support made of, for example, a metal, 500 is a pressing spring, and by engaging both under the state with the heater board 100 and the ceiling plate 400 sandwiched therebetween, the heater board 100 and the ceiling 400 are pressure fixed by the urging force of the pressing spring 500. One embodiment is described by referring to FIGS. 62 and 63. The support 300 as well as the wiring substrate 200 can be provided by plastering, etc., and also can be made to have the mounting standard onto the carriage for performing scanning of the head. Also, the support 300 also functions as the member which cools the heater board 100 by release of the heat generated with driving.

600 is a feeding tank, which receives ink feed from the ink reservoir portion forming the ink feeding source, and functions as a subtank leading the ink to the common liquid chamber formed by bonding of the heater board 100 and the ceiling plate 400. 700 is a filter arranged at a site in the feeding tank 600 near the ink feeding inlet to the common liquid chamber, and 800 is a lid member of the feeding tank 600.

900 is an absorber for impregnation of ink, and is arranged within the cartridge main body 1000. 1200 is a feeding inlet for feeding ink to the unit comprising the respective portions 100–800 as described above, and by injecting ink through the feeding inlet 1200 in the step prior to arrangement of said unit to the portion 1010 of the cartridge main body 1000, ink can be impregnated into the absorber 900.

1100 is a lid member of the cartridge main body, and 1400 is an air communicating opening provided at the lid member for communication to the air. 1300 is a liquid repellant material arranged inwardly of the air communicating opening 1400, by which the ink leak through the air communicating opening 1400 can be prevented.

On completion of ink filling through the feeding inlet 1200, the unit comprising the respective portions 100–800 is arranged by registration at the portion 1010. Registration or fixing at this time can be effected by, for example, fitting the projection 1012 provided on the cartridge main body 1000 with the hole 312 provided on the support 300 corresponding thereto, whereby the cartridge shown in FIG. 7B is completed.

The ink is fed into the feeding tank 600 from the cartridge inner portion through the feeding inlet 1200, the hole 320 provided at the support 300 and the introducing inlet provided on the back side in FIG. 7A of the feeding tank 600, and after passing through the inner portion thereof, flows from the discharging outlet into the common liquid chamber through an appropriate feeding pipe and the ink introducing inlet 420 of the ceiling plate 400. At the connecting portion for ink communication as described above, for example, packing of silicone rubber, butyl rubber, etc. is provided, whereby sealing is effected to ensure the ink feeding flow channel.

Figure 8A:
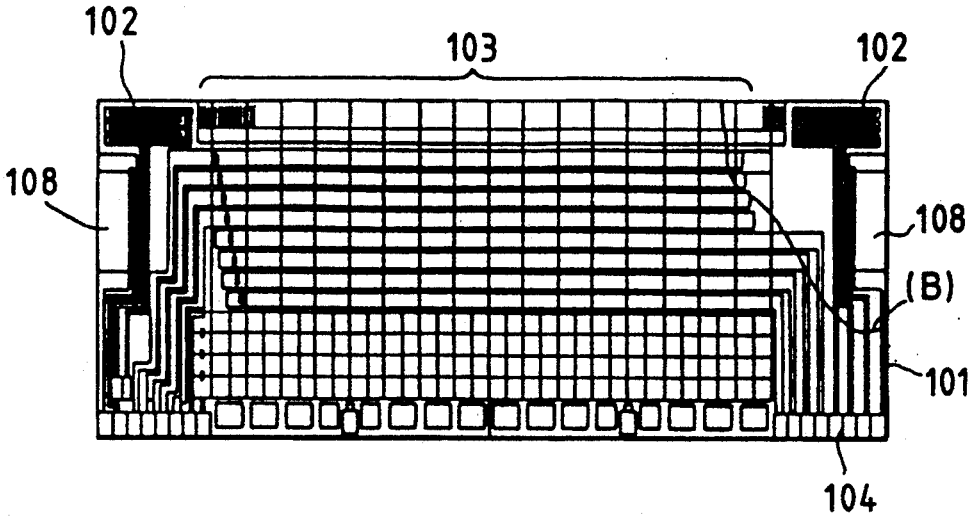
FIGS. 8A and 8B are respectively a plan view and partial enlarged view showing a heater board applicable for the recording head of the present embodiment.
Figure 8B:
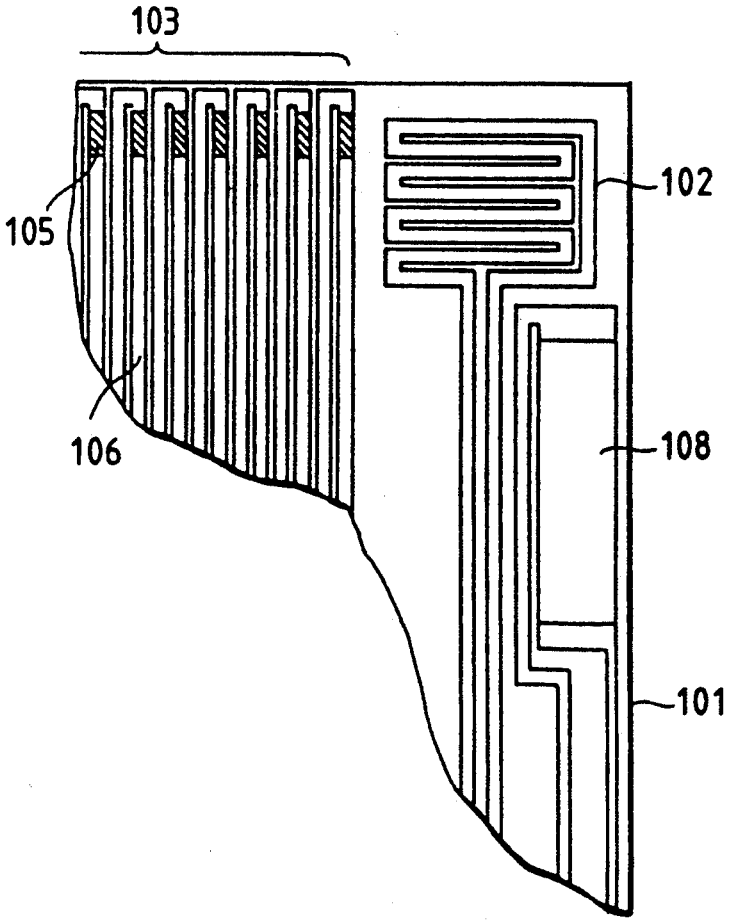

FIGS. 8A and 8B are a plan view of the heater board 100 according to this example and its partial enlarged view.

In FIG. 8A, 101 is the heater board substrate according to this embodiment, and 103 the discharging heater portion. 104 is a terminal, which is bonded by wire bonding to the outside. 102 is a temperature sensor, which is formed at the discharging heater portion 3, etc. according to the same film forming process as for the discharging heater portion 103, etc. FIG. 8B is an enlarged view of the portion B including the sensor 102 in FIG. 8A, 105 and 106 are respectively discharging heater and wiring. 108 is a heater for heating the head.

The sensor 102 is formed according to the same film forming process as formation of semiconductors, and is therefore extremely high in precision, and can be formed of a material varying in electroconductivity depending on temperature such as aluminum, titanium, tantalum, tantalum pentoxide, niobium, etc. which is the constituent material of other portions. For example, among them, titanium is a material which can be arranged between the both for enhancing adhesiveness between the heat-generating resistance layer constitutes the electricity-heat converting element and the electrode, and tantalum is a material which can be arranged at the upper portion for enhancing the cavitation resistance of the protective layer on the heat-generating resistant layer. Also, for making variance in the process smaller, line width is made bold, and for making the influence of wiring resistance, etc. smaller, a zig-zag shape is formed to make the resistance higher.

In the recording head shown in FIGS. 7A and 7B, the orifice plate should desirably have a thickness of about 10 to 50 μm, and also in view of the cost of material and ink resistance as the material of the orifice plate, film materials of thermoplastic resins, such as polyether ketone, polyimide, polyether sulfone, etc. may be included. In this example, a film of a polyether ether ketone (PEEK) with a thickness of 25 μm is used.

When forming an orifice plate, first the above film material is cut into a size necessary for orifice plate. Next, by use of an excimer laser of KrF emitting UV-ray of 248 nm wavelength, working of orifice is performed by means of a device shown in FIG. 9.

The excimer laser is a laser capable of oscillating UV-ray and has such advantages as high strength, good monochromaticity, directional characteristic, capability of short pulse oscillaton, capability of making energy density very great by focusing with a lens.

Eximer laser is a device capable of oscillating UV-ray of short pulses (15–35 ns)by discharging excitation of a gaseous mixture of rare gas and halogen, and Kr-F, Xe-Cl, Ar-F laser are frequently used. The oscillation energy of these may be some 100 mJ/pulse, and the pulse repetition frequency 30 to 100 Hz.

When the short pulse UV-ray of high luminance such as the excimer laser is irradiated on a polymer resin surface, there occurs the Ablative Photodecomposition (APD) process where the irradiated portion is decomposed and scattered momentarily with accompaniment of plasma emission and impact sound, by which process working of the polymer resin is rendered possible.

Thus, when working precision excimer laser is compared with that with other lasers, for example, if a polyimide (PI) film is irradiated with KrF laser as an excimer laser and other YAG laser and $CO_2$ laser, since the wavelength absorbing light of PI is in the UV region, beautiful holes can be opened by KrF laser, but the edge surface is roughened by YAG laser which is not in the UV region although holes may be opened, while craters are formed around the hole by $CO_2$ laser which is IR ray.

Also, metals such as SUS, etc., opaque ceramics, Si, etc. are not influenced by irradiation of excimer laser in an atmosphere of the air and hence can be used as the masking material in working by excimer laser.

Figure 9:
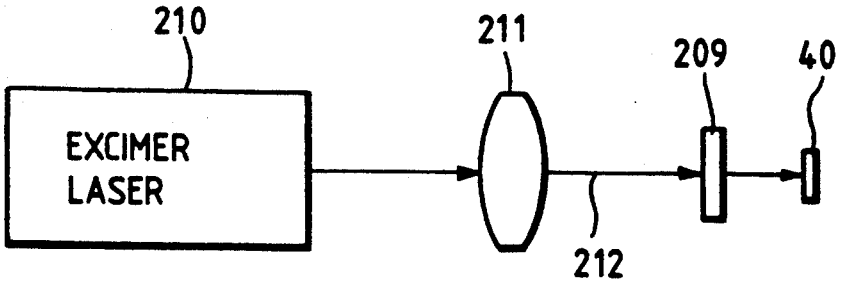
FIG. 9 is a schematic view of apparatus according to one embodiment.

FIG. 9 is a schematic illustration of a device for performing working orifice by use of such excimer laser. In FIG. 9, 210 is an excimer laser, 211 is a lens for focusing laser beam 212 emitted from the excimer laser 210, 209 is a mask arranged between the excimer laser 210 and the orifice plate, and 40 is an orifice plate on which orifices are to be formed.

Figure 10:
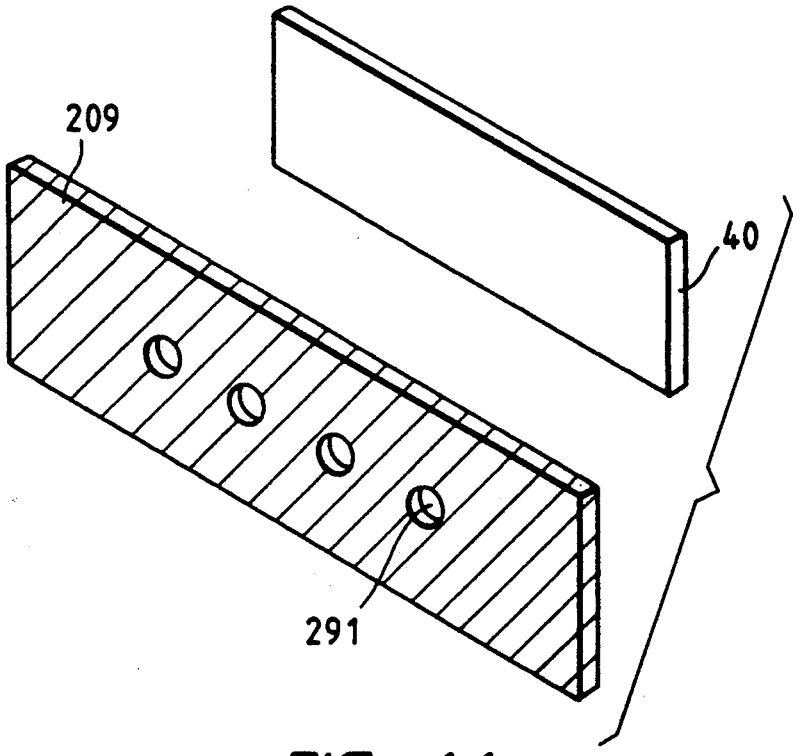
FIG. 10 is a perspective view showing relation between mask and orifice plate.

FIG. 10 is a perspective view showing the details of the mask 209 and the orifice plate 40. On the mask 209 are provided transparent portions 291 corresponding to the sites where orifices on the orifice plate 40 are to be worked so that laser beam 212 may be transmitted therethrough. Thus, by providing a pattern necessary for orifices on the mask 209, this pattern can be worked into the film for orifice plate.

As shown in FIG. 10, the number of the orifices is plural, but this is shown schematically and practically in this example a mask having orifices of 360DPI, each with a diameter $\phi 33$ μm, linearly juxtaposed is used. In this constitution, orifices are formed by irradiation of laser beam 212 through the mask 209 on the plate 40. As the mask material, it should preferably receive no influence of the heat by laser irradiation, and, for example, a material with small coefficient of thermal expansion, such as a metal material of Be-Cu, etc, can be used.

The orifice on the orifice plate prepared according to the method as described above is free from abnormal deformation at the peripheral portion of the orifice as in working by carbon dioxide laser and YAG laser, and a circular form similar to the mask is worked beautifully from the surface to the back of the film.

The results of comparison between the design value and the dimension in the orifice plate after preparation according to the method as described above are shown in Table 1.

TABLE 1

| | Design value (μm) | Dimension after laser working (μm) | Error (μm) |
|---|---|---|---|
| Pitch variance | 70.5 | 70.4 | −0.1 |
| Hole diameter | 34.0 | 33.9 | −0.1 |

As is also apparent from comparison in this Table 1, the orifice working with excimer laser has sufficient precision for further improvement of the performance of the ink jet recording head, and also has a specific feature that it can be produced simply.

In the following, a more effective example of the present invention is described.

Figure 11:
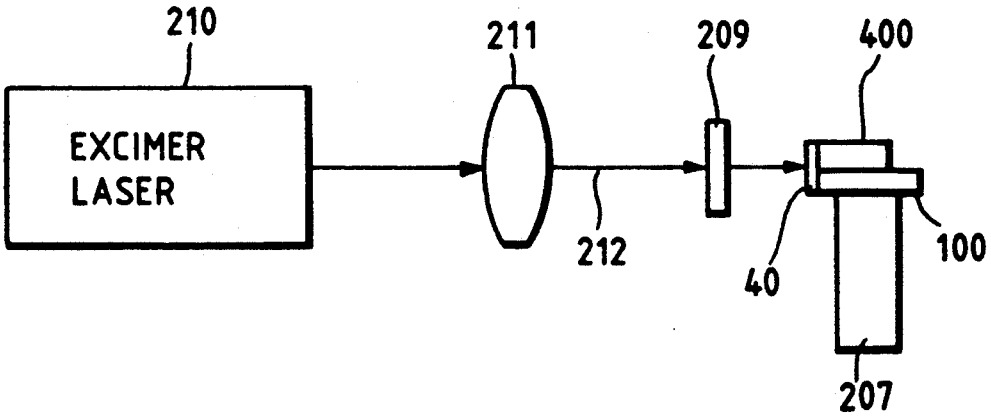
FIG. 11 is a schematic view of apparatus of another emobodiment.
Figure 12:
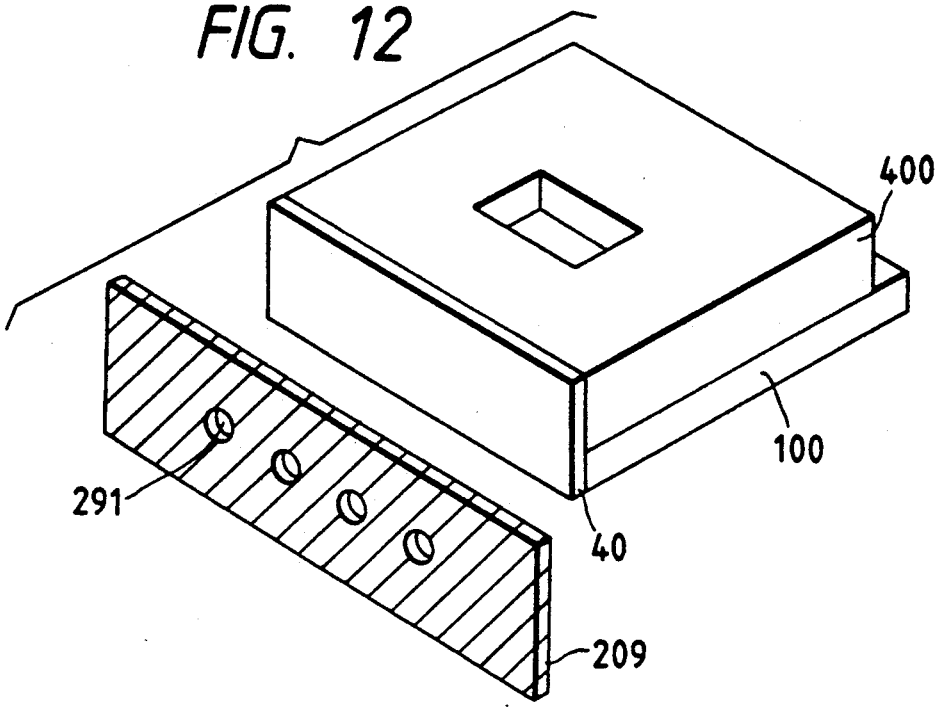
FIG. 12 is a perspective view showing relation between mask and recording head of FIG. 11.

FIG. 11 and FIG. 12 are respectively a schematic view and a perspective view representing the details of the mask and the orifice of the orifice working device.

In this example, first, a glass material applied with grooving as the ceiling plate 400 and a heater board 100 having energy generating elements and wirings therefor, etc. provided on a Si wafer are bonded together, and then the bonded surface was subjected to ozone washing of the orifice plate 40, the ceiling plate 400 and the heater board 100, followed by coating of a silane coupling agent. The coating method is performed by transfer from a silane coupling agent A-187 (from Nippon Unicar K.K) spin coated on a Si rubber of $\phi 100$, $t=0.6$.

Next, a dry film (Tokyo Ohka K.K., SE-320) as the material of the orifice plate 40 after peel off of the protective film, polyether on one side is heated to about 40°-80° C. At this time, the ceiling plate 400 and the heater board 100 integrally combined are also heated at the same time. This heating is performed by use of a hot plate or a clean oven in this example.

Figure 13:
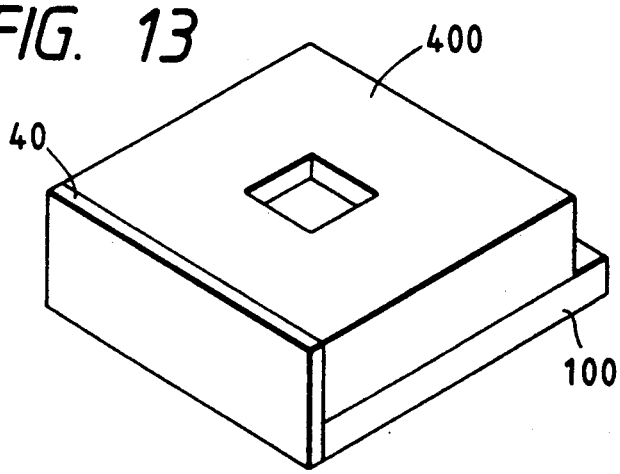
FIG. 13 is a perspective view showing condition in which film having no orifice is connected in manufacturing process of FIG. 11.

After the dry film is sufficiently heated, the dry film surface of the film and the ceiling plate-heater board are pushed against each other under a pressure of 2 to 10 $kg/cm^2$ for 1 to 10 seconds to be bonded together. Next, the composite is cooled gradually to room temperature (about 25° C.), followed by separation of the film from the ceiling-heater board. At this time, the dry film which becomes the orifice plate is separated from the other protective film of Mylar film to be bonded to the ceiling-heater board to become the state shown in FIG. 13. Next, UV-ray is irradiated on the bonded dry film surface to effect curing of the film, and the recording head (ceiling plate-heater board orifice plate) is fixed at a predetermined position comprising the constitution shown in FIG. 11, followed by registration of the recording head, the excimer laser and the mask. This registration is corresponded by making the stand 207 for fixing the recording head movable system in this example.

Figure 14:
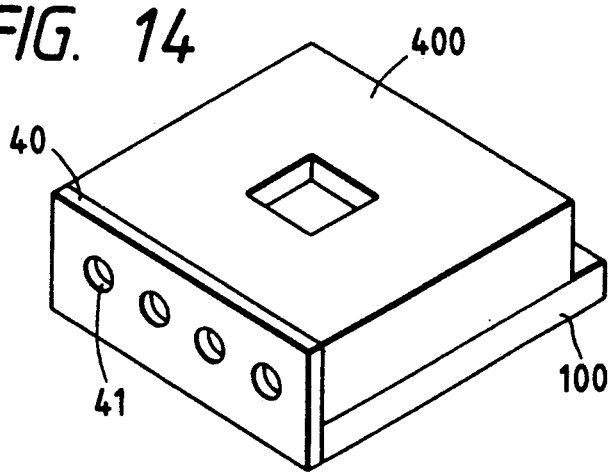
FIG. 14 is a perspective view showing state in which orifice has been formed by excimer laser.

After completion of registration, excimer laser light is irradiated on the orifice plate 40 through the mask 209 to effect working of the orifice 41. The state of the recording head after such wording is shown in FIG. 14.

According to the method as described above, it is not necessary to perform bonding by registration with high precision between the orifice plate having fine orifices and the ceiling-heater board, whereby the preparation steps of the ink jet recording head become simple.

Next, an example for making the orifice shape a more preferable shape by working with excimer laser is shown.

Figure 15:
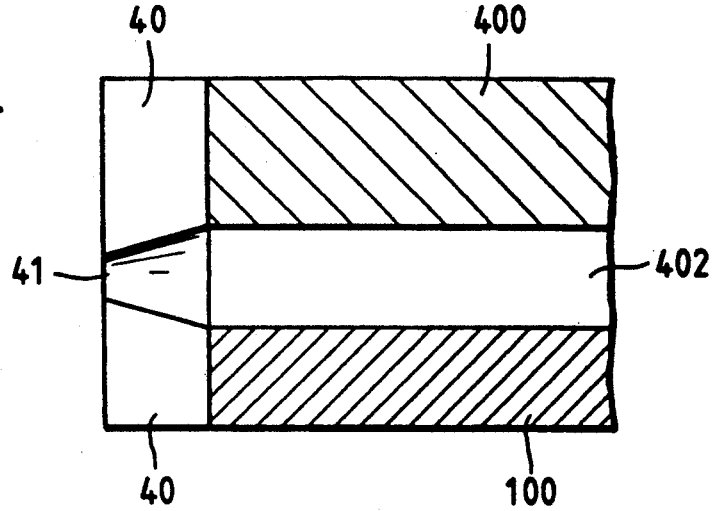
FIG. 15 is a cross section of orifice according to another embodiment.
Figure 16:
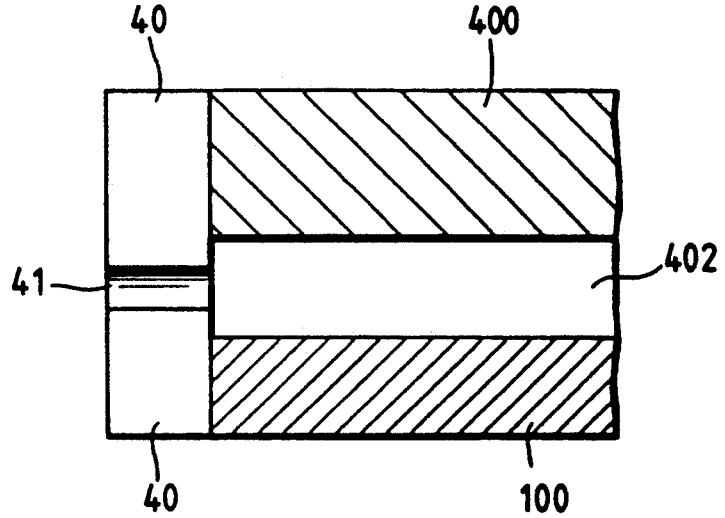
FIG. 16 PRIOR ART
FIG. 16 is a cross section of orifice according to conventional manufacturing method.

As shown in FIG. 15, the orifice shape of the ink jet recording head in this example has been deemed to have desirably a shape which is narrower at the tip as nearer from the ink channel 402 toward the orifice 41. However, because it can be realized with difficulty in the preparation method of the prior art, most of its shape have been columnar as shown in FIG. 16.

Whereas, by use of excimer laser, and utilizing the specific feature that the shape of the hole is varied by changing the position of the focus by moving gradually the focusing lens during irradiation in working only of the orifice plate, also an orifice shape as shown in FIG. 15 can be produced.

Figure 17:
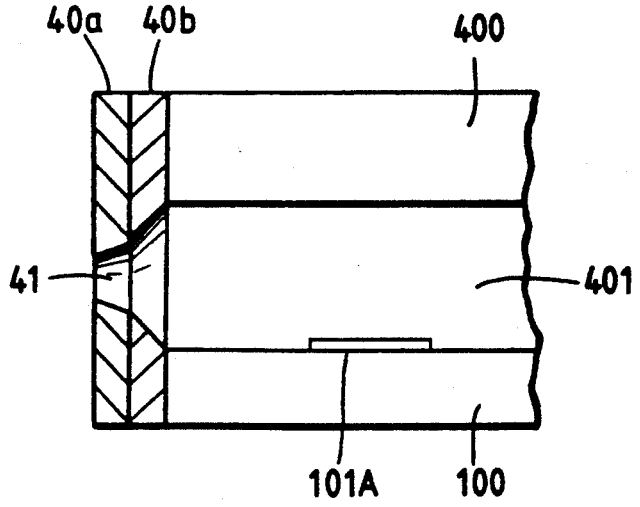
FIG. 17 is a cross section of main body of recording head forming cartridge.

FIG. 17 is a sectional view of an ink liquid channel of the ink jet recording head according to an another example of the present invention. In FIG. 17, 40*a* is one plate of the orifice plates comprising two kinds of materials, and 40*b* is the other orifice plate. In this example, as the material for the plate 40*a*, a PI film with a thickness of about 20 μm is used, and as the material for the plate 40*b*, a dry film with a thickness of about 20 μm (SE-320, manufactured by Tokyo Ohka K.K.) for bonding the PI film 40*a* to the opening surface at which the openings of ink liquid channels are arranged.

Figure 18:
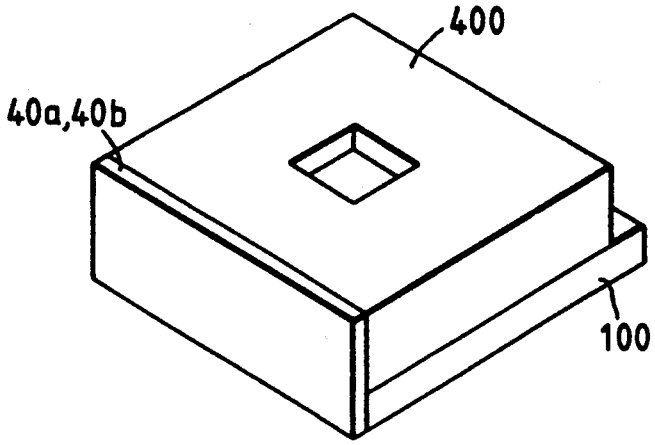
FIGS. 18 and 19 are schematic perspective views showing orifice manufacturing process of recording head body of FIG. 17.

Also, in this example, the PI film 40*a* is bonded to the dry film 40*b* before bonding to the opening surface of the ink liquid channels, but of course the PI film 40*a* may be also bonded after bonding of the dry film 40*b* to the opening surface. By such bonding, the main recording head becomes the state as shown in FIG. 18.

Figure 19:
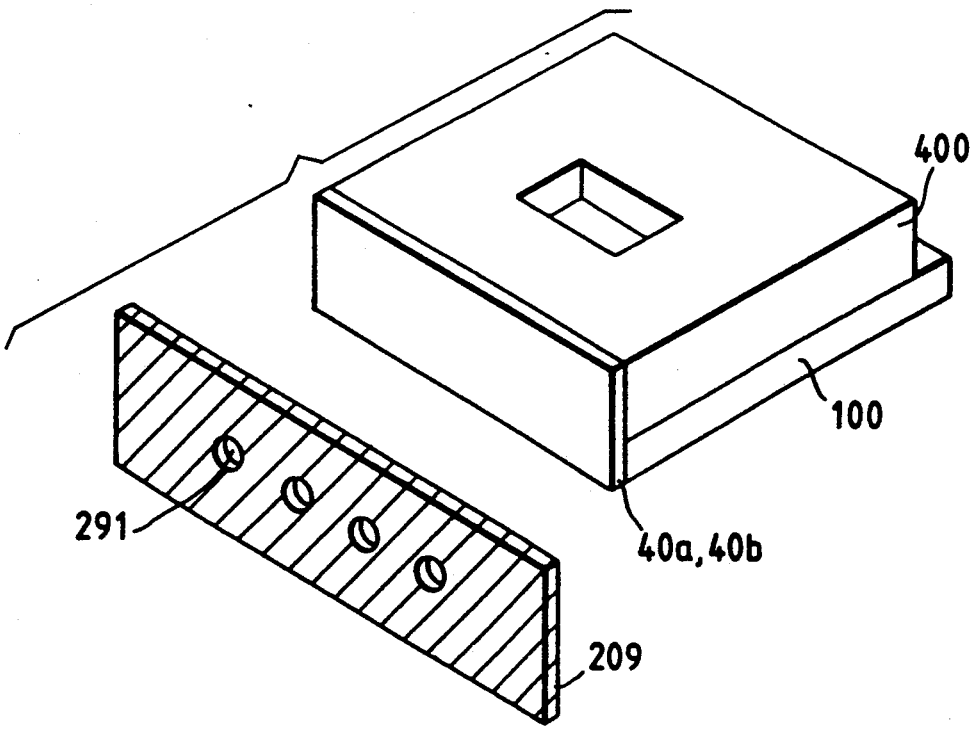

Next, orifices are worked by laser beam on the main recording head bonded with the orifice plate. In this example, an excimer laser is used. As shown in FIG. 19, by first using a mask 209 of SUS having a shape 291 of orifice to effect registration between the opening of the ink liquid channel and the orifice shape 291 of the mask 209, an excimer laser beam is irradiated on the mask 209 for several seconds. The orifice plates 40*a*, 40*b* at the portions irradiated with the excimer laser are removed to form the orifices 41. At this time, since the range removed is varied depending on the material of the film, orifices 41 with the shapes shown in FIG. 17 are obtained.

The shape which becomes smaller in diameter toward the tip end shown in FIG. 17 has the effect of increased discharging speed and also the discharging direction which is made constant, leading to improvement of recorded image quality.

Figure 20:
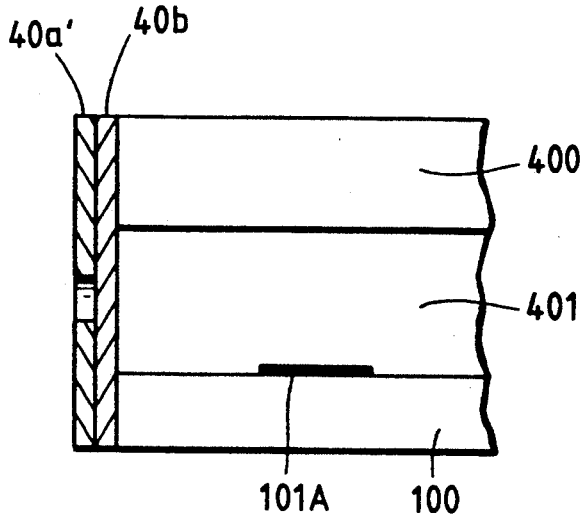
FIGS. 20 and 21 are cross sections showing orifice manufacturing process according to another embodiment.
Figure 21:
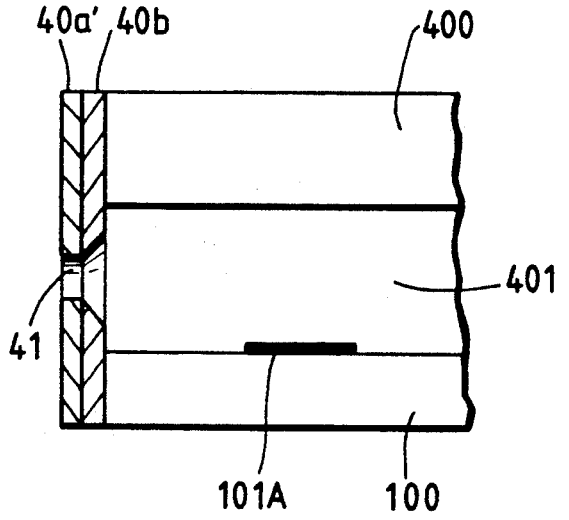

FIG. 20 and FIG. 21 concern other examples of the present invention, showing similarly sectional views as in FIG. 17. The same shape of the ink liquid channel 401 and the same dry film for the material of the orifice plate 40*b* as in FIG. 17 are used. Next, by applying etching on SUS, etc., the orifice and the metal material 40*a'* formed are bonded to the opening of the ink liquid channel with registration. This state is shown in FIG. 20.

Next, the orifice is worked by irradiation of the excimer laser beam similarly as in the first example. This state is shown in FIG. 21. As can be seen from FIG. 21, in this example, there is obtained the effect that no mask for laser working is separately prepared, because the SUS material 40*a'* also functioning as the mask becomes the orifice plate as such.

Further, other examples are described. The shape of the ink liquid channel and the orifice plate 40*b* are the same as in the example as described above, and as the material for the orifice plate 40*a*, films of Myler, Tedlar (registered brand), etc. are used. The film 40*a* is previously bonded to the plate 40*b*, and then bonded to the opening surface of the liquid channel. Thereafter, the orifice is worked with an excimer laser beam. The recording head obtained according to this Example has water repellency at the discharging orifice surface and the orifice plate, and therefore no unnecessary ink pooling or dew formation occurs at the discharging orifice surface, whereby stable discharging without influences from these is rendered possible.

Figure 22:
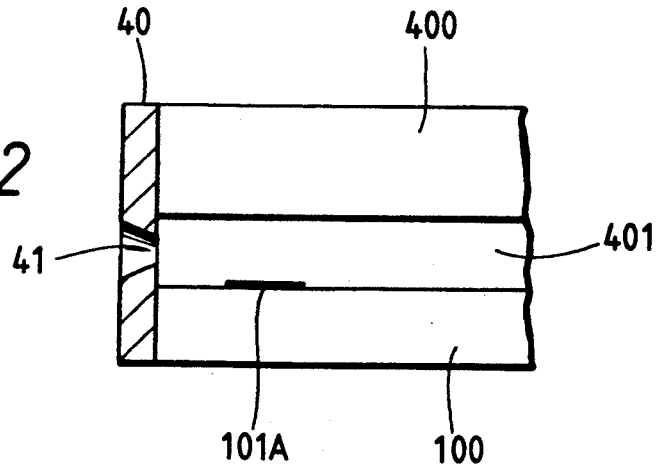
FIG. 22 is a cross section showing one example of ink jet recording head.

As the orifice of recording head according to such embodiment, it is desirable to obtain the tapered configuration in which diameter decreases from the ink liquid path side toward the discharge opening side, not the tapered configuration in which diameter decreases from the discharge opening side toward the ink liquid side, as shown in FIG. 22.

Figure 23:
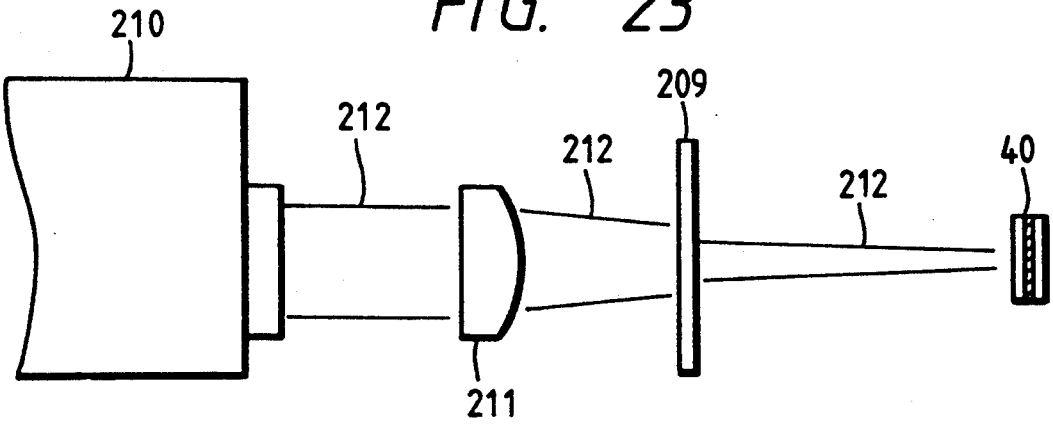
FIG. 23 is a schematic construction view of orifice working device using excimer laser light.
Figure 29:
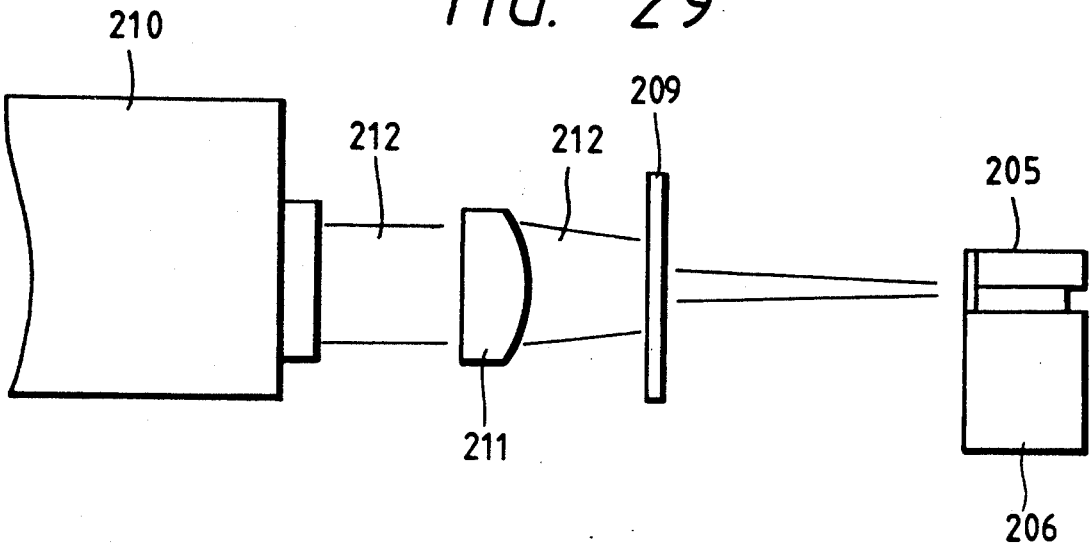
FIG. 29 is a schematic construction view of orifice working device using excimer laser light.

FIG. 23 shows the manner in which orifice working is performed by excimer laser beam on the orifice plate made of a resin film according to another embodiment of the present invention, and the same elements as those shown in FIG. 29 are attached with the same symbols. In FIG. 23, 210 is a laser oscillating device for oscillating KrF excimer laser beam, 212 a pulse laser beam with a wavelength of 248 mm and a pulse width of about 15 nsec oscillated from the laser oscillating device 210, 211 a synthetic quartz lens for converging the laser beam 212, 209 a projection mask having aluminum capable of shielding the laser beam 212 vapor deposited thereon, on which a plurality of holes of 133 μm in diameter are arranged at a pitch of 212 μm to constitute an orifice pattern. 40 is an orifice plate member, which comprises a film of polyether sulfone (PES) having a thickness of 4 μm coated with a 6 μm thick tacky layer, and further plastered with a 25 μm thick Mylar.

Figure 24:
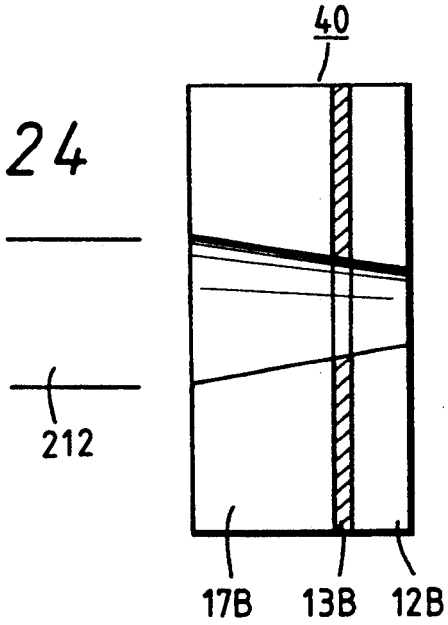
FIG. 24 is a schematic view for manufacturing orifice plate of one emobodiment is manufactured.

FIG. 24 is an enlarged sectional view of the orifice plate member 40 shown in FIG. 23, and in FIG. 24, 12B is a PES film forming the orifice plate, 13B a tacky layer as the adhesive, and 17B a Mylar. In this case, on the emitting side of the laser beam on the PES film 12B which becomes the orifice plate by irradiation of the laser beam 212 through the mask 209, orifices of 3 μm are formed at a pitch of 70 μm. After the orifice plate member 40 is irradiated with laser beam to be made into the state shown in FIG. 24, the orifice plate 12B obtained by peel-off of the Mylar 17B is bonded to the opened face of the ink channel to complete the main ink jet recording head.

Figure 25:
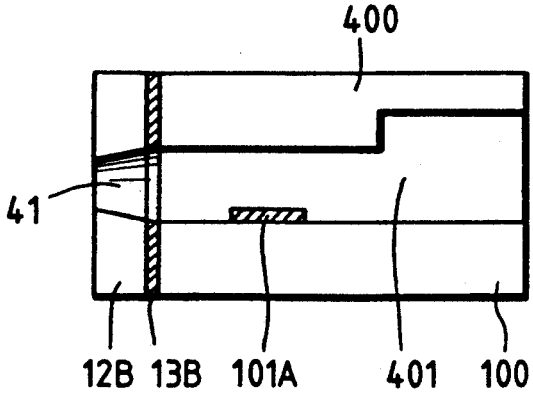
FIG. 25 is a cross section of orifice and ink path of ink jet recording head of one embodiment.

FIG. 25 is a sectional view of the main recording head thus obtained. As can be clearly seen by comparison between FIG. 25 and the sectional view of the main recording head of the prior art shown in FIG. 31, since the side of the orifice plate on which laser beam is irradiated is bonded to the opened face of the ink channel, the shape obtained by this example becomes tapered, being widened in the direction opposite to the discharging direction. With such shape, the discharging speed and the ink amount discharged are increased stably to give the result that quality of the recorded image is improved.

Figure 26:
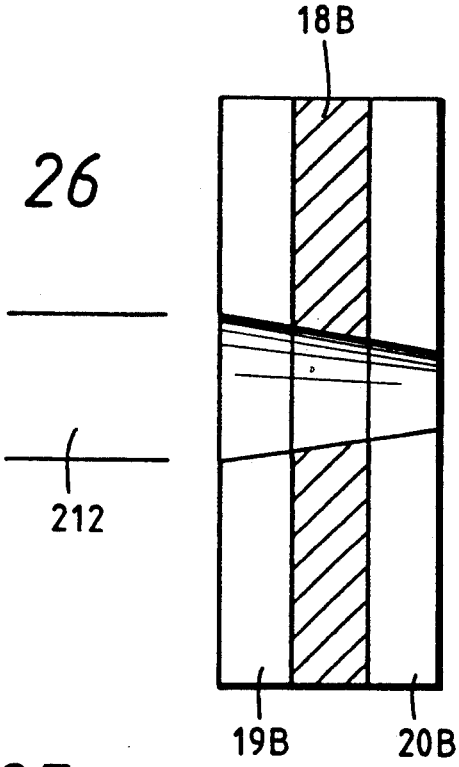
FIG. 26 is a schematic view in which orifice plate used for another embodiment is formed.
Figure 27:
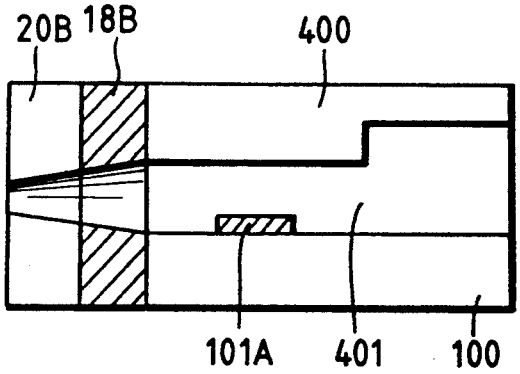
FIG. 27 is a cross section showing orifice manufacturing process according to the above embodiment.
Figure 28:
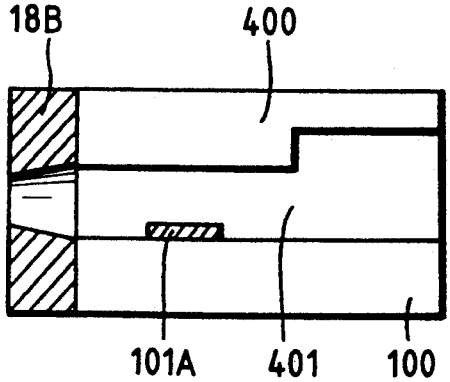
FIG. 28 is a cross section of orifice and ink path of above embodiment.

Next, an example by use of a dry film (Tokyo Ohka, SE320) as the material of the orifice plate is described by referring to FIG. 26 to FIG. 28. The laser beam, the optical system and the projection mask are the same as in the example as described above.

FIG. 26 is an enlarged views of the portion where the laser beam 212 is incident on the film, and in FIG. 26, 18B is a dry film forming the orifice plate, 19B a protective film comprising a polyether and 20B a Mylar.

In this constitution, after the laser beam 212 is first irradiated, the orifice plate of the dry film obtained by peel-off of the protective film 19B is bonded to the opened face of the ink channel (FIG. 27).

Next, the Mylar is peeled off to form the state shown in FIG. 28, and UV-ray is irradiated on the orifice plate 18B of the bonded dry film from the discharging direction side to effect photocuring, thereby completing the main ink jet recording head. Also according to this example, a shape with the taper of the orifice being widened in the direction opposite to the ink discharging direction is obtained.

Figure 30:
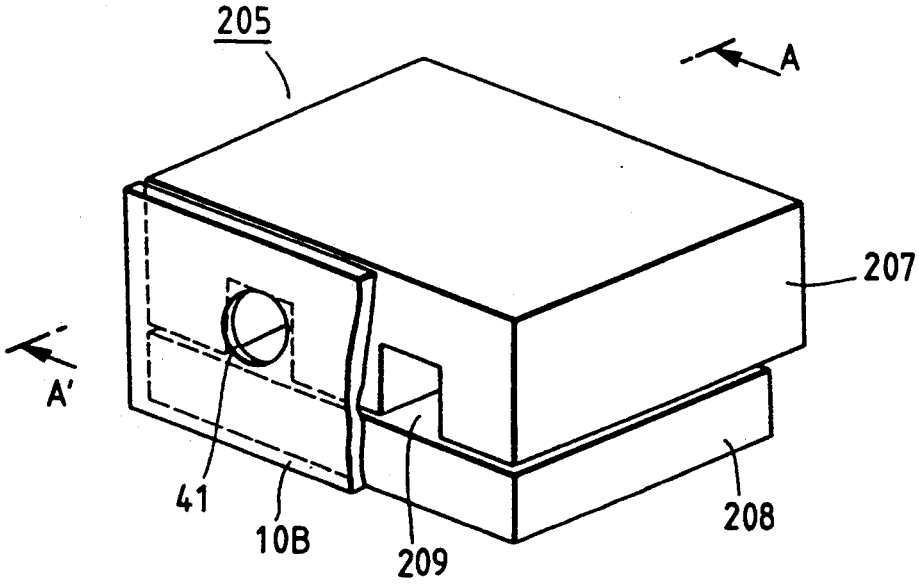
FIG. 30 is a schematic perspective view of main body having orifice of ink jet recording head.
Figure 31:
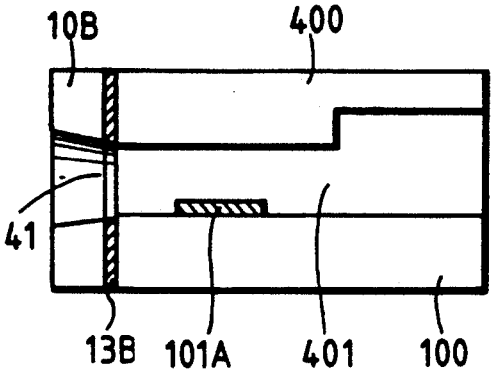
FIG. 31 PRIOR ART
FIG. 31 is a cross section of main body having orifice of ink jet recording head.

FIGS. 30 and 31 show detail of a main body 205 of the ink jet recording head in which a orifice is formed by causing the laser beam 212 oscilated from laser device 210 of FIG. 29 to enter from an orifice forming surface side of the body 205, among which FIG. 30 is an enlarged view of the head body (each members are shown so as to be separated slightly for simplicity), FIG. 31 is a cross section thereof.

In FIGS. 30 and 31, 207 is a ceiling plate provided with grooves for forming the groove discharging the ink, 208 is a base plate provided with patterning of the discharge energy generating element, 209 is an opening communicated with the ink path, 10B is an orifice plate made of resin film, 41 is an orifice formed on the orifice plate 10B. 13B is an adhesive agent for adhering the orifice plate 10B to an opened surface at which the opening of ink path, 401 is an ink path, 101A is an electro-mechanical converting element as discharge energy generating element.

As shown in FIG. 31, the orifice work according to mere excimer laser, orifice portion may have tapered configuration whose discharge opening side is flared.

On the contrary, according to the above embodiment, the orifice may have convergent configuration, it is possible to obtain the amount of ink liquid droplet necessary for recording and the discharge speed, to recording image in high quality can be realized.

In the following, an another example of the present invention is described in detail.

Figure 32A:
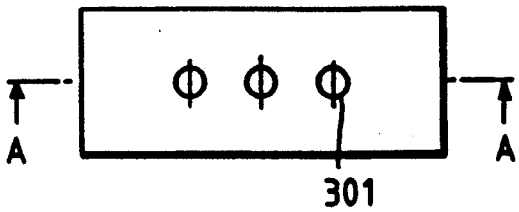
FIG. 32A is a plan view and FIG. 32B is a cross section along line A—A of FIG. 32A.
Figure 32B:
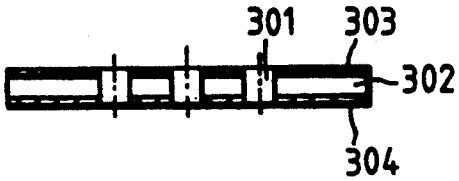

In the method of the present invention, first as shown in FIG. 32B, on one surface of a plate member 302 capable of forming a discharging orifice plate, a liquid repellent (ink repellent) coating layer 303 and an adhesive layer 304 are provided. As the plate member 302, one comprising a resin, a metal, etc. can be utilized.

As the resin to be used for the plate member in the case of using a thermosetting resin for the adhesive layer 304, it is preferable to use a resin having high heat resistance which will not give rise to deformation, etc. during heat curing of the adhesive layer 304, such as polyimide, polyether sulfone, polysulfone, polyester, acrylic resin, phenol resin, urea resin, melamine resin, epoxy resin, silicone resin, etc.

Also, the resin plate member may be also improved in strength and other characteristics by addition of various additives or fillers into the resin. When a plate member made of a metal is used, for example, a plate member comprising stainless steel, nickel, gold, silver, platinum, etc. can be utilized.

Said plate member should be conveniently thin in its thickness for the purpose of inhibiting flash or residue during formation of thru-holes for formation of discharging outlets as described below to the extent which gives no bad influence on ink discharging, or for the purpose of performing continuous perforation but for the balance with the strength, it should desirably have a thickness within the range from 5 to 100 μm.

The liquid repellent coating layer 303 may be formed of any material provided that it has a sufficient adhesion characteristic with the plate member 302, and also has liquid repellency to the extent that it repells aqueous ink to be used for recording and the ink does not remain as droplet by attachment on the surface and, for example, can be formed of a material suitably selected from the materials known as conventional liquid repellent treating agents. Also, during formation of such coating layer, the layer thickness or other forming conditions may be suitably set so that good liquid repellent characteristic at the discharging outlet surface may be obtained.

The adhesive layer 304 may be formed of a material suitably selected which can give good bonded state between the discharging orifice plate and the main recording head portion and, for example, an epoxy type adhesive subjected to B staging by the heating treatment under the conditions of 100° C.–120° C. for 30 to 60 minutes, etc. can be utilized, and provided to a layer thickness of about 1 to 5 μm.

For formation of the liquid repellent coating layer 303 and the adhesive layer 304, for example, there can be utilized, for example, the dipping method, the coating method, the printing method, the spraying method, the method of transferring the liquid repellent coating layer or the adhesive layer to a predetermined portion, etc.

Next, a thru-hole 301 is opened at a predetermined portion of the plate member 302 having the liquid repellent coating layer 303 and the adhesive layer 304 provided thereon as described above.

For formation of the thru-hole 301, the press working method, the electron beam working method, the laser beam working method, the liquid jet working method, etc. can be utilized. By combining the plate member 302 with the above-mentioned constitution with these methods, of high precision perforation working can be done at high speed and simply.

Figure 3A:
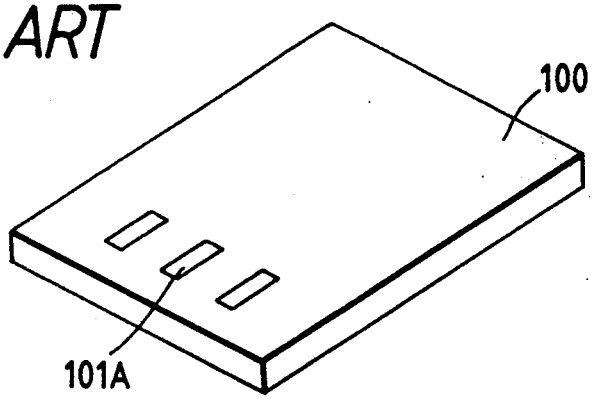
FIG. 3A PRIOR ART
FIGS. 3A to 3C and FIGS. 4A and 4B are views of construction of ink jet recording head using discharge opening plate.
Figure 3B:
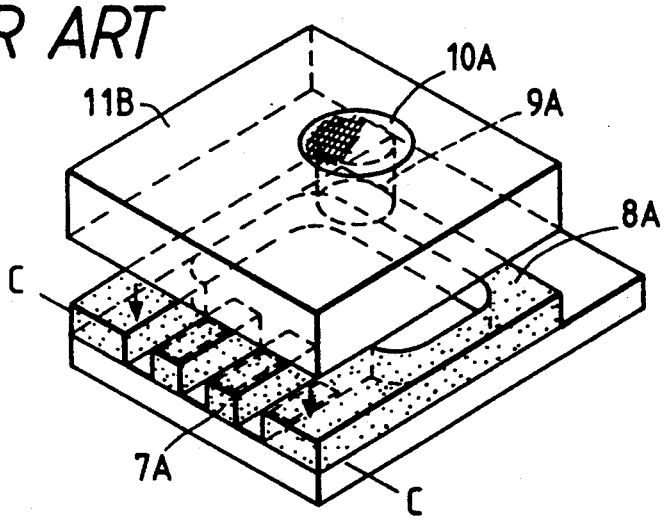
FIG. 3B PRIOR ART
Figure 3C:
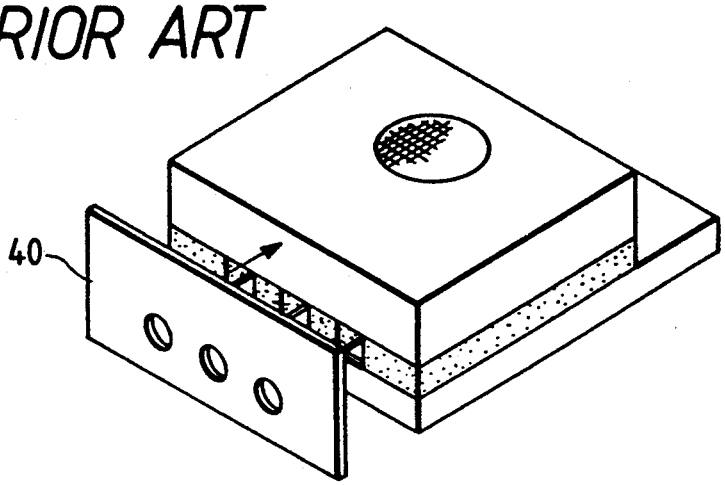
FIG. 3C PRIOR ART
Figure 4A:
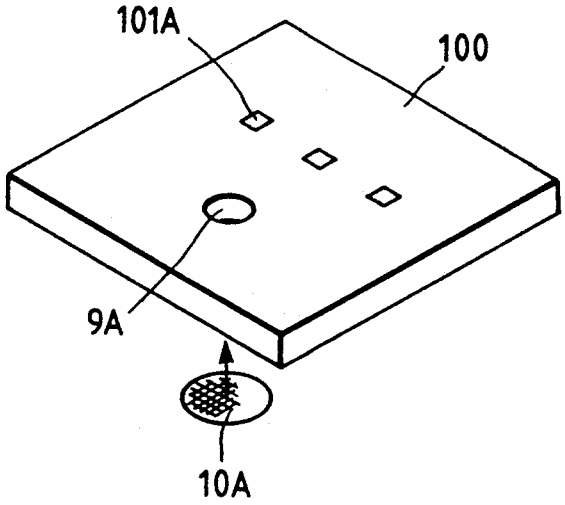
FIG. 4A PRIOR ART
Figure 4B:
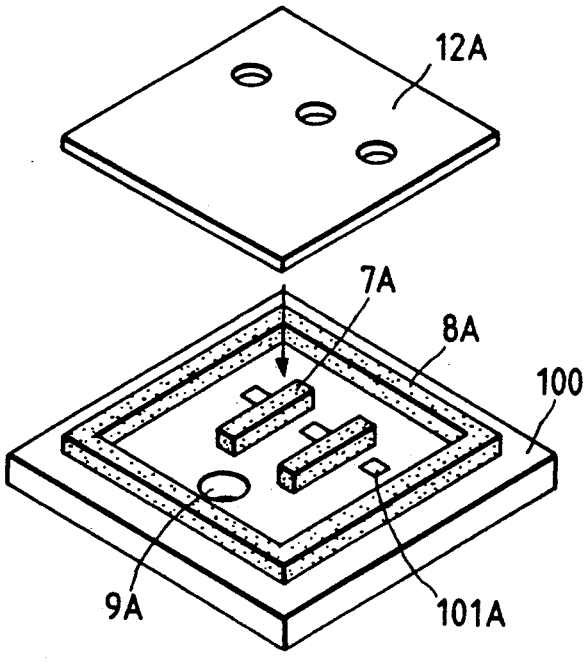
FIG. 4B PRIOR ART

The discharging orifice plate formed as described above is tentatively bonded by superposing with registration on a predetermined position of the main recording head portion having flow channel walls, etc. with the constitution as shown in FIG. 3 and FIG. 4 provided on a substrate through, for example, the adhesive layer 304 subjected to B staging, then subjected to the heating treatment under the condition of 150° to 200° C. for 30 to 120 minutes to completely cure the adhesive layer 304 subjected to B staging to effect bonding these, whereby the recording head of the present invention can be obtained.

EXAMPLE A

On one surface of a polyimide film (plate material) with a thickness of 30 μm, an epoxy type adhesive comprising a mixture of various components shown below was coated according to the spin coating method under various conditions shown below, further subjected to the heating treatment under the conditions of 100° C. to 120° C., and 30 to 60 minutes, followed by drying and solidification to effect B staging, to give a number of plate materials attached with adhesive layers. The layer thickness of the adhesive layer after B staging was found to be 1 to 5 μm.

| | |
|---|---|
| (1) Mixture of Epikote 1004 (trade name) and methyl ethyl ketone formulated at 2:1 (weight ratio) | . . . 100 parts by weight |
| (2) Mixture of dicyandiamide and dimethyl-formamide formulated at 1:4 (weight ratio) | . . . 3 parts by weight |
| (3) N,N-dimethylbenzylamide | . . . 0.2 parts by weight |
| Spin coating conditions: | |
| rotational number: 500–1000 rpm<br>time: 5–10 sec. | |

Next, on the surface (back surface) opposed to the surface of the plate material attached with the adhesive layer where the adhesive layer is provided, a solution prepared by adding a fluorine silicon coating agent KP - 801 (trade name, manufactured by Shinetsu Kagaku Kogyo) to 0.07% by weight into Difreon S-3 (trade name, manufactured by Daikin Kogyo) was spin coated under the various conditions shown below, and then subjected to the heating treatment of 80° C. to 120° C. form a liquid repellent coating layer of 1 μm or less.

| Spin coating conditions: |
|---|
| rotational number: 2500–3000 rpm<br>time: 20–30 sec. |

Next, on each of the plate materials obtained by the above operations, 48 thru-holes (diameter 30±2 μm, pitch 70.6±2 μm) were formed according to the continuous perforation working method by a press at predetermined positions to obtain a discharging orifice plate.

When the states of the liquid repellent coating layer and the adhesive layer in the discharging orifice plate obtained were examined, both were found to be formed uniformly with predetermined layer thicknesses only on the surface of the plate, with only the polyimide film being exposed within the thru-holes for forming the discharging orifices.

The thus obtained discharging orifice plate was tentatively adhered with registration at the predetermined positions shown respectively on the main recording head portion having flow channel walls, etc. on a substrate with the constitution shown in FIG. 3 and FIG. 4 through its adhesive layer, and then the adhesive layer of the discharging orifice plate was completely cured by the heating treatment at 150° C. to 200° C. for 30 to 120 minutes, to complete a recording head.

As the main recording head portion to be used in this Example, one conventionally used in this field was used. Also, the ink discharging energy generating member, the electrical system for applying discharging signals on said generating member, etc. were formed by utilizing the materials conventionally used in this field.

EXAMPLE B

A discharging orifice plate was obtained in the same manner as in Example a except for using a stainless steel plate with a thickness of 50 μm as the plate material, and forming perforation of thru-holes by the continuous perforation working with electron beam.

The discharging orifice plate obtained was found to have good quality similarly as in Example a.

These discharging orifice plates were tentatively adhered with registration on the predetermined positions shown on the main recording head portion with the construction shown in FIG. 4 (formed by utilizing materials conventionally used in this field), and then adhesive layer of the discharging orifice plate was completely cured by the heating treatment at 150° C. to 200° C., for 30 minutes to 120 minutes, to complete a recording head.

COMPARATIVE EXAMPLE A

On a polyimide film with a thickness of 30 μm, thru-holes were provided with the same sizes and the arrangements as in Example 1 according to the continuous performation working method by a press.

On the other hand, a solution obtained by mixing a two-liquid epoxy adhesive (trade name: HP-2R/2H, manufactured by Canon Chemical) mixed into methyl ethyl ketone at a ratio of 0.5% by weight was uniformly spin coated on a 0.5 mm silicone rubber under the conditions shown below.

Spin coating conditions:
rotational number: 500–1000 rpm
time: 5–10 sec.

Next, the bonded surface of each discharging orifice plate of the main recording head portion used in Example a (with the constitution shown in FIG. 3 and FIG. 4) is pressed under a load of about 2 kg/cm$^2$ against the two-liquid mixed epoxy resin adhesive layer on the silicone rubber obtained by the above operation, and then the silicon rubber was peeled off to have the adhesive layer onto the main recording head.

The discharging orifice plate previously obtained was tentatively adhered with registration onto the transfer adhesive layer thus obtained, and then subjected to the heating treatment at 60° C. to 100° C. for 30 minutes to 60 minutes to cure the adhesive.

Next, the fluorine silicone coating agent solution used in Example a was spin coated uniformly on a silicone rubber with a thickness of 0.5 mm under the conditions shown below.

Spin coating conditions:
rotational number: 2500–3000 rpm
time: 20–30 sec.

After the whole discharging orifice surface bonded to the main recording head previously obtained was pressed under a load of 2 kg/cm$^2$ against the fluorine silicone coating agent layer on the silicon rubber thus obtained, the silicone rubber was peeled off to have the fluorine silicone coating agent layer transferred onto the discharging orifice plate surface of the main recording head, followed further by curing by heating at 80° C.–120° C., to complete a recording head.

COMPARATIVE EXAMPLE B

A recording head was prepared in the same manner as in Comparative example a except for using a stainless steel plate with a thickness of 50 μm as the plate material, and the same one as used in Example b as the main recording head.

When tests were conducted for yields in the bonding steps and the liquid repellent treatment steps of the discharging orifice plates in the recording heads obtained in the respective Examples and Comparative examples, and initial printing and prolonged printing in recording operations by use of the recording heads obtained, the results shown in Table 2 were obtained.

In the respective tests, 50 of the recording heads prepared for each of the respective examples were used.

TABLE 2

| | Example a | Example b | Comparative example a | Comparative example b |
|---|---|---|---|---|
| Discharge-ing plate bonding | 100% | 100% | 88% | 94% |
| Ink repellent treatment | | | 91% | 89% |
| Initial printing | 100% | 100% | 95% | 95% |
| Prolonged printing | 100% | 100% | 95% | 98% |

In the following, other examples of the present invention are described by referring to the drawings.

Figure 33:
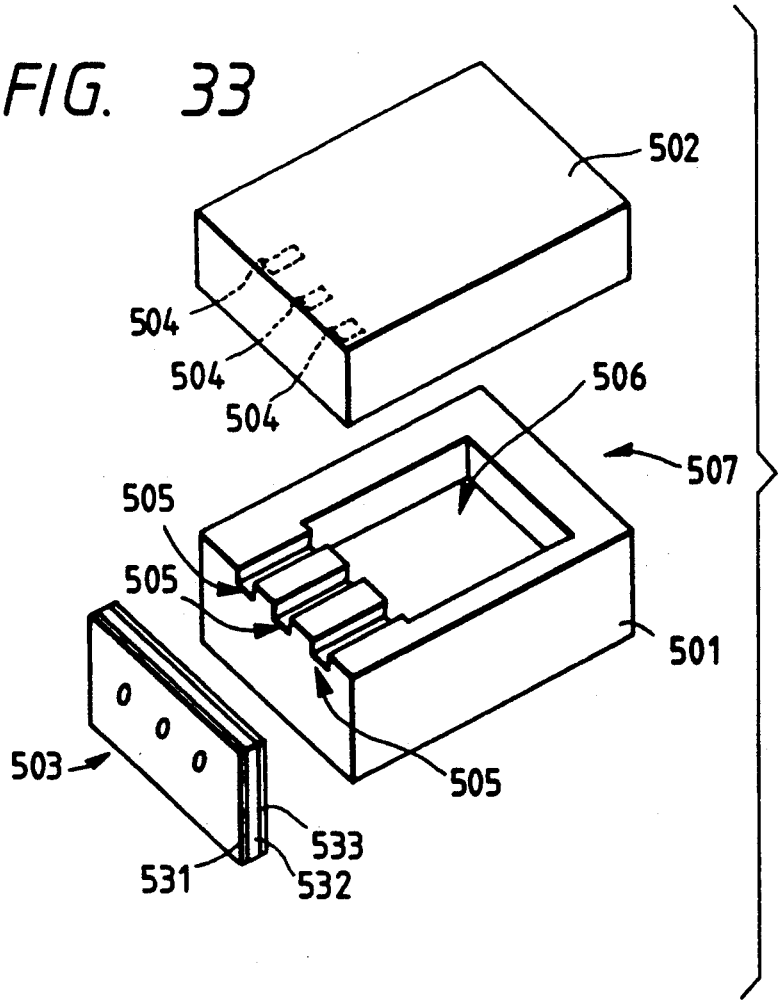
FIG. 33 is a view showing construction of ink jet head manufactured by method of present invention.

First, as shown in FIG. 33, the ink jet liquid has grooves which become ink channels 505 and ink liquid chamber 506 on an appropriate substrate 501 such as glass, metal, plastic, etc., and further has an energy generating member 504 for generating energy to be utilized for discharging ink such as heat energy, etc. on the lower side of another substrate 502 along the groove formed along the substrate 501, followed by bonding of the substrate 501 and the substrate 502 to prepare a main head 507. Subsequently, the discharging orifice plate 503 which is a plate body of a multilayer structure applied with high precision hole opening by press working is adhered to the surface of the main head 507 where openings communicated to the ink channels 505 are formed.

Next, the multilayer structure of the discharging plate 503 as described above is described by referring to FIG. 34 and FIG. 35.

Figure 34:
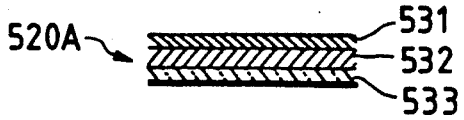
FIGS. 34 and 35 are cross sections showing layer construction of plate-like member.

Referring first to FIG. 34, this case is formed of a plate body 520A comprising the three layers having an ink repellent layer 531, a base film 532 and an adhesive layer 533 successively laminated, and after the plate body 520A is subjected to hole opening by press working, it is adhered as the discharging orifice plate 503 with the adhesive layer 533 onto the main head 507.

Figure 35:
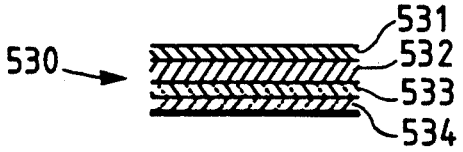

Referring to FIG. 35, this case is formed of a plate body 530 comprising four layers having an ink repellent layer 531, a base film 532, an adhesive layer 533 and a release film 534 successively formed, and after the plate body 530 is subjected to hole opening by press working, it is adhered as the discharging orifice plate 503 by peeling the release film 534 with the adhesive layer 533 onto the main head 507.

As the base film 532 laminated in the plate bodies 520A, 530, it is desirable to use a plastic film excellent in ink resistance, for example, non-stretched film such as polyether ether ketone (PEEK), polyether sulfone (PES), polysulfone (PSF), polyethylene terephthalate (PET), polyimide, etc. This is intended to inhibit the shrinkage to minimum during heating of the plate bodies 520A, 530 at the time of curing of the adhesive, and in this example, a polyether ether ketone (PEEK) with a plate thickness of 25μ is employed. The nonstretched film of 25μ polyether ether ketone (PEEK) is sufficiently satisfactory in precision with a heat shrinkage of 0.1% or less after held at 150° C. for 4 hours.

Figure 36:
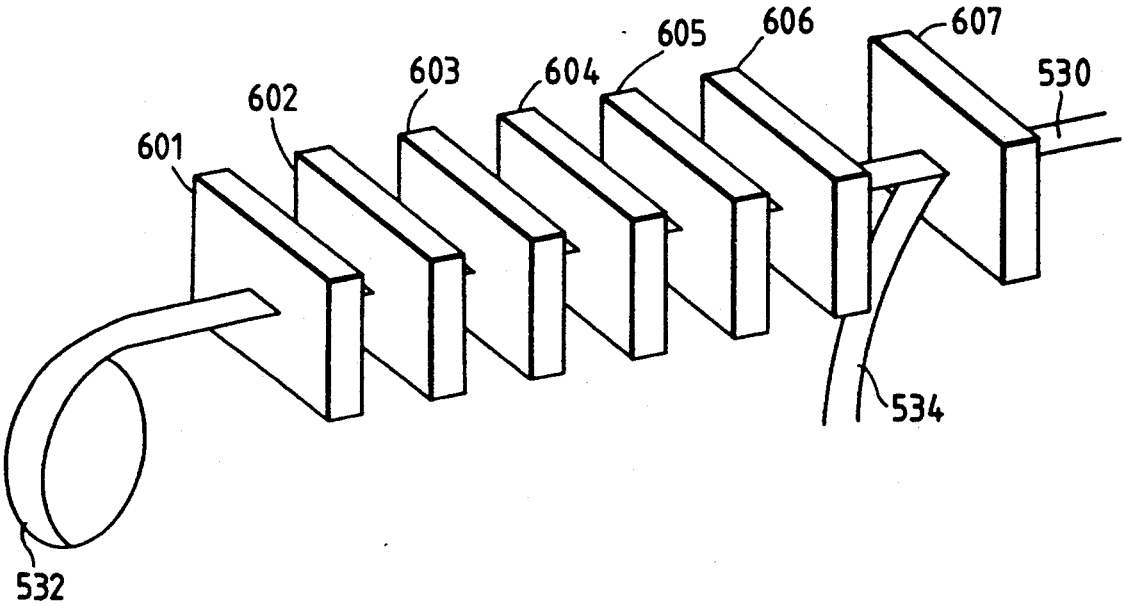
FIG. 36 is a view showing manufaturing process of plate-like member.

Subsequently, the preparation steps of the plate body with the multilayer structure are described by referring to FIG. 36 by taking an example of the plate body 530 with the four layer structure as described above.

The preparation steps of the plate body 530 comprise the 7 steps of the film washing step 601, the ink repellent treatment agent coating step 602, the drying step 603, the surface modification step 604, the adhesive coating step 605, the drying step 606 and the release film molding step 607.

In the following, the respective steps are described in detail.

The points of the present embodiment are the ink repellent treatment and the adhesive coating, and therefore other steps are omitted.

First, concerning the ink repellent treatment agent coating step 602, it has been practiced in the prior art to effect the water repellent treatment after hole working, whereby there may be occurred clogging of hole with the ink repellent treatment agent. This problem can be improved by applying this step to the base film 532. As the ink repellent treatment agent, fluorine type or silicon type agents such as Fluorocoat of Asahi Glass, LF-40 of Soken Kagaku, DEFENSA-7702 (trade name) of Dainippon Ink Kagaku, etc. may be employed. In this example, DEFENSA-7702 is coated by a roll coater.

Next, concerning the adhesive coating step 605, the base film 532 as described above is excellent in chemical resistance and therefore adhesion strength between the adhesive and the base film 532 cannot but become weak. For improvement of the adhesion strength between the adhesive and the base film 532, surface modification of the base film 532 is effected in the surface modification step 604.

As the means for surface modification, the plasma treatment, the uv/$O_3$ treatment, etc. are effective. As an example of the present invention, the uv/$O_3$ treatment method was employed. Evaluation of surface modification was performed in terms of contact angle. By irradiation of a light of 2537Å at 20 mw/cm² for 5 minutes, the initial contact angle 36° could be improved to 31 with polyether ether ketone (PEEK). As the next step, the step of coating an adhesive onto the base film 532 with the modified surface is performed, and the characteristics demanded for the adhesive may include the following items.

1. It is initially smooth without stickiness.
2. It becomes sticky with light, heat etc. when bonded to the main head.
3. It has firm adhesive force after the main adhesion.
4. It is excellent in ink resistance.

As the adhesive satisfying these conditions, epoxy type uv curable adhesives, acrylic uv curable adhesive, etc. may be included. In this example, a stock solution of a dry film is coated by roll coating and vacuum dried.

Finally, the release film plastering step 607 is not required if the above characteristic 1 of the adhesive layer 533 being initially smooth is complete, but practically more or less stickiness may sometimes remain, and therefore in view of easiness during the press working in the later step, a release film 534 may be laminated. As the release paper, polyethylene (PE), polyvinyl fluoride (PVF), etc. are suitable.

By use of the plate body 530 obtained according to the steps as described above, the item of clogging of holes with adhesive, ink repellent treatment agent which is the problem of the prior art has been solved. In preparing the plate body 520A with the three layer structure shown in FIG. 36, it can be accomplished by deleting the release film plastering step 607 in FIG. 36.

Subsequently, hole opening for forming ink discharging orifices is performed by applying press working on the plate body 530 obtained according to the steps as described above.

Figure 37:
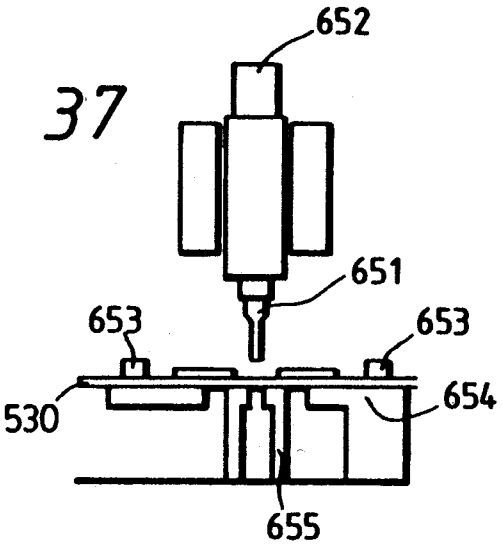
FIG. 37 is a front view of one embodiment of drilling device.

In this case, the plate body 530 is mounted on the delivery table 604 and the die 655 of a press hole opening device as shown in FIG. 37, fixed with the film press 653, and holes are opened by driving the punch 651 by the punch driving source 652. In this example, the discharging orifice diameter is made 3.2 μm and the pitch 70.5 μm. Generally speaking, in the case of hole opening by means of a press, punching sag, burr are generated, but in this example, the influence is made null by making the punching sag an adhesive, and further generation of the burr could be inhibited by controlling the clearance of the die 652 of the punch 651 to about 1μ.

Thus, according to this example, a highly precise ink jet head can be obtained by forming ink discharging orifices by press working of a plate body with a multilayer structure.

Figure 38A:
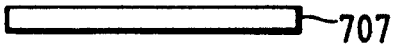
FIGS. 38A to 38H are process views for explaining main processes of a method of the present invention.
Figure 38B:
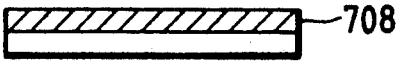
Figure 38C:
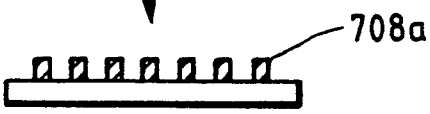

In another method of the present invention, as shown in FIGS. 38A to 38C, there is formed a pattern of the resin layer **708*a* corresponding to the desired arrangement stage of discharging orifices on the surface of a substrate 707, comprising a metal plate, Si, a glass plate, Si, a glass plate having an electroconductive layer provided thereon, having electroconductivity, and from which the metal layer 709** formed later is peelable.

When the metal layer 709 as described below is demanded to have high uniformity, smoothness, etc., it is preferable to use a substrate having a metal film such as of aluminum, metal, titanium, etc. formed by such method as sputtering, etc. on a substrate with better plane characteristic, smoothness such as glass, Si, etc.

Formation of the resin layer pattern **708*a* can be performed by laminating a photosensitive resin layer 708 on the surface of the substrate 707 as shown in FIG. 38B, then exposing the photosensitive resin layer 708 through a desired pattern to light, or spot irradiating the photosensitive resin layer 708 in a desired pattern, and developing the photosensitive resin layer 708 after exposure, thereby leaving the pattern of the resin layer 708*a*** to remain on the substrate surface.

For formation of the pattern of the resin layer **708*a***, the method utilizing photolithography as described above is not limitative, but other various methods can be used.

Figure 38D:
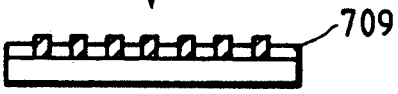
Figure 38E:
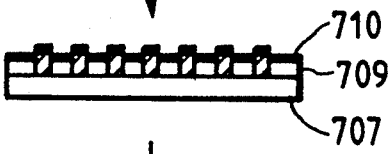

Next, as shown in FIG. 38D, on the surface of the substrate where the resin layer **708*a* is provided, a metal layer 709 which is the constituent material of the discharging orifice plate is formed by electroforming, and then water repellent treatment is applied on the metal layer 709 surface as shown in FIG. 38E to form the layer 710** of water repellent treatment agent.

For formation of the metal layer 709, a material having necessary rigidity and satisfactory characteristics to ink may be suitably selected and used for the discharging orifice plate. For example, nickel, etc. can be utilized.

For water repellent treatment of the metal layer 709, by using one suitably selected from various water repellent treatment agents conventionally used for water repellent treatment of metal surfaces in view of the material of the metal layer 709, etc., the conditions for obtaining good water repellent treatment effect may be set.

Figure 38F:
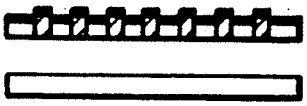
Figure 38G:
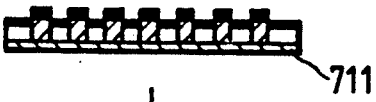
Figure 38H:
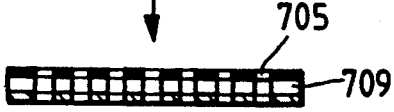

After the water repellent treatment, the metal layer 709 is peeled off from the surface of the substrate 707 to provide a metal plate (FIG. 38F). Next, after providing an adhesive layer 711 on the lower surface of the metal plate 709 (FIG. 38G), and further protecting said adhesive layer 711 with an appropriate film (not shown), the resin **708*a* is treated with an appropriate liquid for dissolution and removal thereof to remove the resin 708*a* from the metal plate 709, thereby forming a void portion (thru-hole) for forming the discharging orifice from which the resin 708*a*, is withdrawn to obtain a discharging orifice plate (FIG. 38H**).

As the method for applying the water repellent treatment agent onto the metal layer 709 surface and forming the adhesive layer 711, other than the coating method as described above, there can be utilized the method in which the metal layer is peeled off previously from the substrate to be taken out as the plate before performing the water repellent treatment, one surface of said plate is sprayed with the water repellent treatment agent, while the other surface with an adhesive (711) either with a time difference or simultaneously; the method in which a water repellent treatment agent layer formed on an appropriate base material such as Mylar film, etc. is superposed on one surface of said plate, pressed with rollers, etc., and further a water repellent treatment agent formed on an appropriate base material such as Mylar film, etc. is formed on the other surface, pressed with rollers; or the method in which a water repellent treatment agent layer formed on an appropriate base material such as Mylar film, etc. on one surface of said plate, and also a water repellent layer formed on an appropriate material such as Mylar film, etc. is superposed on the other surface, and the whole composite is pressed all at once.

The discharging orifice plate thus obtained has one surface subjected to the water repellent treatment and the other surface having an adhesive layer which can be utilized for bonding to a bonding member having liquid channels, etc. formed thereon which becomes the ink passage for formation of ink jet recording head.

In the method as described above, since the portion which becomes the orifice of the metal plate is filled with the resin 708 during the water repellent treatment, the water repellent treatment will not extend to the portion which becomes the orifice inner surface. Besides, due to the presence of the resin 708, formation of the adhesive layer 711 can be done more easily.

EXAMPLE C

On a predetermined surface of a plate material (thickness 0.5 mm) made of a stainless steel (SUS 304) which is an electroconductive substrate, a dry film (Laminate HG, manufactured by Dinachem) was laminated and pattern exposure and developing processing were applied on said laminate film (thickness 25 μm) to form spot-like resin layers arranged corresponding to the arrangements of the discharging orifices.

Next, nickel plating was effected on the spot-like resin layer formed surfaces on the electroconductive substrate to form a nickel plated layer (thickness 20 μm).

Further, a solution of a fluorosilicon type KP-801 (trade name) manufactured by Shinetsu Kagaku as the water repellent agent dissolved at a ratio of 0.01% by weight dissolved in Difreon S3 (trade name, manufactured by Daikin Kogyo) was prepared, coated on the nickel plated layer surface on the electroconductive substrate by the spin coating method, followed by drying of the coated layer (thickness 1 μm or less) by the heating treatment under the conditions of 150° C., 2 hours, to effect the water repellent treatment.

After completion of the water repellent treatment, the electroconductive substrate and the nickel plated layer were peeled off to give a nickel plate.

Next, on the peeled surface of the nickel plate from the electroconductive substrate, an adhesive (Takelite xP-405/xH-8901b, manufactured by Takeda Seiyaku) was coated to form an adhesive layer (thickness 2 μm), and further a Mylar film was laminated on said adhesive layer, followed by treatment with an aqueous 3–4% sodium hydroxide solution and removal of the dry film from the nickel plate, to give a discharging orifice plate.

Figure 5:
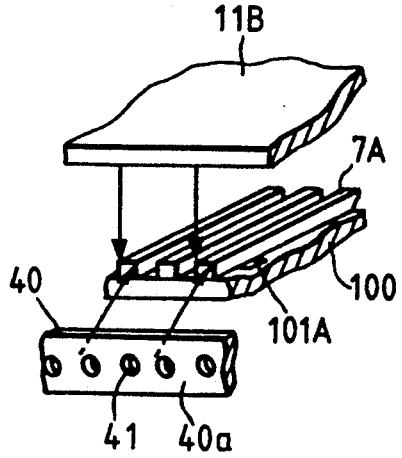
FIG. 5 PRIOR ART
FIG. 5 is an exploded perspective view showing main portion of ink jet recording head using discharge opening plate.
Figure 6A:
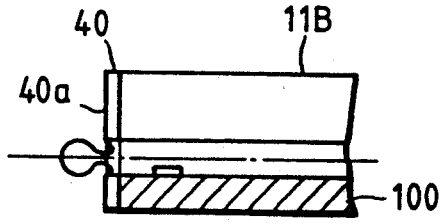
FIGS. 6A and 6B are partial cross sections for explaining ink discharge condition.
Figure 6B:
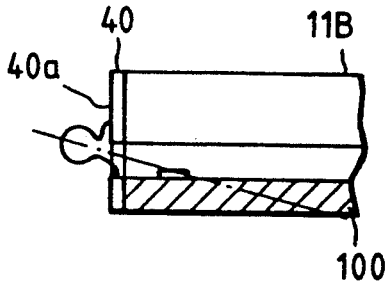

The Mylar film on the discharging orifice plate obtained was peeled off to have the adhesive layer exposed, and bonded to the main recording head portion having an energy generating member generating energy used for ink discharging, a discharging signal applying means onto the energy generating member, ink channels, etc. formed on a substrate as shown in FIG. 5 to prepare an ink jet recording head. As the result of ink discharging test, the slippage angle from the predetermined discharging direction is 1° at the maximum, and also no nondischarging occurred because there was no progress of the water repellent into the inner portion of the discharging orifice. Also, when discharging was performed for a long time, there was no unnecessary pooling of ink on the surface, whereby stable discharging could be persisted.

EXAMPLE D

After a discharging orifice plate was obtained in the same manner as in Example c except for using the product obtained by sputtering an aluminum coating layer on a Si substrate surface as the substrate for formation of the discharging orifice plate, an ink jet recording head was prepared.

In the recording test in the ink jet recording head obtained, the slippage of ink droplets from the predetermined shooting spots was 25 to 30 μm, and hence its printing was found to be improved as compared with that of the prior art.

Also, although the heater 108 can be formed by use of the same material as the heat generating resistance layer of the discharging heater 105 (e.g. $HfB_2$), it may be also formed by use of other materials constituting the heater board, such as aluminum, tantalum, titanium, etc.

Figure 39:
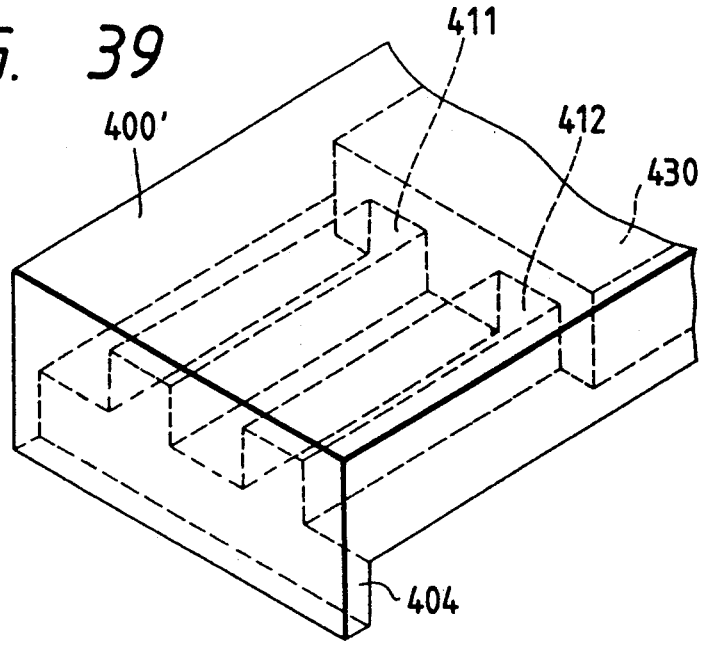
FIG. 39 is a perspective view showing blank of ceiling plate used in the present embodiment.

FIG. 39 shows a constitutional example of the ceiling plate material for constituting the ceiling plate 400 according to another embodiment.

The ceiling plate material 400' is made to have a desired number of ink channel grooves 411, 412, . . . (two in the Figure for brevity) and an orifice plate portion 404 provided integrally.

In the constitutional example shown in FIG. 39, the ceiling plate material 400' is simultaneously molded integrally together with the orifice plate portion 404 by use of a resin of excellent ink resistance such as polysulfone, polyethersulfone, polyphenyleneoxide, polypropylene, etc. The orifice plate portion 404 may be also formed of the same resin material as the main body portion of the ceiling plate material 400' or another kind of resin material, which may be prepared separated from the main portion of the ceiling plate material 400' and inserted into the mold for insert molding.

As for the ink flow channel groove, the resin can be molded with a mold having a reverse pattern thereto formed by such method as cutting, etc., whereby the flow channel grooves 411, 412 can be formed on the ceiling plate 400.

The orifice plate 404 having thus been integrally molded has a thickness of about 50 to 100 μm in molding. Although the orifice can be also formed under this state, but practically the flow channel length of that portion should be desirably 20 μm or less. This is because, if the flow channel length from the discharge heater 101A is large, discharging performance is influenced thereby. Accordingly, in this example, particularly the portion over the range where orifices to be formed are arranged corresponding to the grooves 411, 412 of the orifice plate portion 404 is worked to be made thin before formation of the orifices. In this example, excimer laser was used for working.

Figure 40:
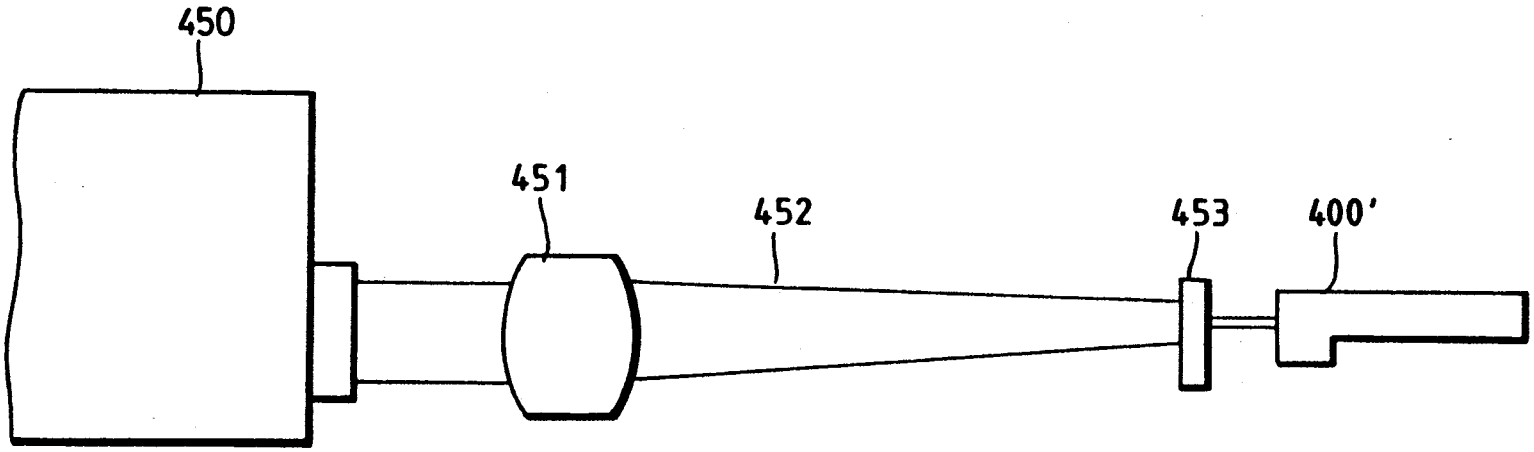
FIG. 40 is a view showing excimer laser device for forming orifice plate portion.

FIG. 40 is a schematic illustration of a device for performing working by use of such excimer laser. Here, 450 is an excimer laser oscillator (in this exmaple, it is made a Kr-F excimer laser oscillator), 451 is a lens of, for example, f value of 500 mm for converging laser beam 452. 453 is a mask comprising a plate of Al, etc. with a thickness of, for exmaple, 1 mm having a hole pattern corresponding to the worked portion. The ceiling plate material 400' is arranged adequately so that the surface to be worked may be irradiated by laser beam through the lens 451 and the mask 453.

In the step of making the orifice plate portion 404 thin, the laser beam emitted from the Kr-F excimer laser oscillator 450 is irradiated on the orifice plate 404 through the mask 453 having, for example, a rectangular shape formed thereon. The orifice plate 404 becomes thin by working only of the portion where irradiated with excimer laser.

Figure 41A:
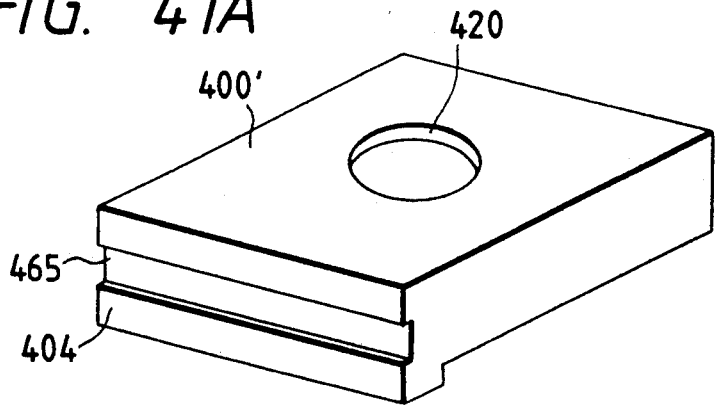
FIGS. 41A and 41B are views for explaining ceiling plate manufacturing process according to device of FIG. 40.

FIG. 41A exhibits such state, where 465 is the grooved portion made thin by said working. At this time by controlling adequately the strength of laser and the working time, the thickness of that portion could be made about 10 to 20 μm.

Next, the orifice plate 404 is subjected to the liquid repellant treatment, because the surface having liquid repellancy has the effect to wetting of unnecessary ink, etc. In this example, as the liquid repellant, DEFENSA from Dainippon Ink diluted with Difreon S-3 from Daikin to 1% is coated. Next, for curing of the liquid repellant, UV-ray irradiation is effected.

Figure 41B:
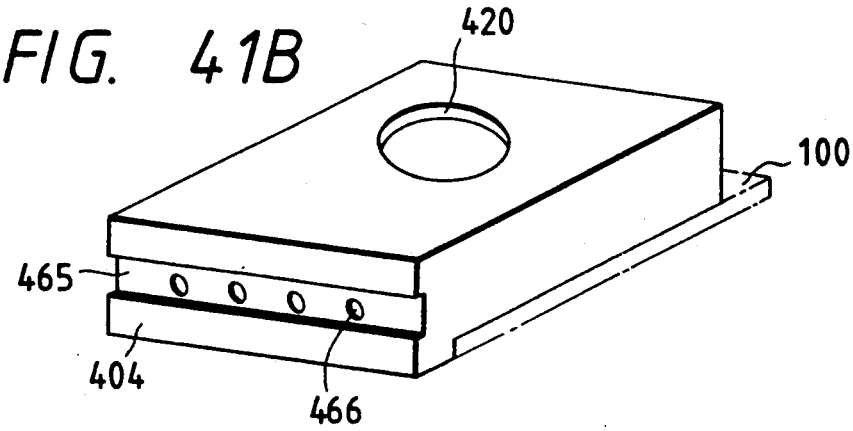

Next, orifices corresponding to flow channels are formed by working with excimer laser. This can be done by replacing the mask having formed the holes corresponding to the orifices with the above mask in FIG. 40. After replacement, registration is effected, lowered by irradiation of laser to form orifices 406. Thus, the ceiling plate 400 as shown in FIG. 41B can be received. In FIG. 41B, for brevity, 4 orifices (or flow channels) are provided.

Concerning also grooves 411, 412 for flow channel formation and the common liquid chamber portion, these may be also worked with excimer laser, or these may be also worked after formation of the discharging outlet (orifice) portions. Also, when the length of the flow channel length in front of the discharging heater poses no problem, the orifice plate portion 404 is not necessarily made thin depending on the constitution.

Then, the heater board 100 is abutted against the orifice plate 404 as shown by the chain line to be bonded thereto, thereby giving a main recording head.

According to such constitution as described above, since no registration or adhesion between the ceiling plate and the orifice plate required as in the prior art, there is no registration error or positional slippage during adhesion at all, whereby reduction in defective products and shortening of the steps could contribute to bulk productivity and lowering in cost of the recording head. Also, since there exists no adhesion step between the ceiling plate and the orifice plate, there is no fear of clogging of the orifices or ink flow channels by flowing of the adhesive. Further, since the position can be determined of the flow channel direction by abutting the heater board 100 against the end surface on the opposite side to the end surface on the discharging side of the orifice plate portion 404 during bonding of the heater board 100 and the ceiling plate 400 integrally made with the orifice plate portion 404, the whole registration step and assembling step can be made easier. In addition, there is also no fear of peel-off of the orifice plate as in the prior art.

Figure 42:
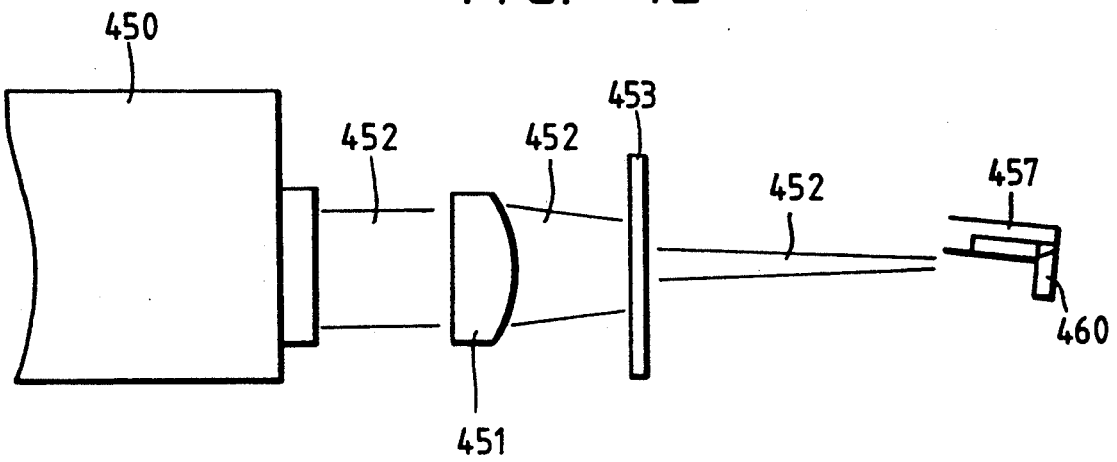
FIG. 42 is a schematic view of orifice manufacturing device using excimer laser light.

FIG. 42 shows another embodiment of the present invention in which orifice working is performed by excimer laser beam on the orifice plate formed integrally with the ceiling plate, and the same elements as those shown in FIG. 40 are attached with the same symbols. In FIG. 40, 450 is a laser oscillating device for oscillating KrF excimer laser beam, 452 a pulse laser beam with a wavelength of 248 mm and a pulse width of about 15 nsec oscillated from the laser oscillating device 451, 453 a synthetic quartz lens for converging the laser beam 452, 454 a projection mask having aluminum capable of shielding the laser beam 452 vapor deposited thereon, on which a plurality of holes of 133 μm in diameter are arranged at a pitch of 212 μm to constitute an orifice pattern.

Figure 43A:
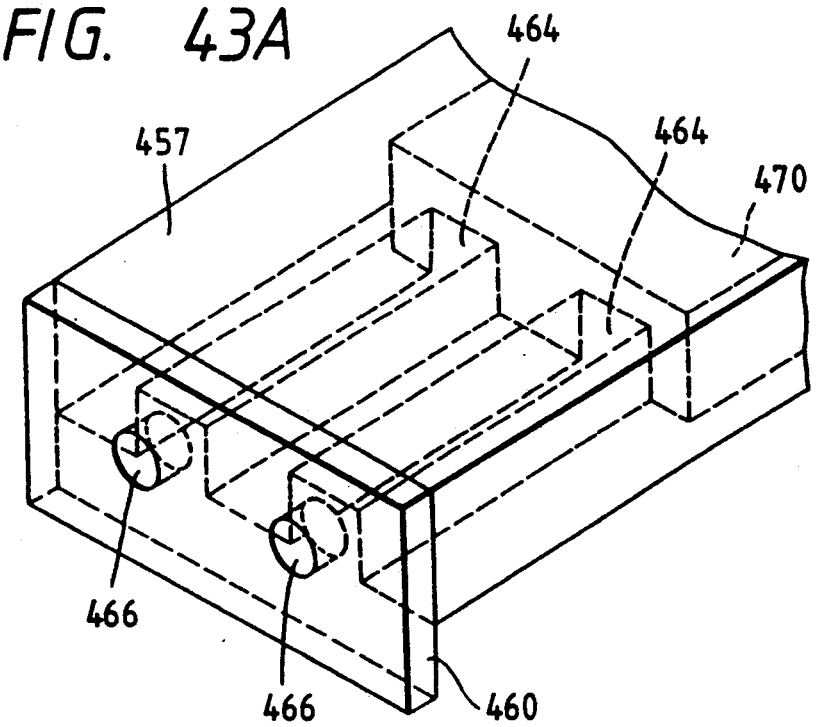
FIGS. 43A and 43B are respectively a perspective view and a cross section of ceiling plate with which orifice plate of ink jet recording head is made integral.

FIG. 43A shows a constitutional example of the ceiling plate 457 according to this example.

The ceiling plate 457 according to this example is made to have a desired number of ink channel grooves 464 and ink discharging orifices 466 formed on the orifice plate 460 corresponding thereto (two in the Figure for brevity) and an orifice plate portion 10 provided integrally.

In the constitutional example shown in FIG. 43A, the ceiling plate material 457 is simultaneously molded integrally together with the orifice plate 460 by use of a resin excellent in ink resistance such as polysulfone, polyethersulfone, polyphenyleneoxide, polypropylene, etc.

Next, the methods for forming the ink channel groove 464 and the orifice 466 are described.

As for the ink channel groove, a resin can be molded with a mold having a fine groove of reverse pattern thereto by such method as cutting, etc., and with the use of the mold, liquid channel groove 464 can be formed on the ceiling plate 457.

As for formation of orifice, within the mold, molding is effected under the state having no orifice 466 and excimer laser beam is irradiated by a laser device on the positions where orifices are to be formed from the ink channel side on the orifice plate 10 as explained in FIG. 42, followed by removal and evaporation of the resin, to form orifices 466.

Figure 43B:
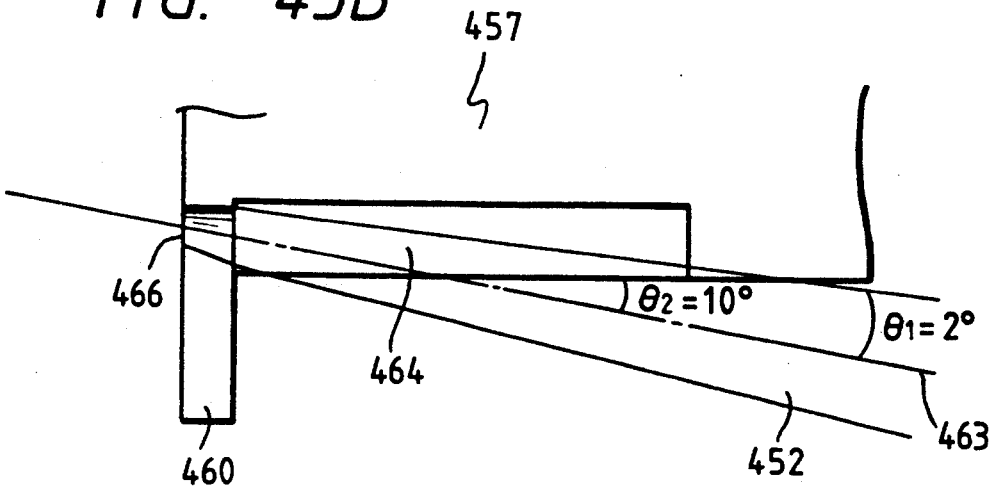

The details of orifice formation are shown in FIG. 43B. As is apparent from FIG. 43B, the excimer laser beam 452 is irradiated on the orifice plate 460 through the mask 454 as described above from the ink channel side 464. The excimer laser 452 is converged at $\theta_1=2°$ on one side with respect to the optical axis 463, and irradiated from the vertical direction of the orifice plate 460 with the optical axis 463 being slanted at $\theta_2=10°$.

Thus, by irradiation of the laser beam from the ink channel side, the cross-sectional area of the orifice having a tapered shape becomes reduced toward the discharging direction.

Figure 44:
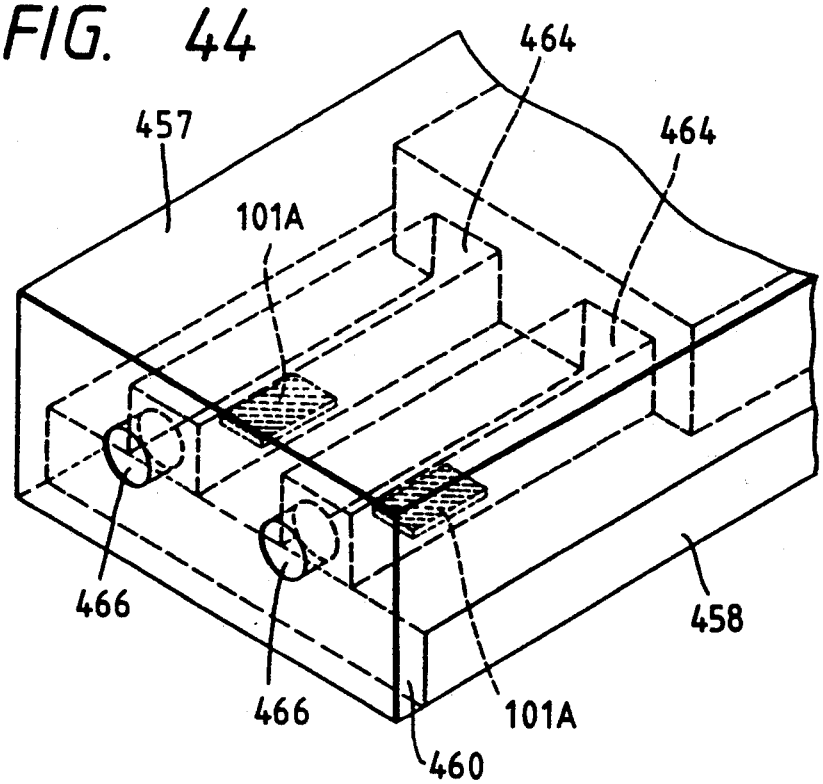
FIG. 44 is a perspective view of main body of ink jet recording head made by connecting heater board and ceiling plate of FIG. 43.

FIG. 44 is a perspective view of the main recording head constituted by bonding of the heater board 458 and the ceiling plate 457 as described above.

As shown in FIG. 44, the heater board 458 having the discharging heater 101A, etc. is bonded to the orifice plate 460 to obtain the main recording head.

According to such constitution as described above, since no registration or adhesion between the ceiling plate and the orifice plate required as in the prior art, there is no registration error or positional slippage during adhesion at all, whereby reduction in defective products and shortening of the steps could contribute to bulk productivity and lowering in cost of the recording head. Also, since there exists no adhesion step between the ceiling plate and the orifice plate, there is no fear of clogging of the orifices or ink flow channels by flowing of the adhesive. Further, since the position can be determined of the flow channel direction by abutting the heater board 458 against the end surface on the opposite side to the end surface on the discharging side of the orifice plate 460 during bonding of the heater board 458 and the ceiling plate 460 integrally made with the orifice plate 460, the whole registration step and assembling step can be made easier. In addition, there is also no fear of peel-off of the orifice plate as in the prior art.

Figure 45A:
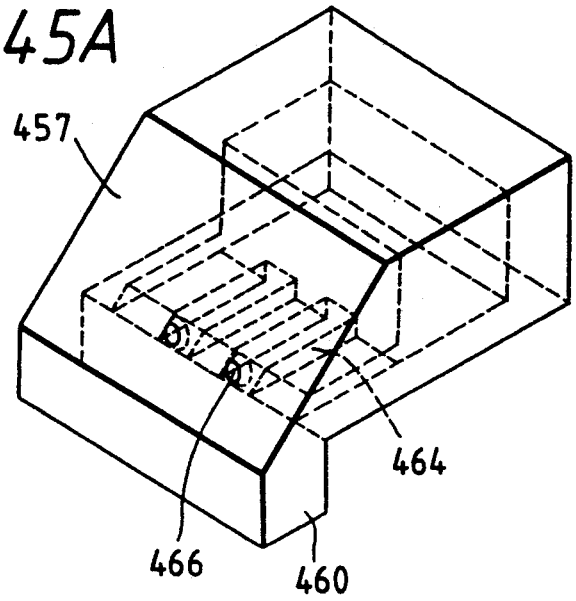
FIGS. 45A and 45B are respectively perspective view and cross section of ceiling plate with which orifice plate according to another embodiment is made integral.
Figure 45B:
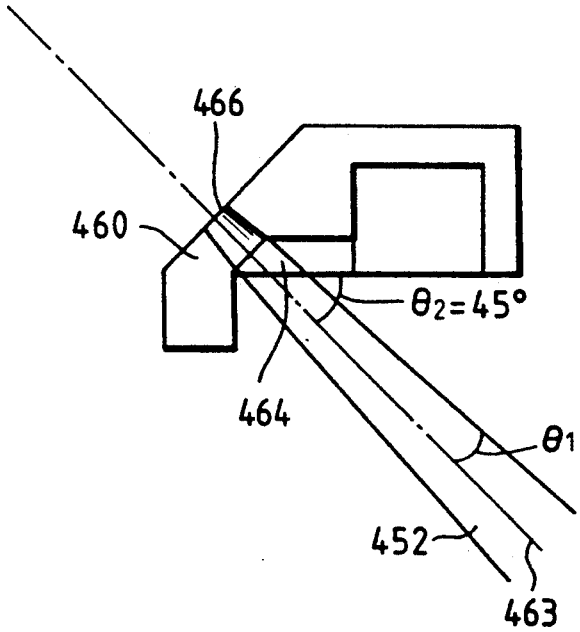

FIGS. 45A and 45B show another example of the present invention, and are respectively a perspective view and a sectional view of a ceiling plate having an orifice plate integral formed therewith.

This example has made the irradiation angle, namely $\theta_2$ as described above 45° corresponding to the shapes of the ceiling plate and the orifice plate. Thus, when laser beam is irradiated from the ink channel side, its irradiation angle is varied corresponding to the shape of the ceiling plate, etc.

Figure 46:
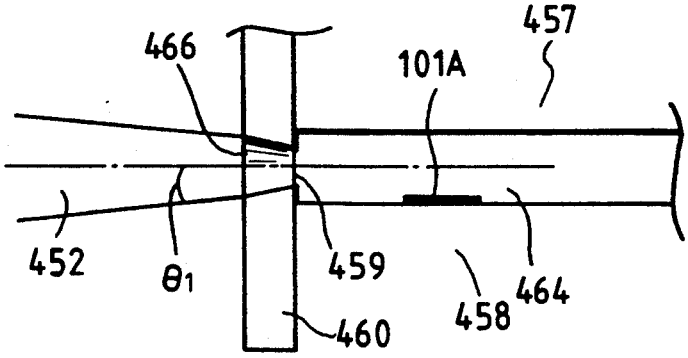
FIG. 46 is a cross section of one example of orifice.

Comparison of the results when recording was performed with the recording heads constituted by the above-mentioned two examples and the recording head of the prior art shown in FIG. 46 is shown in the following table.

| | Droplet discharging speed (average of 10 heads) | Recording result |
|---|---|---|
| Example (FIG. 43) | 8 m/s ± 10% | Good |
| Example (FIG. 45) | 9.3 m/s ± 8% | Good |
| Reference example (FIG. 46) | 4 m/s ± 40% | Passable |

As is apparent from the above table, when the recording head according to this example is used, the discharging speed is increased to two-fold or more, and consequently the shooting position precision of droplet can be improved to give good recording result. Also, when having such orifice shape as in this example, the volume of discharged liquid is understood to become larger, and this gives better result to the recording density.

In the above-mentioned two examples, the orifice plate and the ceiling are integrally combined, but application of the present invention is not limited thereto, but the desired effect can be of course obtained by bonding separately to the ceiling plate, and then applying the orifice working as described above thereon.

Figure 47:
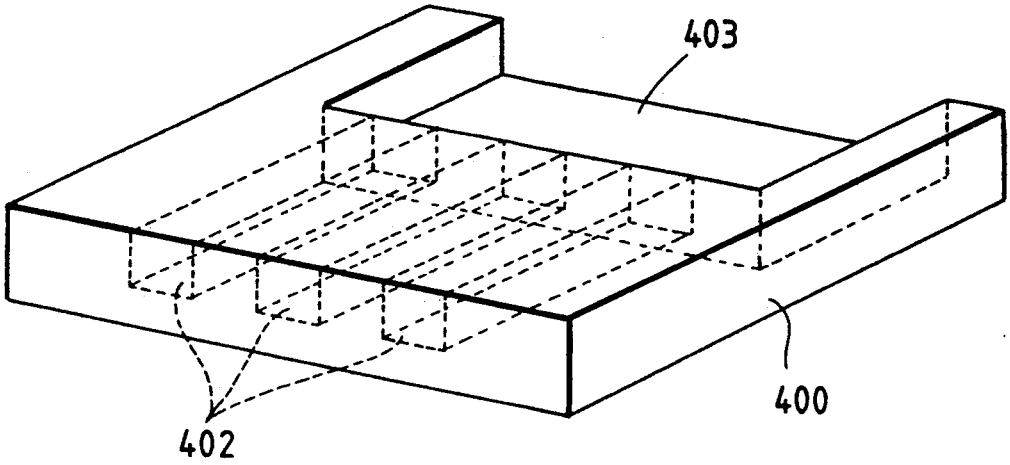
FIG. 47 is a perspective view of resin plate which has not been manufactured.

FIG. 47 is a perspective view showing one example of ceiling plate 400 shown in FIG. 7, representing the groove 403 for common liquid chamber and the groove 402 (dotted line) for ink channel, and the ceiling plate 400 is a resin molding. As the resin material, polyether sulfone, polyether ether ketone excellent in ink resistance can be used. Molding of the ceiling plate 400 is performed by use of a commercially available injection molding machine and a mold forming a pair with the shape shown in FIG. 47.

Figure 49:
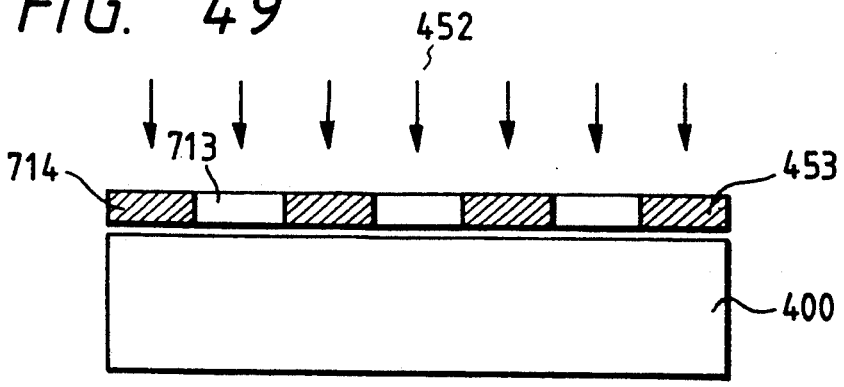
FIG. 49 is a view for explaining removing work by excimer laser via mask.
Figure 50:
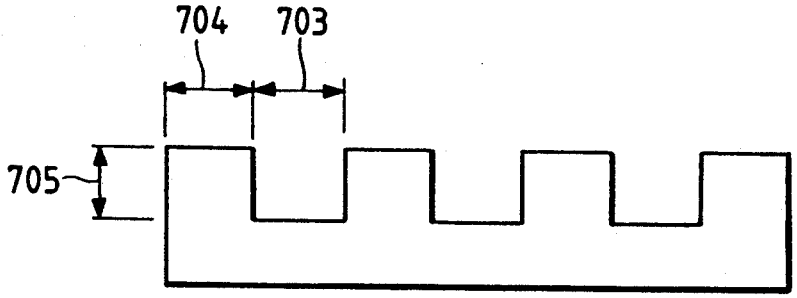
FIG. 50 is a schematic view of groove obtained work of FIG. 49.

On completion of injection molding, then after registration between the mask 453 having a transparent portion 713 and a nontransparent portion 714 corresponding to the pattern of the ink channel to the laser beam 452 of excimer laser as shown in FIG. 49, the resin molding surface shown in FIG. 47 is removed and eliminated with the laser beam passed through the transparent portion of the excimer laser beam to obtain a groove shape of ink channel as shown in FIG. 50.

The excimer laser used in this example is KrF excimer laser and also Arf excimer laser can be used.

As the mask material, a quartz substrate is used and the opaque portion 714 of the mask 453 is formed by Cr vapor deposition. The width 703 of the ink channel groove is made 32 μm corresponding to the constitution having 16 discharging outlets per 1 mm, and width 704 of the non-groove portion is made 31.5 μm.

Further, by irradiating KrF excimer laser by use Index 200 manufactured by Lumonix, Canada by way of 360 pulse irradiation at an energy density of 350 mJ/cm$^2$ per one pulse, a groove depth 705 of 30 μm is obtained.

Figure 48:
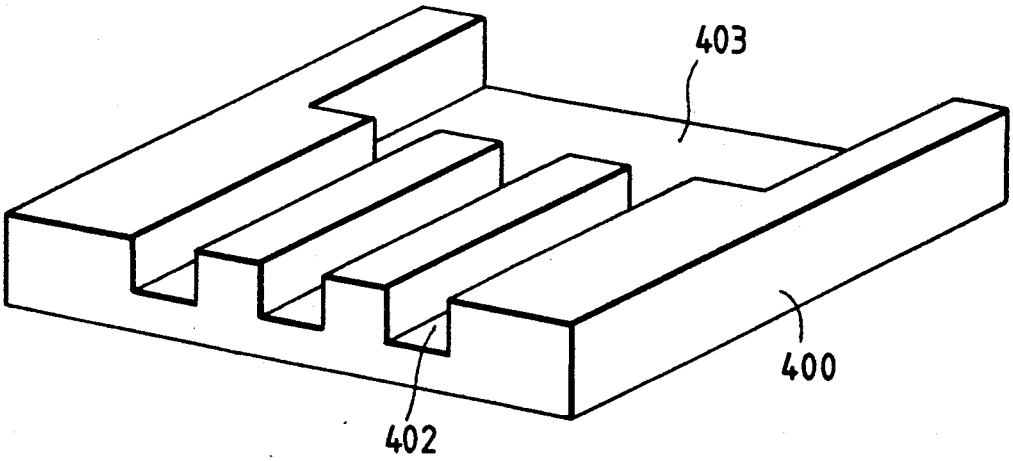
FIG. 48 is a perspective view of ceiling plate which has been manufactured by present embodiment.

From the above process, the resin molding shown in FIG. 47 becomes the ceiling plate having fine grooves for ink channel integrally as shown in FIG. 48.

Figure 51:
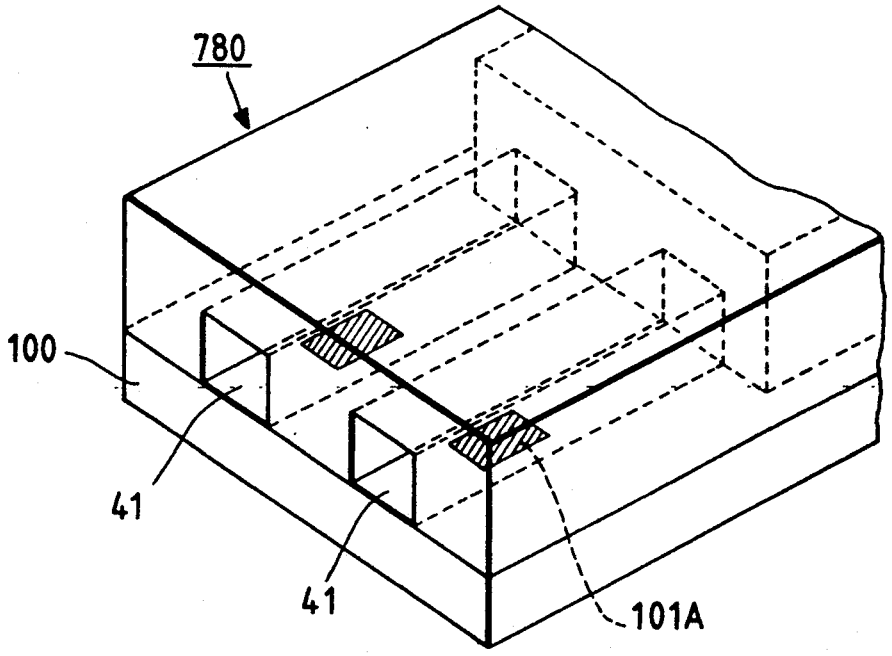
FIG. 51 is a schematic perspective view of main body of ink jet recording head obtained by using ceiling plate of embodiment.

Next, the ceiling plate 400 after being precisely washed is bonded to the heater board 100 having energy generating elements 101A such as heat generating elements, etc. arranged on a substrate which can be formed of glass, ceramics, Si, plastic, or metal, etc. as shown in FIG. 51 to constitute the main head 780.

In the FIG. 741 is ink discharging outlet (orifice) in the main head 780.

Figure 52:
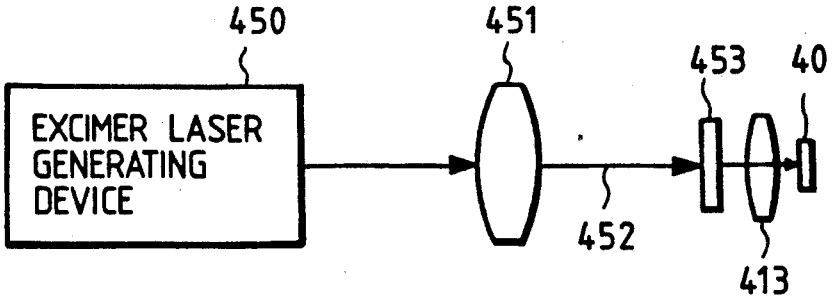
FIG. 52 is a schematic view of apparatus for manufacturing ink jet recording head of present invention.

FIG. 52 is a schematic view of an apparatus showing manufacturing manner of the orifice according to another embodiment. In FIG. 52, 450 is an excimer laser generating device, 451 is a lens for collecting laser beams 452 outputted from the generating device 451, 453 is a mask disposed between the generating device 450 and the orifice plate, 40 is an orifice on which the orifice is formed, 413 is a lens for collecting the laser beam for perforating the discharge opening on the orifice plate by projecting the mask 413.

Figure 53:
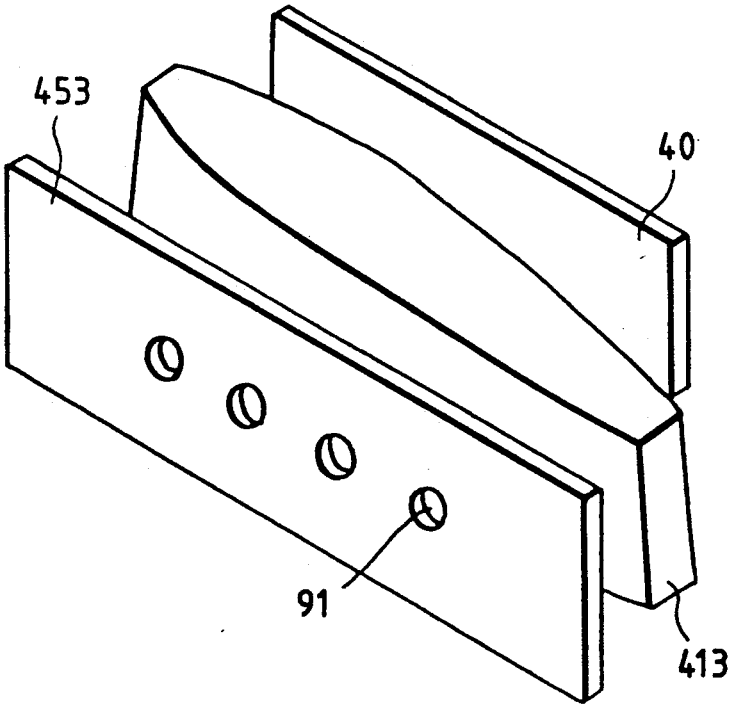
FIG. 53 is a perspective view showing mask and discharge opening forming member of FIG. 52.

FIG. 53 is a perspective view for showing detail of the mask 453 and orifice plate 40. On the mask 453 a transparent portion 91 is provided corresponding to a portion at which the orifice of orifice plate 40 is worked for causing the laser beam to transmit. In detail, the pattern provided on the mask 453 as the orifice will be worked on the film of orifice plate.

As shown in FIG. 53, although the number of orifices is plural this is merely illustrative. In fact, in the present embodiment the mask in which orifices of 360DPI, ϕ33 μm are arranged side by side linearly is used. In this construction, the laser beam 452 is irradiated to the plate 40 via the mask 453 to form the orifice. It is desirable for the mask not to be affected by heat due to laser irradiation, and for this reason material of low thermal coefficiency such as metal (for example Be-Cu) can be adopted.

In the orifice of orifice plate thus manufactured, there is no abnormal deformation around the orifice and circular configuration exactly following the configuration of the mask can be formed on the front and rear surfaces, which can be formed by such as carbon dioxide gas laser or YAG laser.

Figure 54:
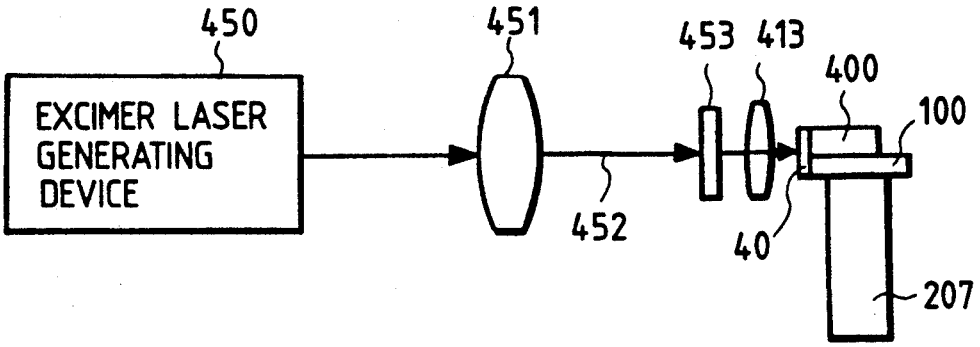
FIG. 54 is a schematic view of manufacturing device for discharge opening forming member suitable for carrying out manufacturing method of present invention.
Figure 55:
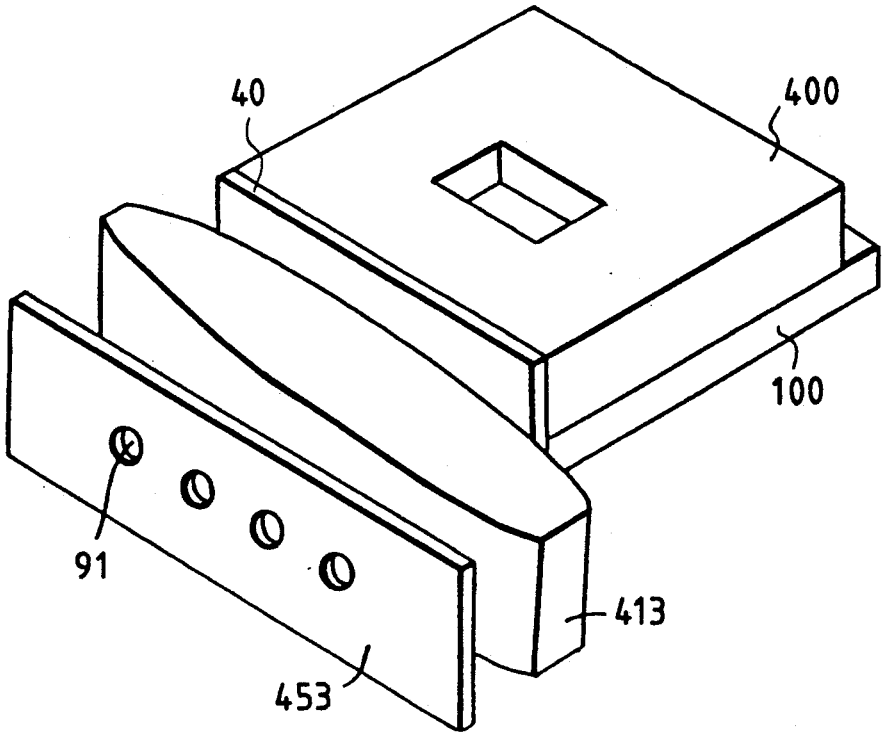
FIG. 55 is a perspective view showing mask and discharge opening forming member of FIG. 54.

FIG. 54 and FIG. 55 show respectively a schematic illustration of a preferable orifice working device for practicing the method for preparing the recording head of the present invention and a perspective view representing the details of the mask and the orifice plate obtained by said preparation method.

In this example, first, a glass material applied with grooving as the ceiling plate 400 and a heater board 100 having energy generating elements and wirings therefore, etc. provided on a Si wafer are bonded together, and then the bonded surface is subjected to ozone washing of the orifice plate 40, the ceiling plate 400 and the heater board 100, followed by coating of a silane coupling agent. The coating method is performed by transfer from a silane coupling agent A-187 (from Nippon Unicar K.K.) spin coated on a Si rubber of ϕ100, t=0.6.

Next, a dry film (Tokyo Ohka K.K. Se-320) as the material of the orifice plate 40 after peel-off of the protective film, polyether on one side is heated to about 40°-80° C. At this time, the ceiling plate 400 and the heater board 100 integrally combined are also heated at the same time. This heating is performed by use of a hot plate or a clean oven in this example.

After the dry film is heated for one minute, the dry film surface of the film and the ceiling plate-heater board are pushed against each other under a pressure of 2 to 10 kg/cm$^2$ for 1 to 10 seconds to be bonded together. Next, the composite is cooled gradually to room temperature (about 25° C.), followed by separation of the film from the ceiling-heater board. At this time, the dry film which becomes the orifice plate is separated from the other protective film of Mylar film to be bonded to the ceiling-heater board. Next, UV-ray is irradiated on the bonded dry film surface to effect curing of the film, and the recording head (ceiling plate-heater board-orifice plate) is fixed at a predetermined position comprising the constitution shown in FIG. 54, followed by registration of the recording head, the excimer laser and the mask. This registration is corresponded by making the stand 207 for fixing the recording head movable system in this example. After completion of registration, excimer laser light is irradiated on the orifice plate 40 through the mask 453 to effect working of the orifice 41.

According to the method as described above, it is not necessary to perform bonding by registration with high precision between the orifice plate having fine orifices and the ceiling-heater board, whereby the preparation steps of the ink jet recording head become simple.

Next, an example for making the orifice shape a more preferable shape by working with excimer laser is shown.

The orifice shape of the ink jet recording head in this example has been deemed to have desirably a shape which is narrower at the tip as nearer from the ink channel 804 toward the orifice 805. However, because it can be realized with difficulty in the preparation method of the prior art, most of its shape have been columnar.

Whereas, by use of excimer laser, and utilizing the specific feature that the shape of the hole is varied by changing the position of the focus by moving gradually the focusing lens during irradiation in working only of the orifice plate, also a converging orifice shape can be produced.

The principal part of the recording head prepared as described above is constituted as shown in FIG. 56. Shortly speaking, the angle $\theta$ of the discharging orifice 805 formed on the orifice plate 802 differs for each liquid channel 804, whereby the droplet will fly with curving of the discharging direction 807 for each discharging orifice 805 in substantially the same angle as the discharging orifice angle. For this reason, the recorded dot pitch d formed on the surface to be recorded 806 can be made smaller than the liquid channel pitch d' of the recording head.

Accordingly, as compared with the recording head of the prior art having the same recording pitch and discharging orifice pitch, the discharging orifice width can be taken larger, and also it has become possible to take also larger width of the discharging energy element. For this reason, energy efficiency can be improved to enhance the discharging speed. Further, since the cross-sectional area of the liquid channel can be enlarged, supplement of ink to the liquid channel becomes smooth, and therefore response frequency can be also improved, and further overall improvement of image quality can be improved.

Figure 56:
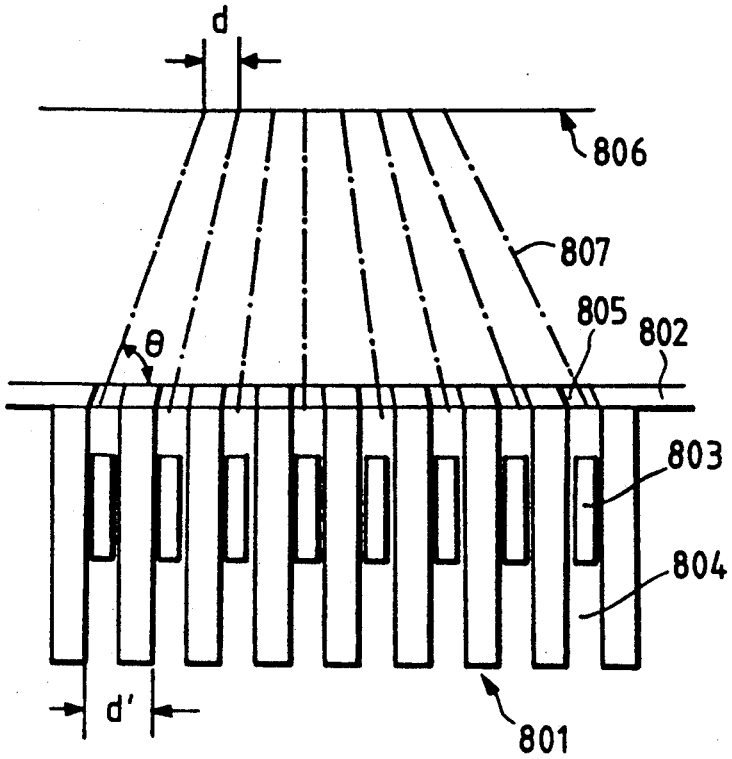
FIG. 56 is a schematic view illustrating a method of present invention.

Further, in the ink jet recording head shown in FIG. 56, by making the diameter of the discharging orifice at the outside portion smaller as compared with the discharging orifice at the central portion, the speed of the ink droplet discharged from the discharging orifice at the central portion with shorter flight length of the ink droplet can be made greater as compared with the speed of the ink droplet discharged from the discharging orifice at the outside portion with longer flight length of the ink droplet, and therefore the timings of the ink droplets shot finally onto the recording medium can be made the same very easily when the timings of the ink droplets discharged from the discharging orifices and their driving forces are the same for the respective discharging orifices.

In the examples as described above, the discharging orifice angles of the respective discharging orifices are formed in the converging direction, but in the present invention, if necessary, the discharging angles can be set variously for the respective discharging orifices.

For example, it is possible to constitute so that the above-mentioned incident angle may be different from the angle formed between the plane which is vertical to the above-mentioned discharging orifice surface and formed between the direction in which above discharging orifices are juxtaposed and the direction in which the ink is discharged from the above discharging orifices, and the above discharging orifice surface.

In the following, another example is described.

Figure 57:
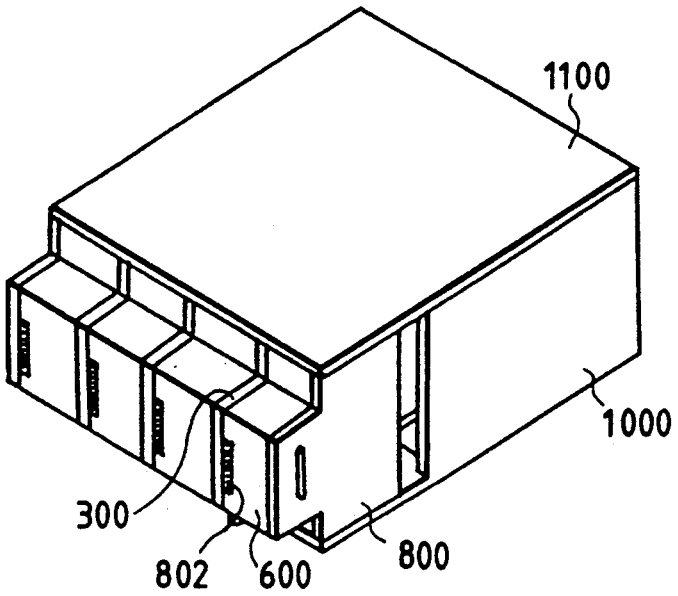
FIG. 57 is a perspective view of ink jet recording head of another embodiment of the present invention.

FIG. 57 is a schematic view of an ink jet recording head according to another example of the present invention, which head is disposable with an ink tank integrally combined.

The ink jet recording head shown in FIG. 57 is provided with four main recording heads, each constituted by bonding a ceiling plate having a concavity (hereinafter called "groove") for constituting ink channels and common liquid chamber, and further a discharging orifice forming member (orifice plate) 802 integrally formed and a substrate (hereinafter called "heater board") having an electricity-heat converter for generating discharging energy (hereinafter called "discharging heater") and an Al wiring for supplying electrical signals thereto formed by the film forming technique on a Si substrate.

Also, in the Figure, 600 is a sub-ink tank arranged adjacent to the main recording head, and the sub-ink tank 600 and the above main body are supported by lids 300 and 800. Further, 1000 is a main cartridge and 1100 is the lid member of the main cartridge. Internally of the main cartridge is built in an ink tank, which supplies suitably ink to the sub-ink tank 600.

Figure 58A:
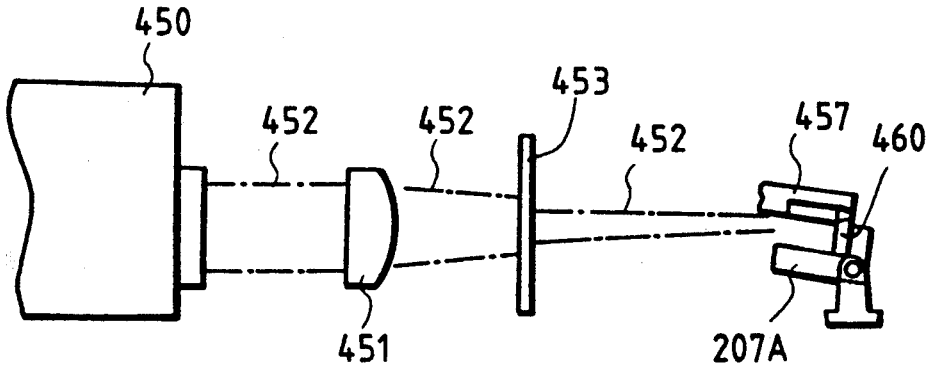
FIGS. 58A and 58B are both schematic views illustrating device for entering laser beam to form discharge opening.
Figure 58B:
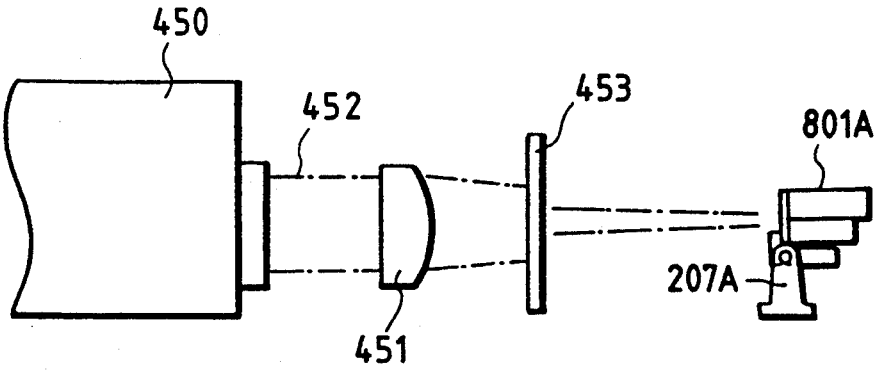

FIGS. 58A and 58B show the manner in which orifice working is performed by excimer laser beam on the orifice plate formed integrally with the ceiling plate. That is, FIG. 58A is a schematic view of the device in which the laser beam is incident so as to form discharging orifices from the ceiling concavity side, and FIG. 58B from the discharging orifice side. In the same Figure, 450 is a laser oscillating device for oscillating KrF excimer laser beam, 452 a pulse laser beam with a wavelength of 248 mm and a pulse width of about 15 nsec oscillated from the laser oscillating device 450, 451 a synthetic quartz lens for converging the laser beam 452, 453 a projection mask having aluminum capable of shielding the laser beam 452 vapor deposited thereon, on which a plurality of holes of 133 μm in diameter are arranged at a pitch of 212 μm to constituted an orifice pattern.

460 is an orifice plate for forming the discharging orifices and 801A is an ink jet recording head, both of which are fixed on an implement 207A which can be freely rotated relative to the laser beam 452.

Figure 59:
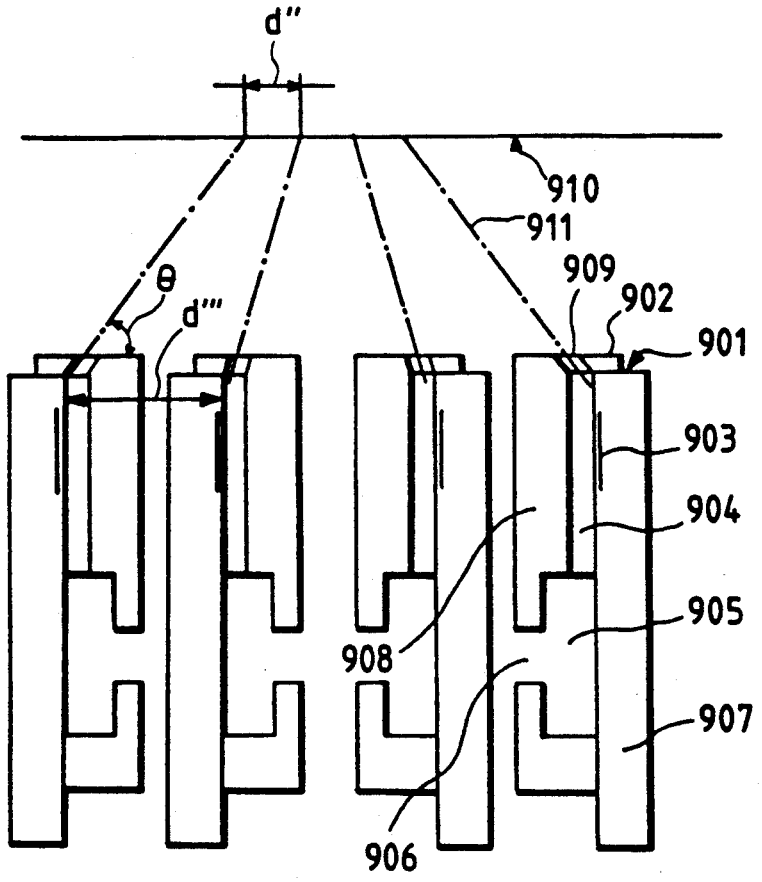
FIG. 59 is a schematic explanation view for showing partial construction of ink jet recording head manufactured by present invention.

The principal portion of the recording head prepared as described above has the constitution as shown in FIG. 59.

Shortly speaking, the discharging angle θ of the discharging orifice 909 formed on the orifice plate 902 differ for each head 901, and therefore the droplet will fly with the discharging direction 911 of each head being curved substantially the same as the discharging angle. Accordingly, the recording dot pitch d" for each discharging orifice row formed on the surface to be recorded 210 can be made smaller than the distance d''' between the discharging orifice rows of the recording head.

In the recording head having a plurality of discharging rows of the prior art, since the distance between the respective discharging orifice rows is the same as the recording dot row distance, greater memory size is required for taking timing for each recording dot row, but in the present invention, the distance between the recorded dot rows can be taken smaller, whereby the cost of the main printer can be made lower. Particularly, such constitution is very effective in the case of color printing where the discharging orifice rows must be divided corresponding to the respective colors.

Figure 60:
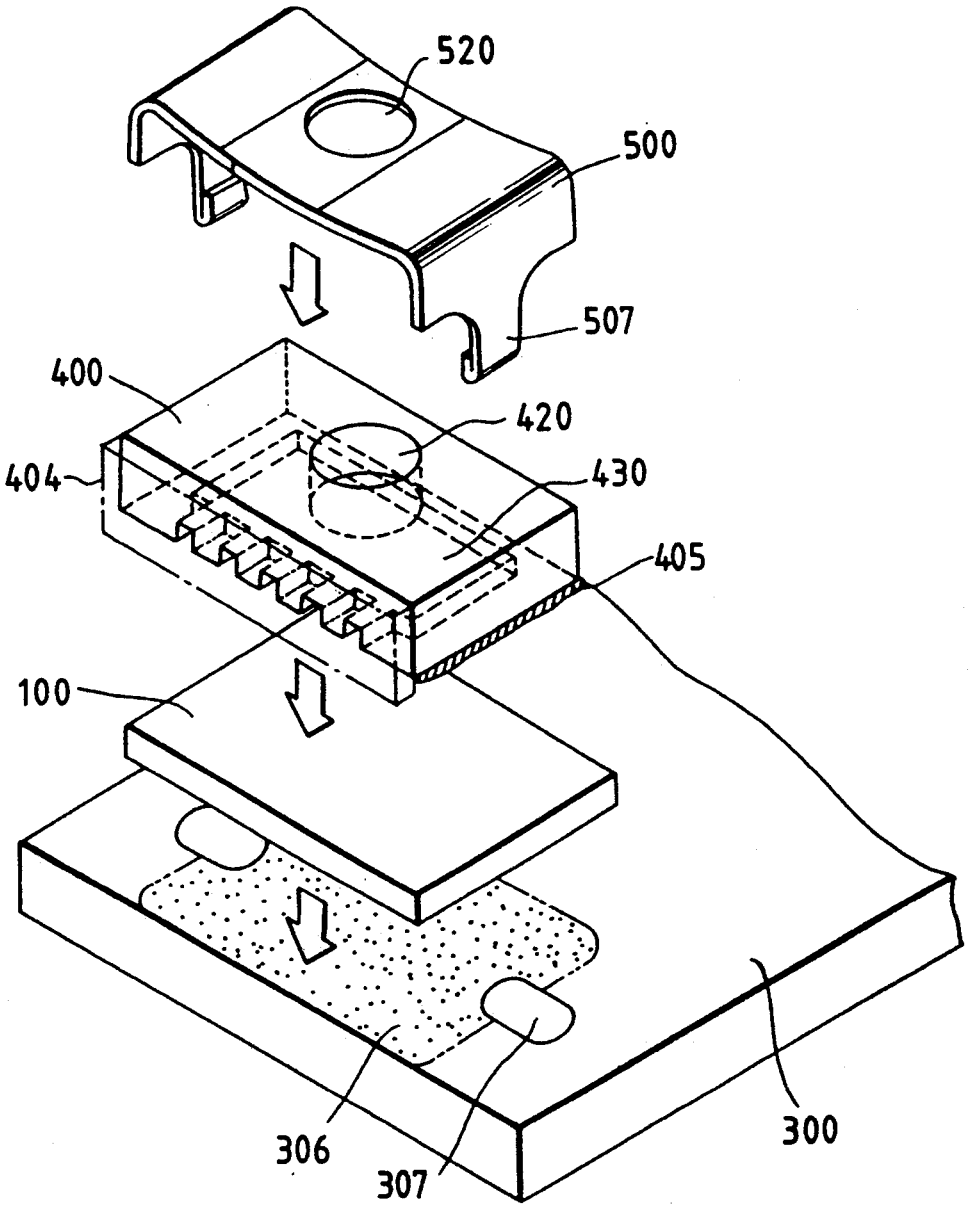
FIGS. 60 and 61 are views for explaining connected or assembled state of recording head body.

FIG. 60 shows an embodiment which bonds or fixes the heater board 100 and the ceiling plate 400. In FIG. 60, for simplification, the orifice plate portion 404 of the ceiling plate 400 is shown by the chain line, and showing of the wiring pattern on the heater board 100 is omitted.

As described above, the registration of the heater board 100 and the ceiling plate 400 is performed by abutting the end surface of the heater board 100 against the orifice plate portion 404, and in bonding of these, the adhesive 405 was coated along the 3 sides of the peripheral portion of the ceiling plate 400. By doing so, flowing of the adhesive into the ink flow channel could be inhibited. Further, it is also possible to permit an adhesive to exist over a suitable range in necessary and sufficient amount at the bonding surface between the heater board 100 and the orifice plate 404.

In this example, as the adhesive 405, a photocurable type adhesive UV-201 (Grace Japan K.K.) is used, and after registration cured by irradiation with UV-ray of, for example, 10—30J/cm$^2$ to fix the both. Here, since the existing portion of the adhesive 405 is apart from the discharging outlet, the tolerable value of trial number during registration is increased.

Next, the main recording head obtained by integration of the ceiling plate 400 and the heater board 100 in this way is fixed onto the support 300 by use of an adhesive 306. As the adhesive 306, for example, HP2R/2H manufactured by Canon Chemical K.K. can be employed.

Under this state, both the substrates (the heater board 100 and the ceiling plate 400) are adhered only at the peripheral portions other than the flow channel portion as described above, and no sufficient adhesion is obtained. Accordingly, an urging force of the pressing spring 500 is permitted to act from the upper side of the ceiling plate 400. The pressing spring 500 can be formed by use of, for example, phosphorous bronze or stainless steel. By fitting the nails 507 provided at the lower portions of both ends into the hole portions 307 provided at the support 300 thereby engaging both, mechanical pressure is applied from the upper portion of the ceiling plate 400. In this way, sufficient adhesion state between the both substrates can be obtained. In the pressing spring 500, 520 is a hole which receives insertion of the feeding pipe for connecting the ink introducing inlet 420 of the ceiling plate 400 to the ink feeding inlet on the feeding tank 600.

In this example, in bonding of the ceiling plate 400 with the heater board 100, a photocurable type adhesive is used, but its form may be any desired one or no adhesive may be required to be used, if sufficient fixing force or adhesion force can be obtained with the pressing spring 500. For example, only for the purpose of enhancing liquid sealability, a suitable sealing material, namely a sealing member such as sealant or rubber packing, etc. can be used. Also, similarly, if sufficient fixing force of the main head body can be obtained through engagement between the nail 507 of the pressing spring 500 and the hole portion 307 of the support 300, no adhesive 306 may be employed.

According to this example, since sufficient bonded state can be obtained without coating of an adhesive on the surface of the flow channel wall of the ceiling plate 400, the coating step of the adhesive can be simplified. Also when slippage occurred during registration in the prior art, there was a fear of sticking of adhesive to the flow channel portion at the discharging heater 105, etc. of the heater board 100, or occurrence of defective product by clogging of the flow channel or discharging outlet with adhesive, but no such phenomenon occurs in this example, and registration can be done for many times. Further, presence of more or less deformation, warping or variance in product in the ceiling plate by use of a resin material is permissible and therefore the manufacturing steps can become simple.

Figure 61:
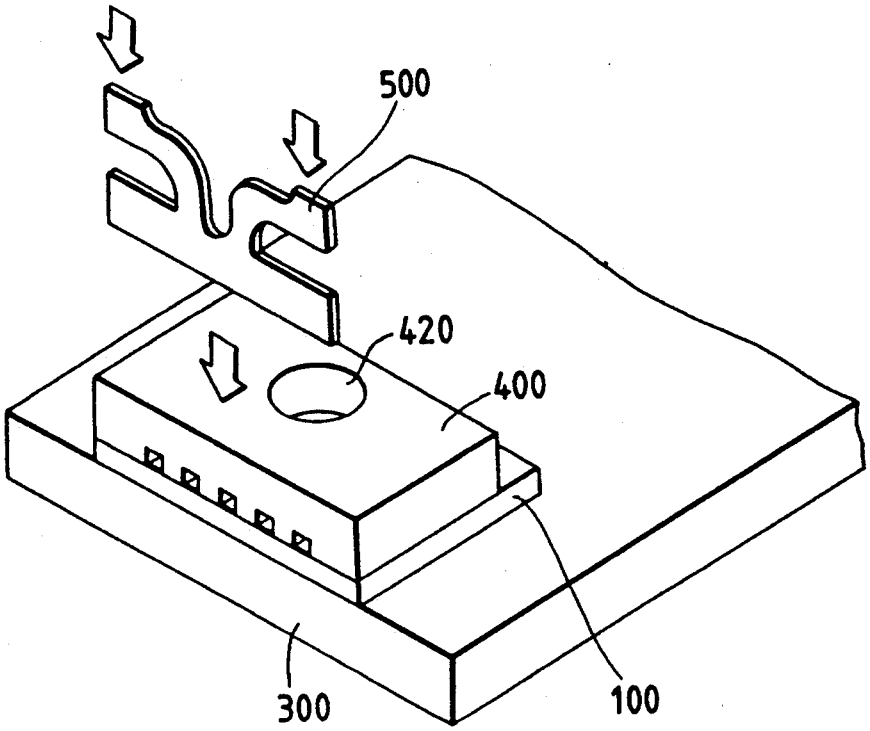

FIG. 61 is a modification example of the constitution shown in FIG. 60. In this Figure, showing of the orifice plate 404 in the ceiling plate 400 is omitted.

In this example, similarly as in the example shown in FIG. 60, the structure is made to obtain sufficient adhesion by applying pressure with a plate spring 500 in flat shape from the upper surface of the ceiling plate 400 under the state where the main recording head comprising the heater board 100 and the ceiling plate 400 is bonded to the support 300. The plate spring 500 is further pressurized by another member of the upper part (e.g. feeding tank 600 in FIG. 7).

Also, according to this example, the same effect as in the constitution shown in FIG. 60 could be obtained.

Figure 62:
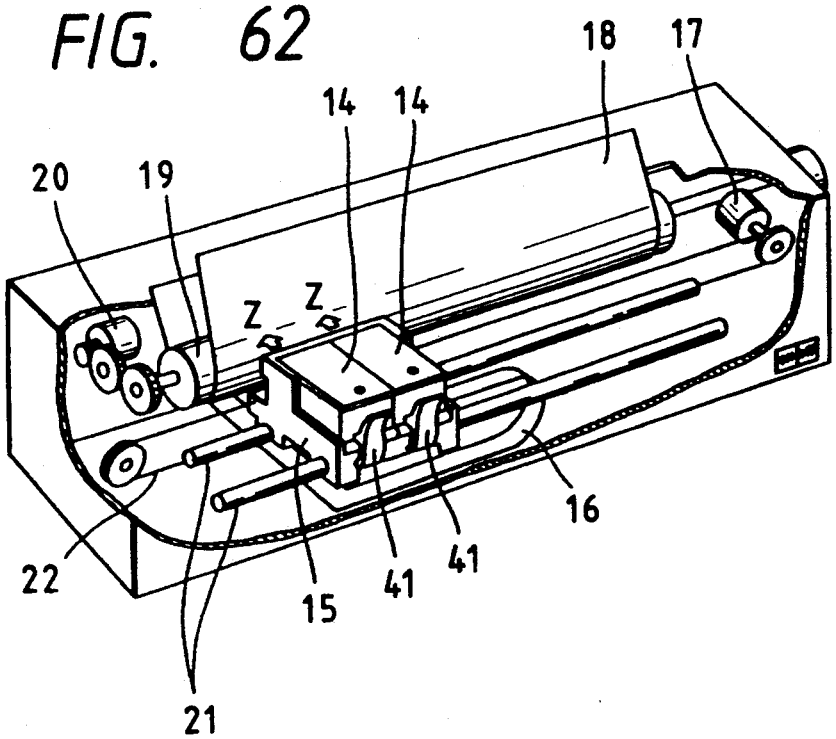
FIG. 62 is a perspective view showing one embodiment of ink jet printer constructed by using cartridge as shown in FIG. 7.

By assembling the respective parts with the constitutions as described above according to the steps in FIG. 7A, the cartridge as shown in FIG. 7B can be obtained and further an ink jet printer as shown in FIG. 62, namely an ink jet printer by use of a disposable cartridge can be constituted by use of this.

In FIG. 62, 14 is the cartridge shown in FIGS. 7A and 7B, the cartridge 14 is fixed on the carriage 15 by a pressing member 41, and these are made reciprocally movable in the lengthy direction along the shaft 21. Also, registration relative to the carriage 15 can be effected by, for example, the hole provided on the support 300 and the dowel provided on the carriage 15 side. Further electrical connection may be obtained by joining of the connector on the carriage 15 to the connecting pad provided on the wiring substrate 200.

This ink discharged by the recording head reaches a recording medium 18 with the recording surface regulated by a platen 9 to form an image on the recording medium 18.

To the recording head are supplied discharging signals corresponding to the image data from a suitable data supplying source through the cable 16 and the terminals connected thereto. The cartridge 14 can be provided in one or plural number (two in the Figure) corresponding to the ink colors, etc. used.

In FIG. 62, 17 is a carriage motor for scanning the carriage 15 along the shaft 21, 22 is a wire for transmitting the driving force of the motor 17 to the carriage 15. 20 is a feed motor jointed with the platen roller 19 for conveying the recording medium 18.

In the ink jet printer by use of such disposable cartridge 14, the cartridge 14 is changed when there is no ink impregnated in the absorber 900, etc., and for that purpose, the cartridge 14 is desired to be low in cost. Since the cartridge 14 as described in the above examples can be produced by simple production steps and also with small number of steps, and therefore can be constituted at low cost, it is extremely suitable for disposable construction. Further, registration in assembling of the main recording head can be done correctly, and yet there occurs no variance in dimension or clogging of the flow channel, etc. by flowing of the adhesive, reliability is very high and also yield can be improved.

The present invention is not limited to the examples as described above, but various constitutions can be employed as a matter of course.

For example, in the above examples, the main recording head the ink supplying source, etc. are made integral and disposable, but the both may be separate bodies, and each is not necessarily required to be made disposable. This is because, even the main recording head may be the fixed type without the condition of simple exchange, simple and inexpensive constitution as described above will also constitute to the reduction in cost of the main printer.

Also, for the main recording head comprising the heater board 100 and the ceiling plate 400, ink flow channels and concavity for formation of the common liquid chamber are provided only on the ceiling plate side in the above examples, but these can be also provided on both thereof. Also, concerning the main recording head, discharging heater 105 is used so as to make the heat energy discharging energy in the above examples, an electricity-mechanical converting element which is deformed corresponding to current passage may be used to utilize the mechanical vibration as the discharging energy.

Further, in the above examples, the orifice plate portion 404 itself is made a constitution having the abutting portion against the heater board, but the shape, etc. of the abutting portion may be any desired one. For example, such abutting portion may be also provided in the side surface direction so as to effect registration in the lateral direction, or in place of providing such abutting portion, the registration may be made through the combination of dowel and hole. Also, if the registration poses no problem, no abutting portion or registration member is necessary. In other words, the ceiling plate may be in the form having the wall portion with the same surface as the bonding surface in front of the groove portion and having the discharging outlet formed thereat.

In addition, in the above examples, the ceiling plate and the heater board are adhered and bonded with a pressing spring, but if there is no problem in use only of an adhesive during said bonding, it is also possible to use a constitution without use of a pressing spring.

The present invention brings about excellent effects particularly in a recording head, recording device of the bubble jet system among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleus boiling corresponding to the recording information on an electricity-heat convertors arranged corresponding to the sheets or liquid channels holding liquid (ink), heat energy is generated at the electricity-heat convertors to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. No. 4,558,333, 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat convertors as the discharging portion of the electricity-heat converter Japanese Patent Laid-Open Application No. 59-138461 which discloses the constitution having the opening for absorbing pressure wave of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat convertors or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary stream color such as black etc., but also a device equipped with at least one of plural different colors or full color by color mixing, whether the recording head may be either integrally constituted or combined in plural number.

Summing up, according to the one aspect of the present invention, it is possible to omit the step for adhering the discharge opening forming member (orifice plate) in the assembling process of the recording head, which enables to omit or exclude the positioning upon adhering and to overcome the disadvantage such as clogging in the liquid path since no adhesive agent is used. Thus, whole of the manufacturing process of the recording head can be simplified. In the case the discharge opening forming member is partially thinned to form the discharge opening thereat, formation of the discharge opening is simplified and length of the liquid flow path located in front of discharge energy generating element can be shortened.

According to another aspect of the present invention, the cheap but reliable ink jet recording head can be obtained by the simple manufacturing process with a small number of steps.

According to other aspect of the present invention, it is possible to form the orifice on the orifice plate with high density, in high accuracy and under accurate positioning relative to the ink path or the like. As the result, by using the mask member properly, more small or fine plural orifices can be manufactured together, so the ink jet recording head can be manufactured simply and in low cost. Additionally, realization of high accuracy can improve character of the image to be recorded.

Furthermore, according to another aspect of the present invention, the discharge opening can be worked into the configuration desirable for ink discharge, workability of the discharge opening can be improved, and occurrence of bad influence resulted from working of the discharge opening can be prevented. As the result, by only adding the conventional working of the discharge opening to the discharge opening forming member preformed the discharge quality is increased and bad influence due to water-repellent treatment or the like can be prevented.

According to another aspect of the present invention, it is possible to obtain the ink jet recording head having tapered configuration whose cross-section decreases with respect to the discharge direction, which enables to stabilize the amount of ink droplet and the discharge speed necessary for recording. As the result, the discharge quality such as accuracy of adhering position and recording density is improved and the recording image at high quality can be obtained.

According to one embodiment of the present invention, the discharge opening plate is formed by providing the water repellent cover layer and adhesive agent layer onto the plate member on which no through hole for forming the discharge opening is formed, high or difficult technique which becomes necessary when forming these layers after formation of the through hole is not indispensable. Thus, the through hole can be worked with high yield and good workability. In addition, since the through hole for the discharge opening is perforated after formation of the water repellent cover layer the material for the water repellent cover layer would not go into the through hole, thus occurrence of problem in the prior art can be prevented.

Furthermore, since the adhesive layer for attaching the discharge opening plate to the main body of recording head, the plate can be attached to the main body by using the adhesive agent layer easily. There is no need for applying the adhesive agent onto the attaching surface of the main body. In connection therewith, since the adhesive agent layer is supplied to the periphery of the discharge opening, the problem occurred in the prior art can be prevented.

According to another aspect of the present invention, the discharge opening plate having the water repellent cover layer and the adhesive layer can be obtained by a simple and effective method. Furthermore, both layers are disposed at the predetermined position in the predetermined condition accurately, thus entry of these layers into the discharge opening can be prevented. For this reason, in the recording head using the discharge opening plate of the present invention, the manufacturing yield is improved, the poor ink discharge due to ink clogging at the discharge surface and connecting portion between the discharge opening plate and the main body of recording head would not occur. Thus, the proper printing character can be obtained, and reliability is increased. Furthermore, by carrying out sequence perforating after the adhesive agent layer and water repellent cover layer have been formed on for example the large plate, the treatment for each head which is effected in the prior art can be excluded. Thus, the number of steps in the discharge opening plate connecting process can be greatly decreased to thereby decrease the manufacturing cost of the recording head.

According to another aspect of the present invention, onto the plate-like member on which are formed the repellent ink layer, base film and adhesive agents layer sequentially, or the plate-like member on which the repellent ink layer, base film, adhesive agent layer and mold release film sequentially, the ink discharge opening is formed by press working, and the plate-like member is adhered to the surface on which the opening communicated with the ink path of the head body is formed by the adhesive agent layer, which enable to prevent occurrence of the clogging of ink discharge opening due to entry of the ink repellent treatment agent and adhesive agent and mass productivity will be increased. Furthermore, cheap ink jet head having high accuracy of ink discharge and the pitch of ink discharge opening can be manufactured.

According to another aspect of the present invention, because the water repellent treatment is made only to the portion which constructs outward wall surface of the discharge opening in the manufacturing process of the discharge opening plate, and because the through hole which forms the discharge opening upon water repellent treatment is filled with the resin and would not reach to the inner surface of the discharge opening, the water repellent treatment can be carried simply and effectively and accurately.

According to another aspect of the present invention, the water repellent treatment of the outer surface of the discharge opening plate is carried out securely and effectively by simple method which adds the applying process of the water repellent treatment agent during the manufacturing process of the discharge opening plate, which enables to realize the discharge opening plate of high quality which has been made water repellent treatment in low cost.

According to another aspect of the present invention, the ceiling plate in which the ink groove of fine configuration and the common chamber having several scores times of the ink path are integrally formed can be formed easily. In addition, high flatness of accuracy of the ink path can be realized by the working of excimer laser light. As the result, the process number can be decreased compared with the prior art, and the bad influence such as positioning shift, leakage of the recording liquid, flow-in of the adhesive agent into the ink path can be prevented. Thus, the ink jet recording head in which the ink discharge quality is increased can be obtained.

According to another aspect of the present invention, the orifice plate can be provided with each discharge opening angle peculiar to the discharge opening in high density and high accuracy, and the positional relation between the ink path or the like and the orifice can be determined accurately.

According to another aspect of the present invention, the discharge opening is formed obliquely on the orifice plate in high accuracy, and plural discharge openings (orifices) of different angles can be formed simultaneously on the plate. In addition, it is possilbe to form the discharge openings by changing or differentiating the discharge opening angle as the whole in every row of the discharging opening. As the result, an ink jet recording head capable of effecting the high speed recording of high quality can be made at low cost and simply.

We claim:

1. A method of manufacturing an ink jet heat having a first base plate provided with energy generating means for generating energy used for discharging ink, a second base plate provided with a recessed portion for forming a portion of an ink path, and a discharge opening member provided with ink discharge openings communicated with the ink path, wherein the ink path is formed by connecting the first and second base plates and the discharge openings and the ink path are communicated with each other by connecting the discharge opening member to the first base plate, said method comprising the steps of:

integrally forming the second base plate and a plate member, the plate member to be formed into the discharge opening member; and forming the discharge openings on the discharge opening member by irradiating a laser beam onto portions of the plate member to be formed into the discharge opening member from a side of the plate member where the ink path is formed and in a direction in which the ink is discharged; and connecting the first base plate and the second base plate such that the energy generating means and the recessed portion are opposed and the discharge opening member and the first base plate abut one another.

2. The method of claim 1, wherein the laser beam comprises an excimer laser beam.

3. The method of claim 1, wherein the integrally formed second base plate and plate member are formed by molding a resin.

4. The method of claim 1, wherein the energy generating means comprises an electro-thermal converting member for generating thermal energy.

5. The method of claim 1, wherein the laser beam is irradiated in an obliquely downward direction from a side of the plate member adjacent the second base plate.

6. The method of claim 1, further including the step of thinning an area of the plate member including portions to be formed into the discharge openings, prior to the step of forming discharge openings.

7. An ink jet head comprising:

a first base plate provided with energy generating means for generating energy used for discharging ink;

a second base plate provided with a recessed portion for forming a portion of an ink path; and a discharge opening member provided with discharge openings communicated with said ink path;

wherein said ink path is formed by connecting said first base plate and said second base plate so that said energy generating means and said recessed portion are opposed to each other, said discharge openings and said ink path are communicated by integrally forming said discharge opening member with said second base plate, said discharge opening member and said first base plate abut one another, and the discharge openings are formed on the discharge opening member by irradiating a laser beam onto portions of the discharge opening member to be formed into the discharge openings, the laser beam being irradiated from a side where the ink path is formed and in a discharge direction in which ink is discharged such that cross sections of said discharge openings decrease in the discharge direction.

8. The ink jet head of claim 7, wherein said second base plate said discharge opening member are formed integrally by molding a resin.

9. The ink jet head of claim 7, wherein said energy generating means comprises an electro-thermal converting member for generating thermal energy.

10. The ink jet head of claim 7, wherein said discharge openings are so formed that the ink is discharged obliquely upward from said discharge openings.

11. The ink jet head of claim 7, wherein an area of said discharge opening member including portions where said discharge openings are disposed is thinner than remaining portions of said discharge opening member.

12. An ink jet apparatus comprising:

an ink jet head including:

a first base plate provided with energy generating means for generating energy used for discharging ink, a second base plate provided with a recessed portion for forming a portion of an ink path, and a discharge opening member provided with discharge openings communicated with said ink path, wherein said ink path is formed by connecting said first base plate and said second base plate so that said energy generating means and said recessed portion are opposed to each other, said discharge openings and said ink path are communicated by integrally forming said discharge opening member with said second base plate, said discharge opening member and said first base plate abut one another, and the discharge openings are formed on the discharge opening member by irradiating a laser beam onto portions of the discharge opening member to be formed into the discharge openings, the laser beam being irradiated from a side where the ink path is formed and in a discharge direction in which ink is discharged such that cross sections of said discharge openings decrease in the discharge direction; and convey means for conveying a recording medium to be recorded by ink discharged from said discharge openings of said ink jet head.

13. An ink jet head cartridge comprising:

an ink jet head including:

a first base plate provided with energy generating means for generating energy used for discharging ink, a second base plate provided with a recessed portion for forming a portion of an ink path, and a discharge opening member provided with discharge openings communicated with said ink path, wherein said ink path is formed by connecting said first base plate and said second base plate so that said energy generating means and said recessed portion are opposed to each other, said discharge openings and said ink path are communicated by integrally forming said discharge opening member with said second base plate, said discharge opening member and said first base plate abut one another, and the discharge openings are formed on the discharge opening member by irradiating a laser beam onto portions of the discharge opening member to be formed into the discharge openings, the laser beam being irradiated from a side where the ink path is formed and irradiated in a discharge direction in which ink is discharged such that cross sections of said discharge openings decrease in the discharge direction; and an ink tank for supplying ink to said ink path of said ink jet head.

* * * * *

UNITED STATES PATENT AND TRADEMARK OFFICE

CERTIFICATE OF CORRECTION

PATENT NO. : 5,208,604

DATED : May 4, 1993

INVENTOR(S) : TAKASHI WATANABE, ET AL.

It is certified that error appears in the above-identified patent and that said Letters Patent is hereby corrected as shown below:

ON TITLE PAGE

In [30] Foreign Application Priority Data:
"Oct. 31, 1989" should read --Oct. 31, 1988--
(three occurrences).

COLUMN 2

Line 48, "source" should read --source,--.

COLUMN 4

Line 15 "comprised of," should read --comprises,--.
Line 31, "(PEEK)." should read --(PEEK),--.

COLUMN 7

Line 14, "have" should read --has--.

COLUMN 8

Line 38, "Dot" should read --dot--.

COLUMN 9

Line 20, "problem" should read --problems--.

COLUMN 10

Line 49, "comprising," should read --comprising--.
Line 56, "comprising," should read --comprising--.

UNITED STATES PATENT AND TRADEMARK OFFICE

CERTIFICATE OF CORRECTION

PATENT NO. : 5,208,604

DATED : May 4, 1993

INVENTOR(S) : TAKASHI WATANABE, ET AL.

It is certified that error appears in the above-identified patent and that said Letters Patent is hereby corrected as shown below:

COLUMN 11

Line 15, "comprising," should read --comprising--.
Line 29, "comprising," should read --wherein--.

COLUMN 12

Line 35, "emobodiment is manufactured;" should read --embodiment;--.

COLUMN 13

Line 53, "PREFERERRED" should read --PREFERRED--.

COLUMN 14

Line 16, "ceiling 400" should read --ceiling plate 400--.

COLUMN 15

Line 8, "3," should read --103,--.
Line 64, "with" (second occurrence) should read --of--.

COLUMN 17

Line 34, "wording" should read --working--.
Line 57, "an" should be deleted.

COLUMN 18

Line 42, "Myler," should read --Mylar,--.
Line 67, "248 mm" should read --248 nm--.

UNITED STATES PATENT AND TRADEMARK OFFICE

CERTIFICATE OF CORRECTION

PATENT NO. : 5,208,604

DATED : May 4, 1993

INVENTOR(S) : TAKASHI WATANABE, ET AL.

It is certified that error appears in the above-identified patent and that said Letters Patent is hereby corrected as shown below:

COLUMN 19

Line 40, "views" should read --view--.
Line 57, "a" should read --an--.

COLUMN 20

Line 15, "an" should be deleted.

COLUMN 21

Line 14, "of high precision perforation working" should read --perforation working of high precision--.
Line 41, insert: --Adhesive layer composition:--.
Line 62, "form" should read --to form--.

COLUMN 22

Line 51, "performation" should read --perforation--.
Line 67, "silicon" should read --silicone--.

COLUMN 23

Line 16, "silicon" should read --silicone--.
Line 55, "liquid" should read --head--.

COLUMN 25

Line 7, "31" should read --31°--.

UNITED STATES PATENT AND TRADEMARK OFFICE

CERTIFICATE OF CORRECTION

PATENT NO. : 5,208,604

DATED : May 4, 1993

INVENTOR(S) : TAKASHI WATANABE, ET AL.

It is certified that error appears in the above-identified patent and that said Letters Patent is hereby corrected as shown below:

COLUMN 29

Line 39, "required" should read --is required--.
Line 64, "248 mm" should read --248 nm--.

COLUMN 31

Line 4, "integral" should read --integrally--.
Line 59, "Arf" should read --ArF--.

COLUMN 32

Line 12, "FIG. 741" should read --Figure, 41--.
Line 18, "device 451," should read --device 450,--.
Line 20, "orifice" (second occurrence) should read --orifice plate--.
Line 23, "413." should read --453.--.

COLUMN 33

Line 37, "shape" should read --shapes--.

COLUMN 34

Line 63, "248 mm" should read --248 nm--.

COLUMN 35

Line 1, "constituted" should read --constitute--.
Line 17, "210" should read --910--.

UNITED STATES PATENT AND TRADEMARK OFFICE

CERTIFICATE OF CORRECTION

PATENT NO. : 5,208,604

DATED : May 4, 1993

INVENTOR(S) : TAKASHI WATANABE, ET AL.

It is certified that error appears in the above-identified patent and that said Letters Patent is hereby corrected as shown below:

COLUMN 37

Line 40, "constitute" should read --contribute--.

COLUMN 38

Line 17, "nucleus" should read --nucleate--.
Line 18, "an" should be deleted.
Line 51, "converter" should read --converter or--.

COLUMN 41

Line 41, "opening." should read --openings.--.
Line 46, "heat" should read --head--.

COLUMN 42

Line 45, "plate said" should read --plate and said--.

Signed and Sealed this

Twenty-fifth Day of October, 1994

Attest:

Bruce Lehman

BRUCE LEHMAN

Attesting Officer

Commissioner of Patents and Trademarks